United States Patent [19]

Willingham

[11] 4,136,492

[45] Jan. 30, 1979

[54] INDUSTRIALIZED BUILDING CONSTRUCTION

[76] Inventor: John H. Willingham, 1280 Estate Dr., Memphis, Tenn. 38117

[21] Appl. No.: 366,409

[22] Filed: Jun. 4, 1973

Related U.S. Application Data

[63] Continuation of Ser. No. 80,540, Oct. 14, 1973, abandoned, which is a continuation-in-part of Ser. No. 807,217, Mar. 14, 1969, abandoned.

[51] Int. Cl.[2] ..... E04H 9/06

[52] U.S. Cl. ..... 52/79.7; 52/30; 52/79.3; 52/79.4; 52/79.13; 52/79.14

[58] Field of Search ..... 52/79, 236, 73, 250, 52/251, 259, 606, 607, 609, 745

[56] References Cited

U.S. PATENT DOCUMENTS

| | | | |
|---|---|---|---|
| 2,419,843 | 4/1947 | Marten | 52/73 |
| 2,691,291 | 10/1954 | Henderson | 52/79 |
| 2,698,973 | 1/1955 | Zeckendorf | 52/236 |
| 3,105,999 | 10/1963 | Piazolo | 52/73 |
| 3,226,894 | 1/1966 | Burchardt | 52/227 X |
| 3,287,865 | 11/1966 | Lockman | 52/73 X |
| 3,550,334 | 12/1970 | Van Der Lely | 52/79 |
| 3,564,795 | 2/1971 | Henton | 52/236 |
| 3,710,534 | 1/1973 | McNamara | 52/236 |

FOREIGN PATENT DOCUMENTS

| | | | |
|---|---|---|---|
| 130683 | 12/1948 | Australia | 52/79 |
| 865652 | 12/1952 | Fed. Rep. of Germany | 52/79 |
| 1448310 | 6/1966 | France | 52/79 |
| 672208 | 10/1964 | Italy | 52/79 |

*Primary Examiner*—John E. Murtagh
*Attorney, Agent, or Firm*—LeBlanc & Shur

[57] ABSTRACT

The building construction disclosed employs precast elongated T-shaped elements (Tees) and/or modifications thereof. Vertical tiers or ranks of Tees are erected in side by side spaced relation one to the other. The stems of the Tees form opposite side walls of internal cells with the flanges of the Tees forming floors and ceilings. When employed, modified or half Tees are disposed in side by side relation and superposed one over the other to form vertically aligned hallways and elevator lobbies. An elevator tower is provided by a pair of modified Tees disposed on their ends to form a vertically extending channel with their stems attached to the elevator lobby Channels. The Tees are secured by welding, post tensioning devices or both. Several variations in construction employing the aforementioned construction elements are also disclosed.

13 Claims, 82 Drawing Figures

HW
VW
62
54
86
46
48
50
34
40
32
30
44
56

HV
VW
86
68
34
38
18
42
36
90

FIG. 7a
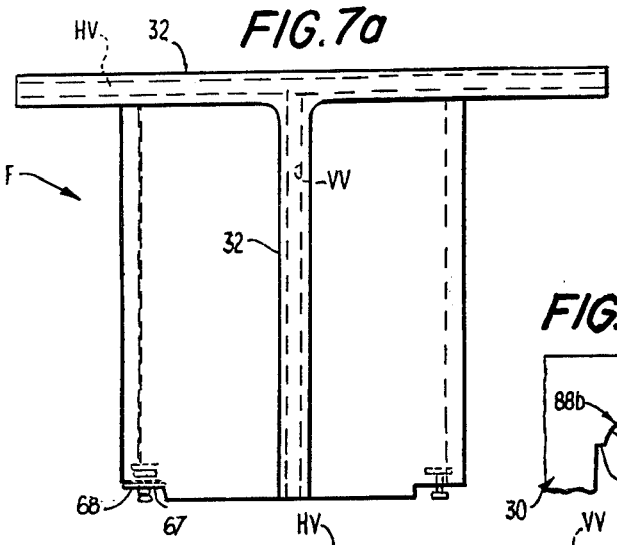
FIG. 8
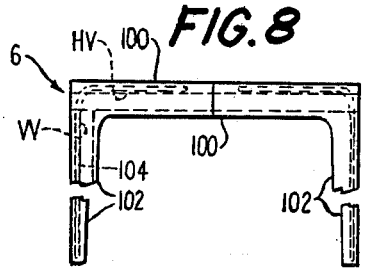
FIG. 7b
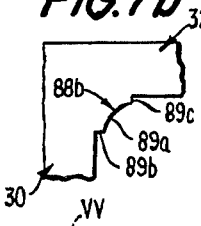
FIG. 7c
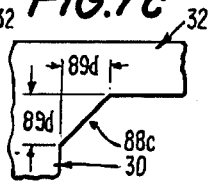
FIG. 7d
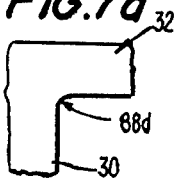
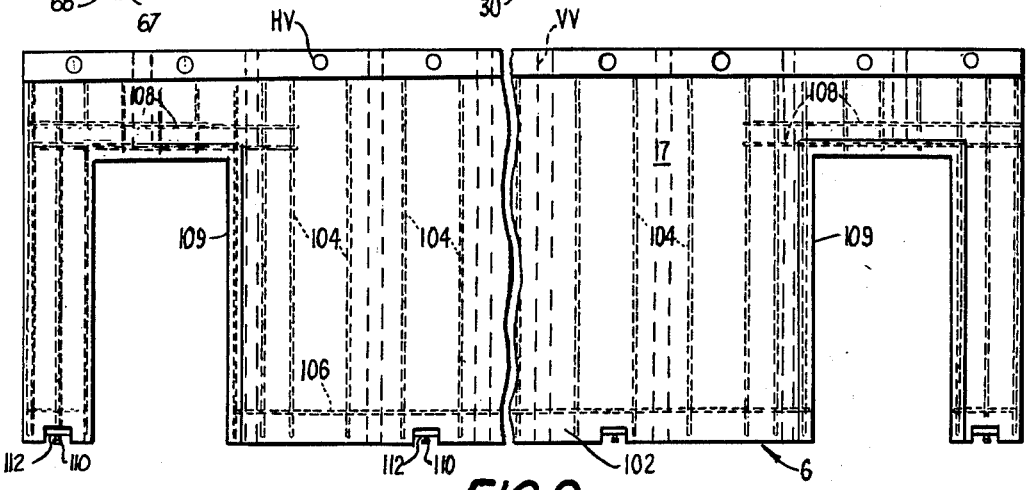
FIG. 10
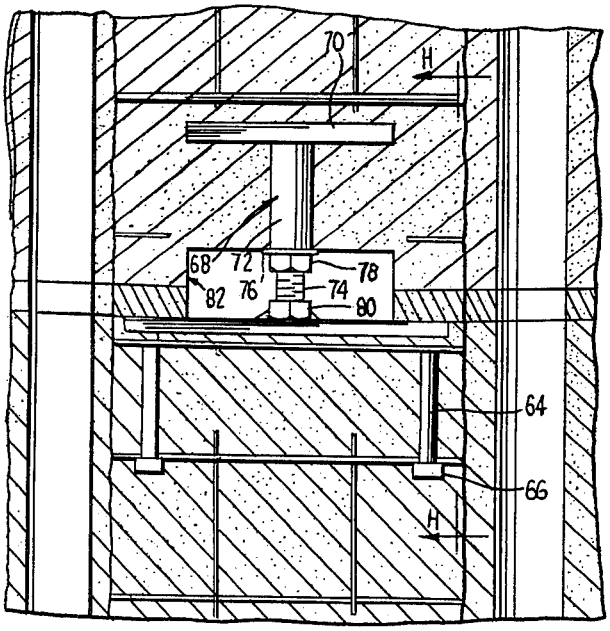
FIG. 9
FIG. 11
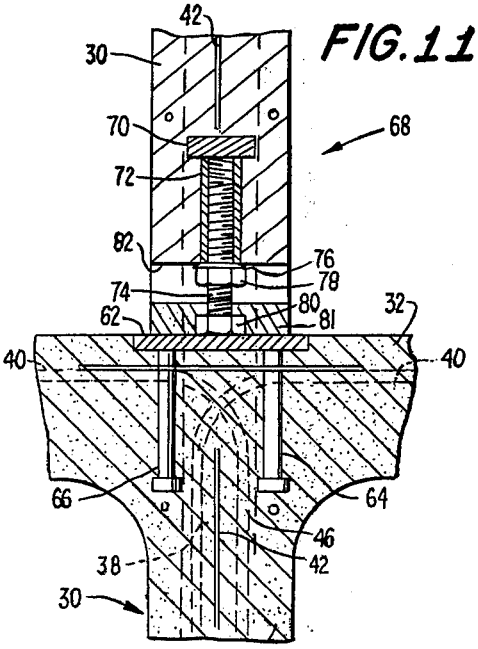

FIG. 12a
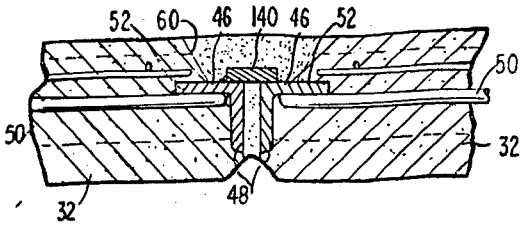
FIG. 12b
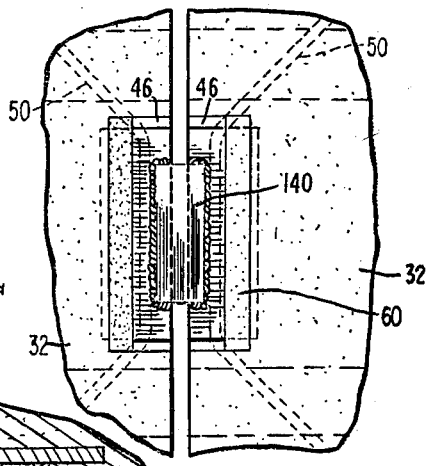
FIG. 13
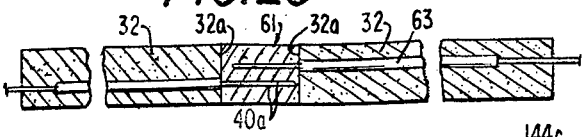
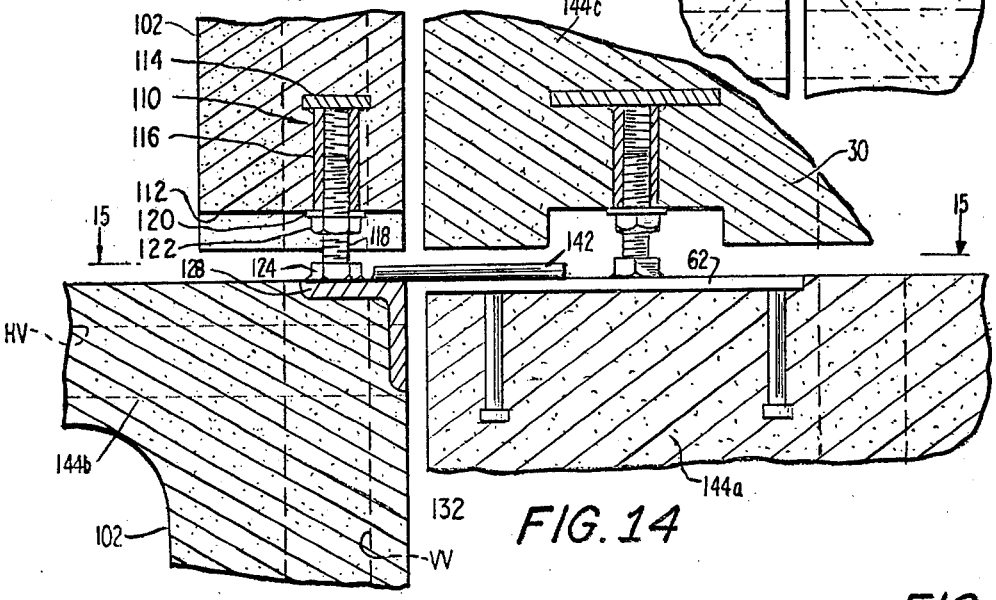
FIG. 14
FIG. 15
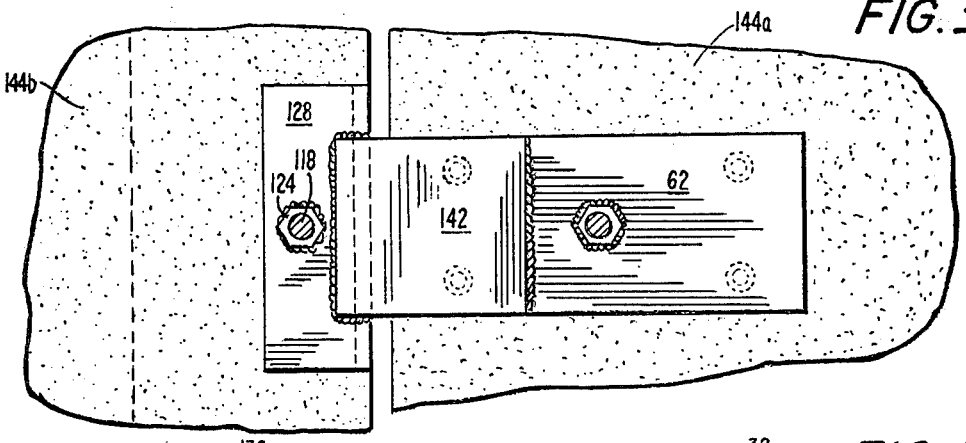
FIG. 16
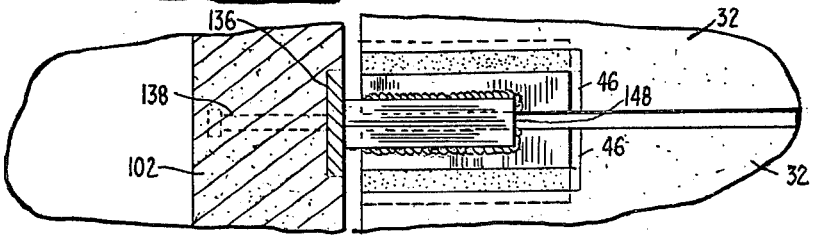

FIG. 17
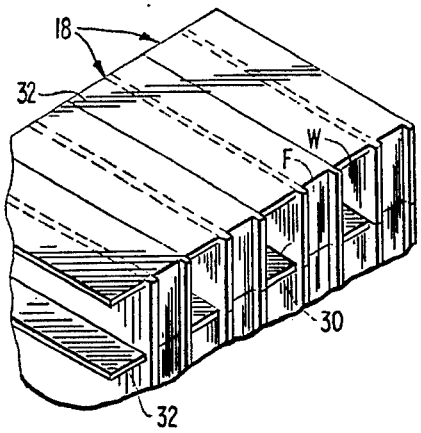
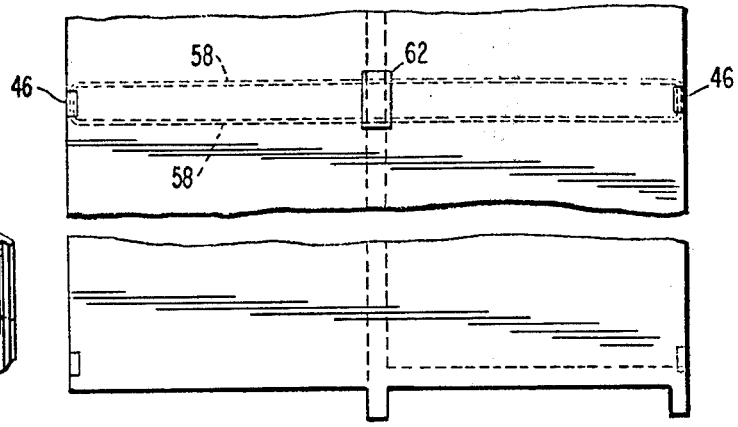
FIG. 18
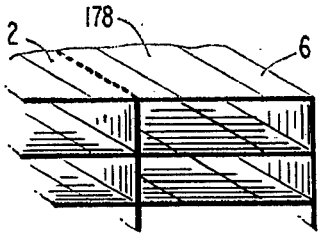
FIG. 30a
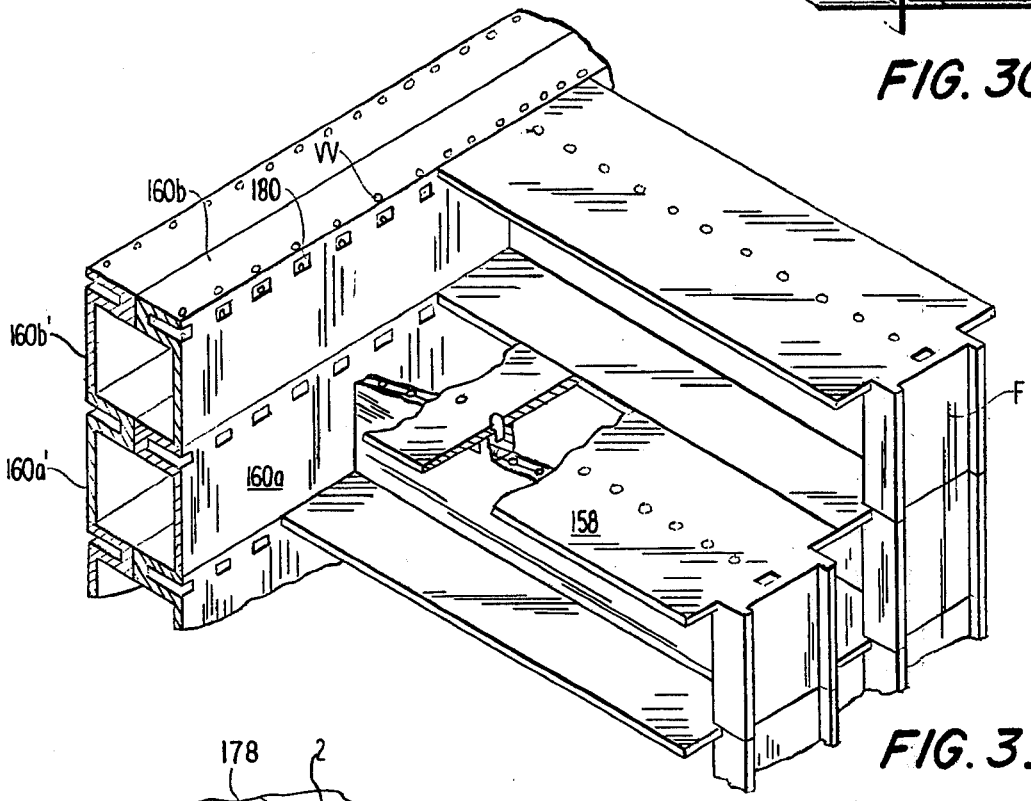
FIG. 31
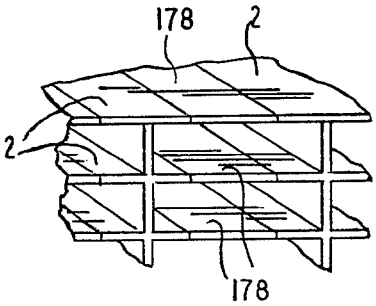
FIG. 30b FIG. 35
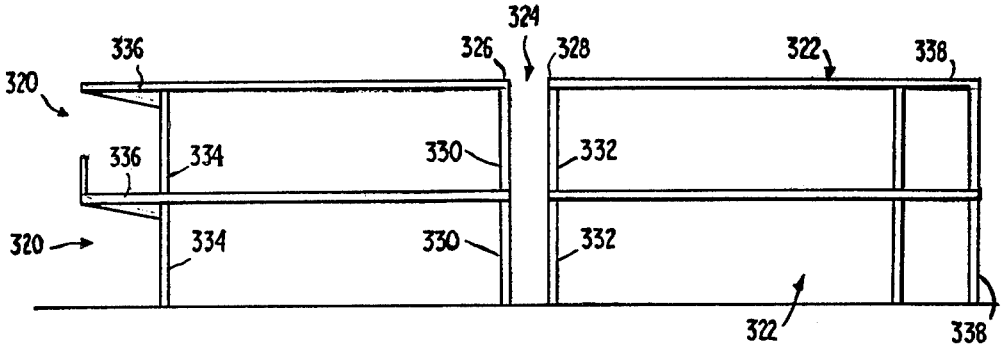
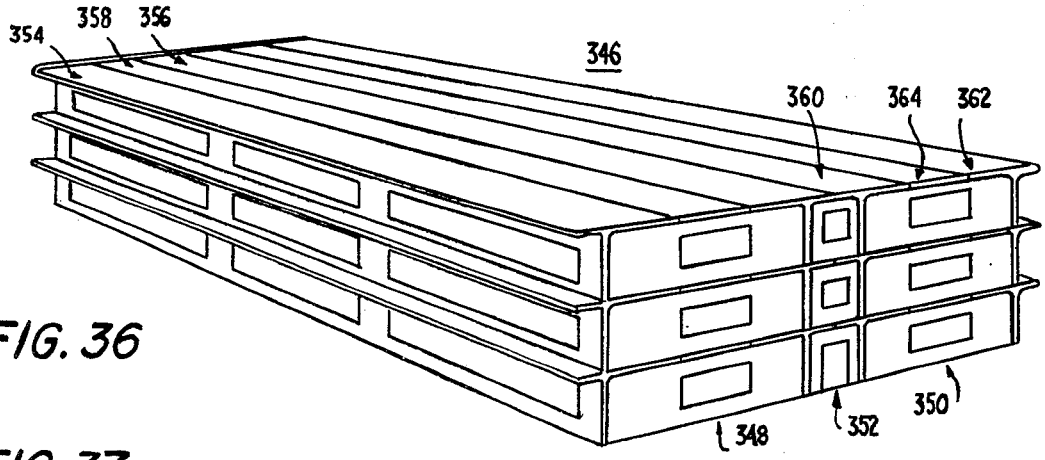
FIG. 36
FIG. 37
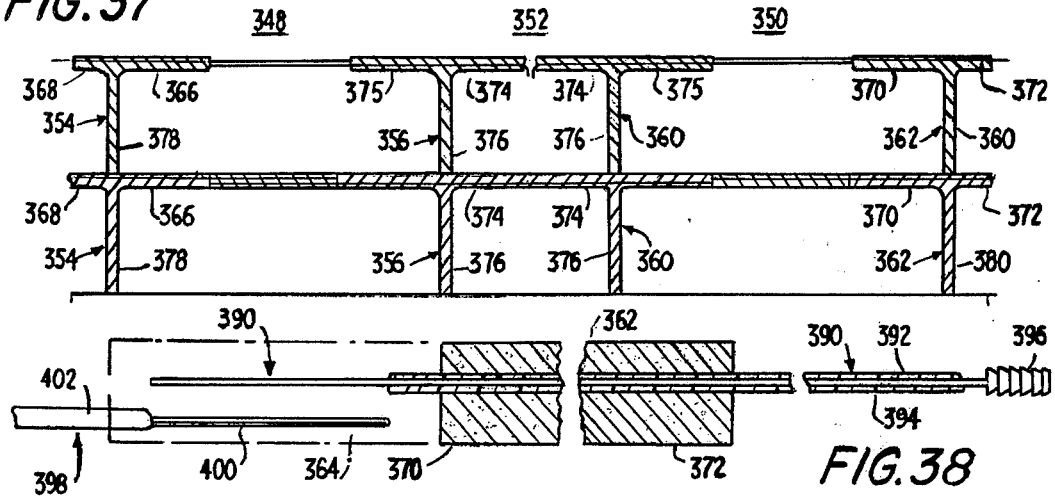
FIG. 38
FIG. 39
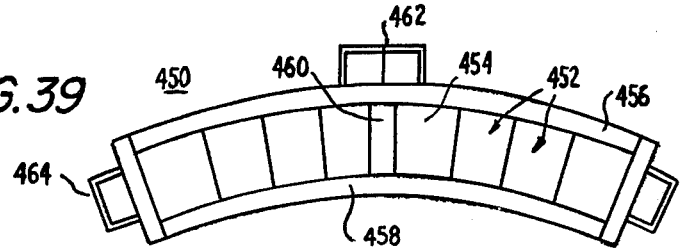

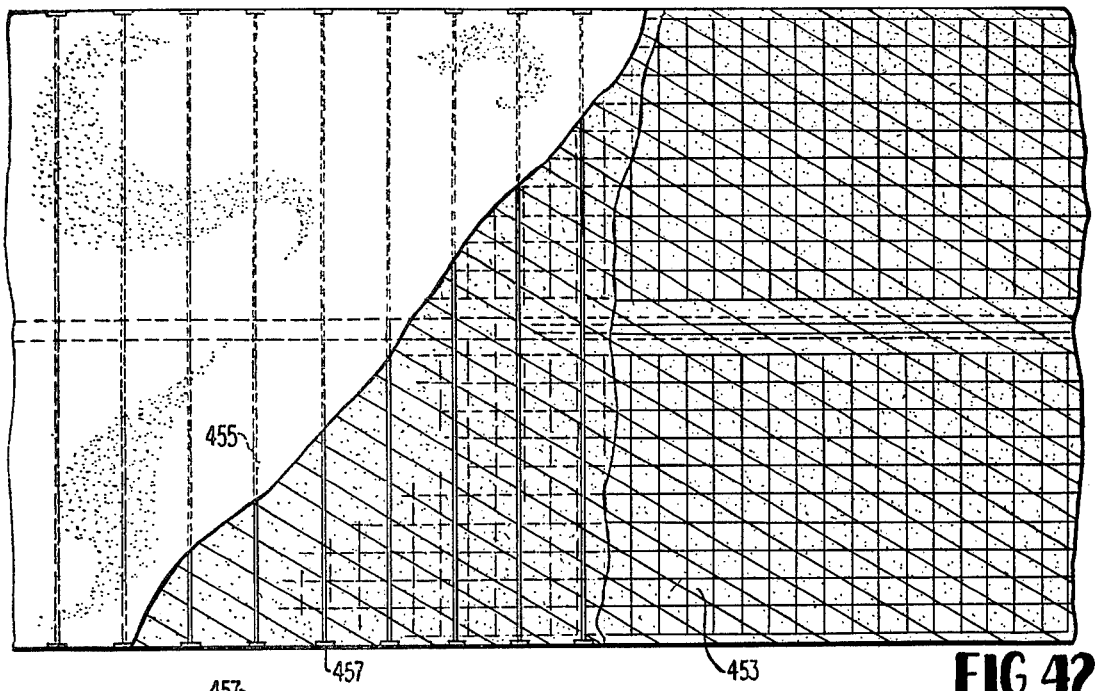
FIG 42
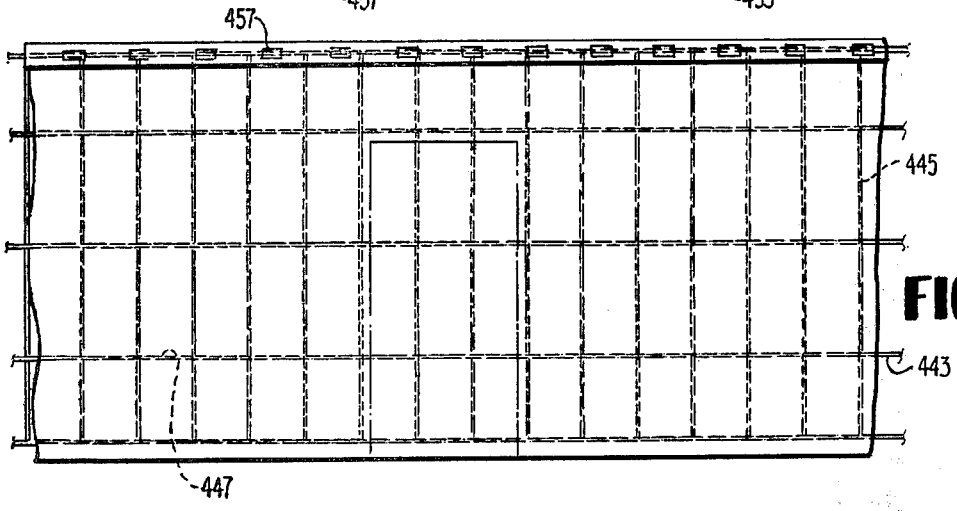
FIG. 43
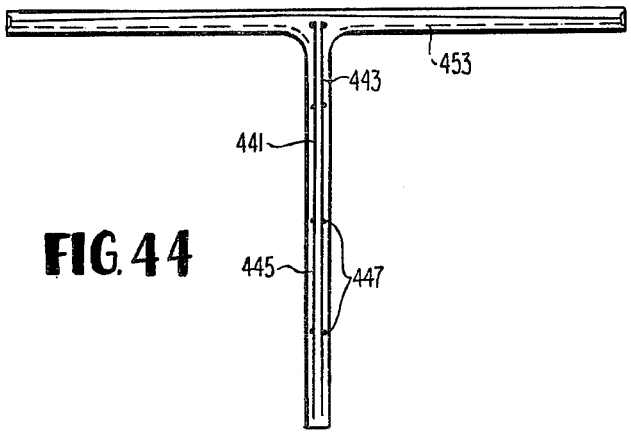
FIG. 44
FIG. 45
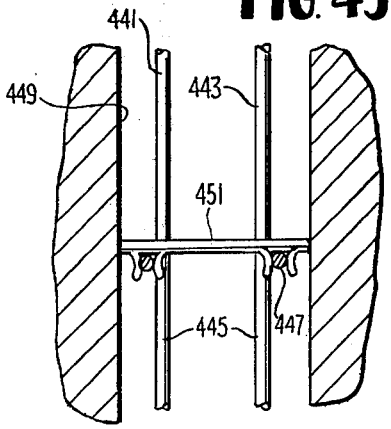

FIG. 46
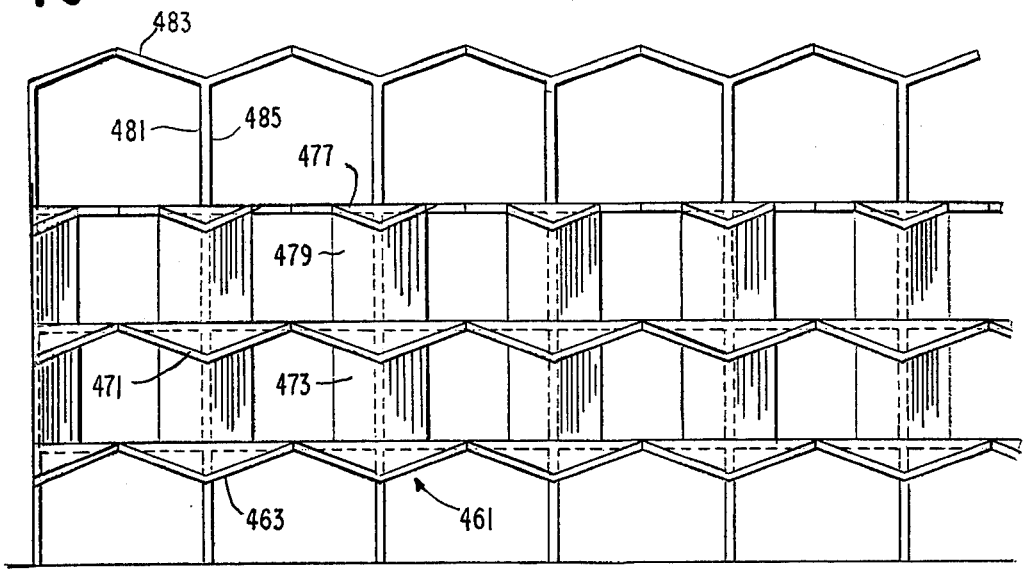
FIG 47
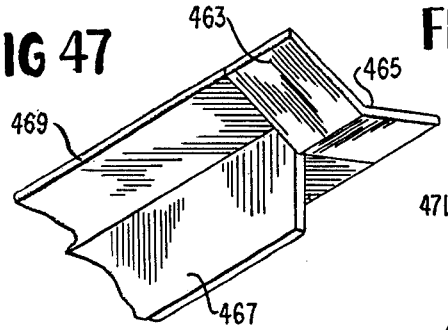
FIG. 48
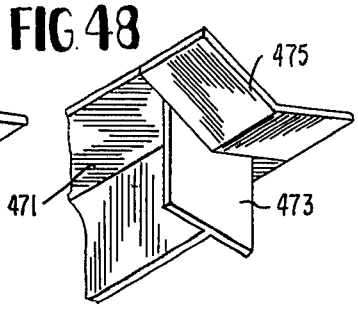
FIG. 49
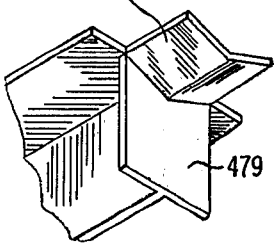
FIG. 50
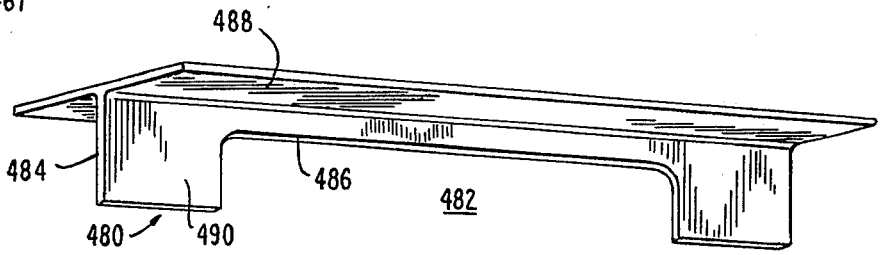
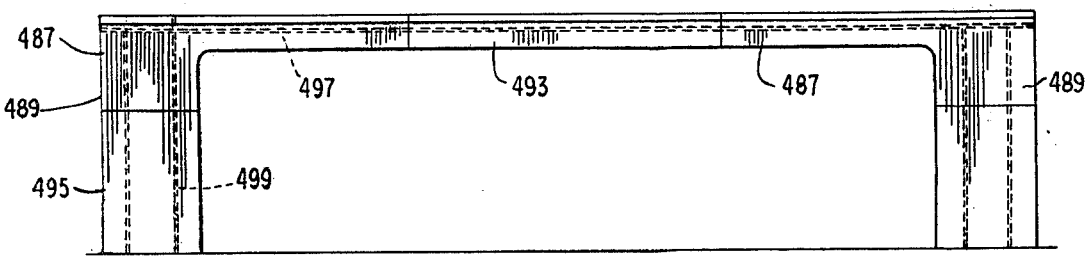
FIG. 51

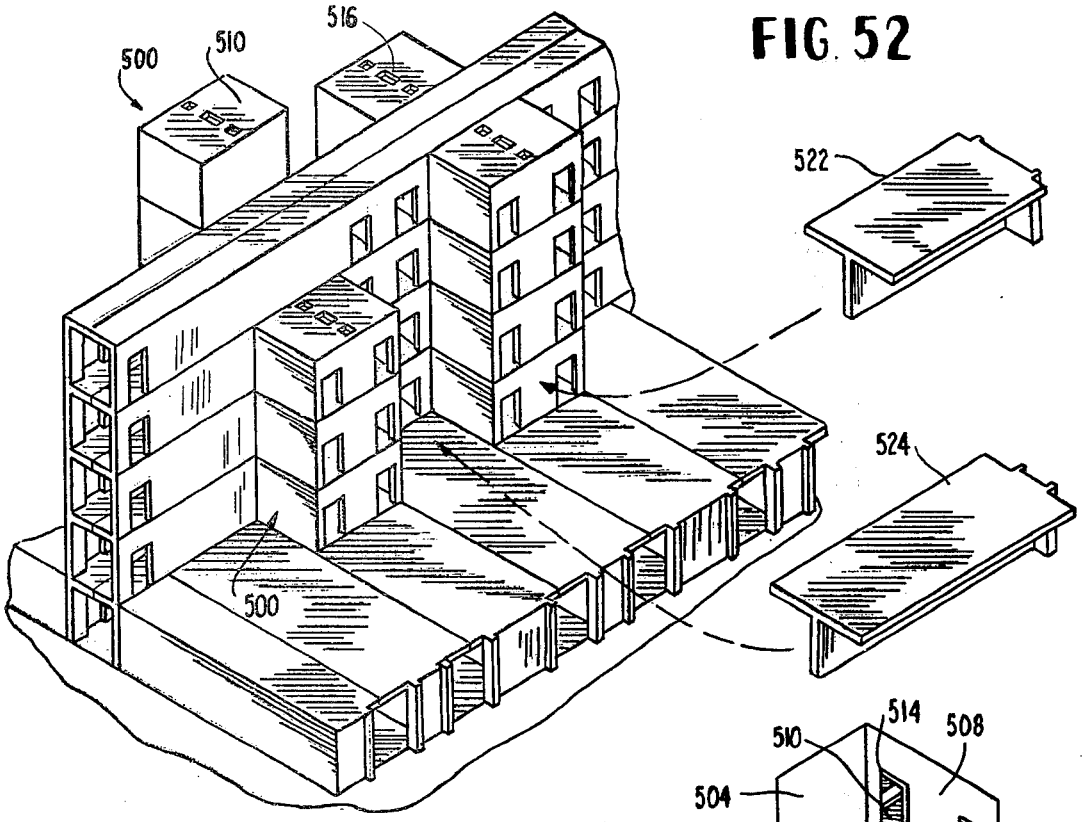
FIG. 52
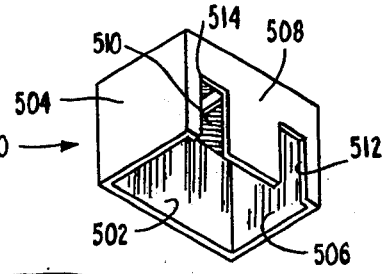
FIG. 53
FIG. 54
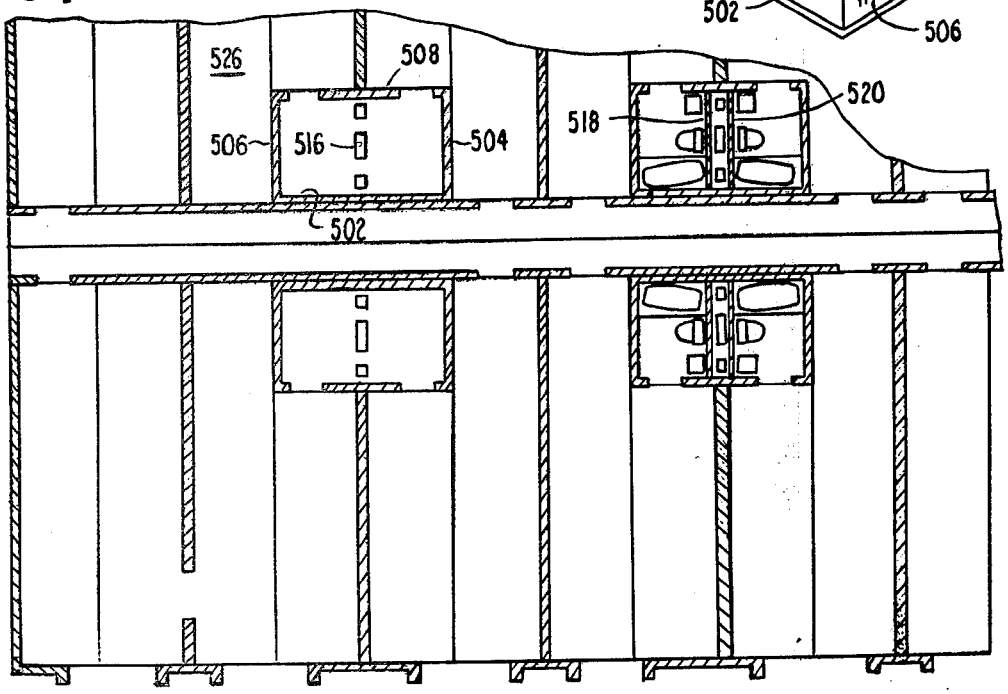

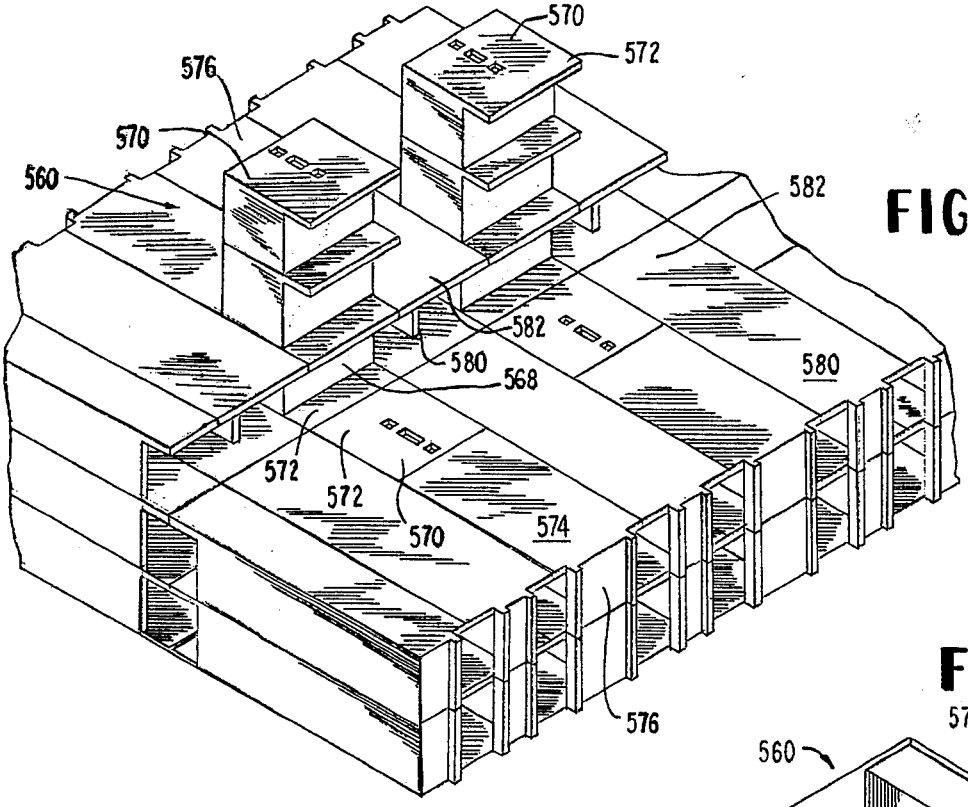
FIG. 55
FIG. 56
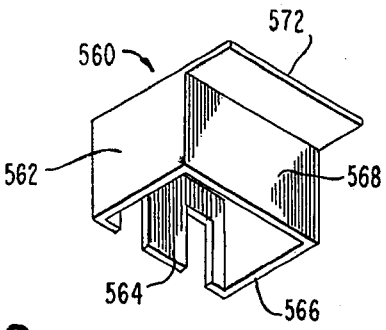
FIG. 57
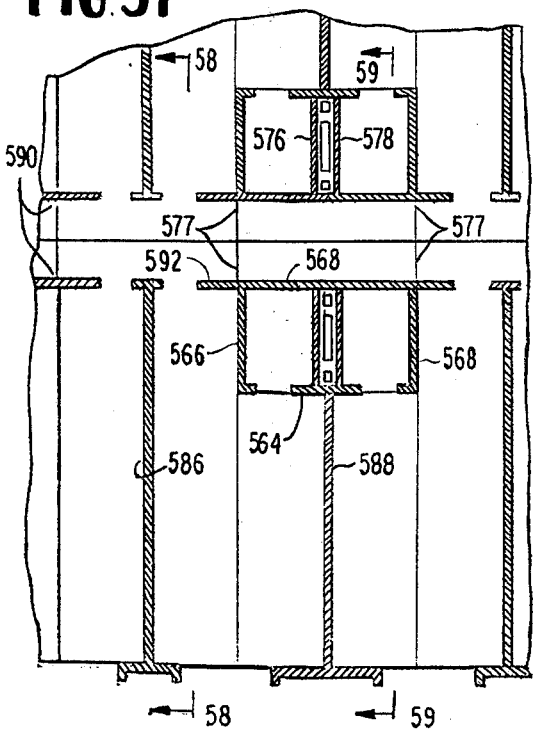
FIG. 58
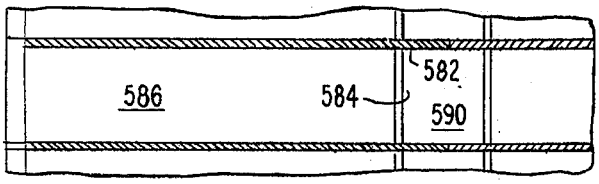
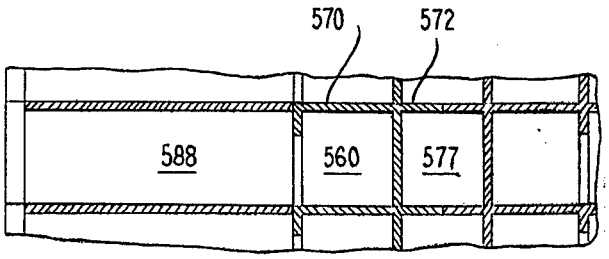
FIG. 59

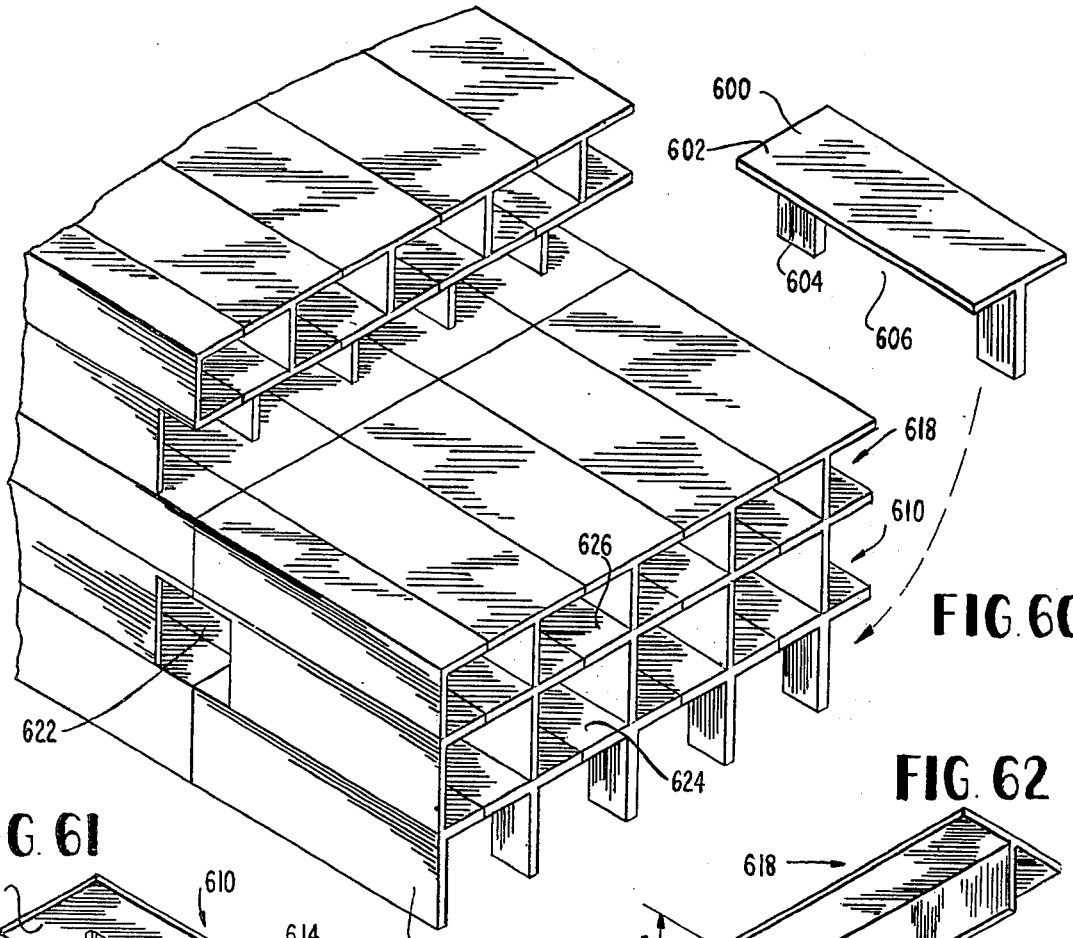
FIG. 60
FIG. 61
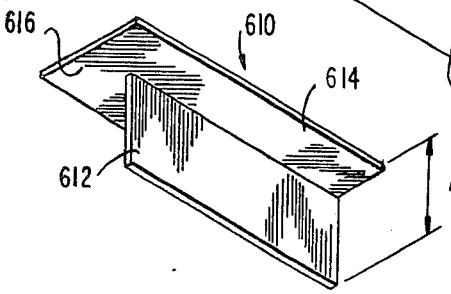
FIG. 62
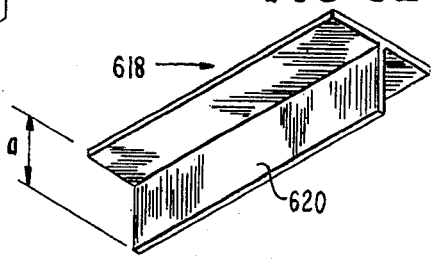
FIG. 63
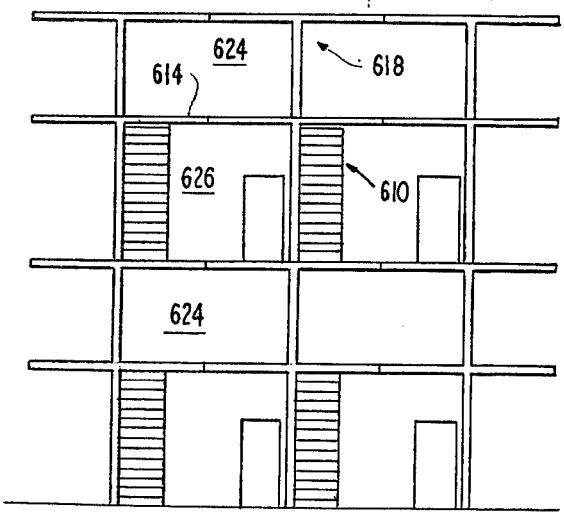
FIG. 64
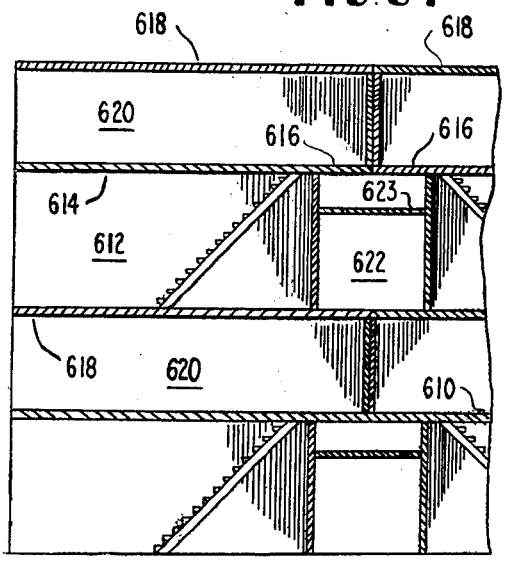

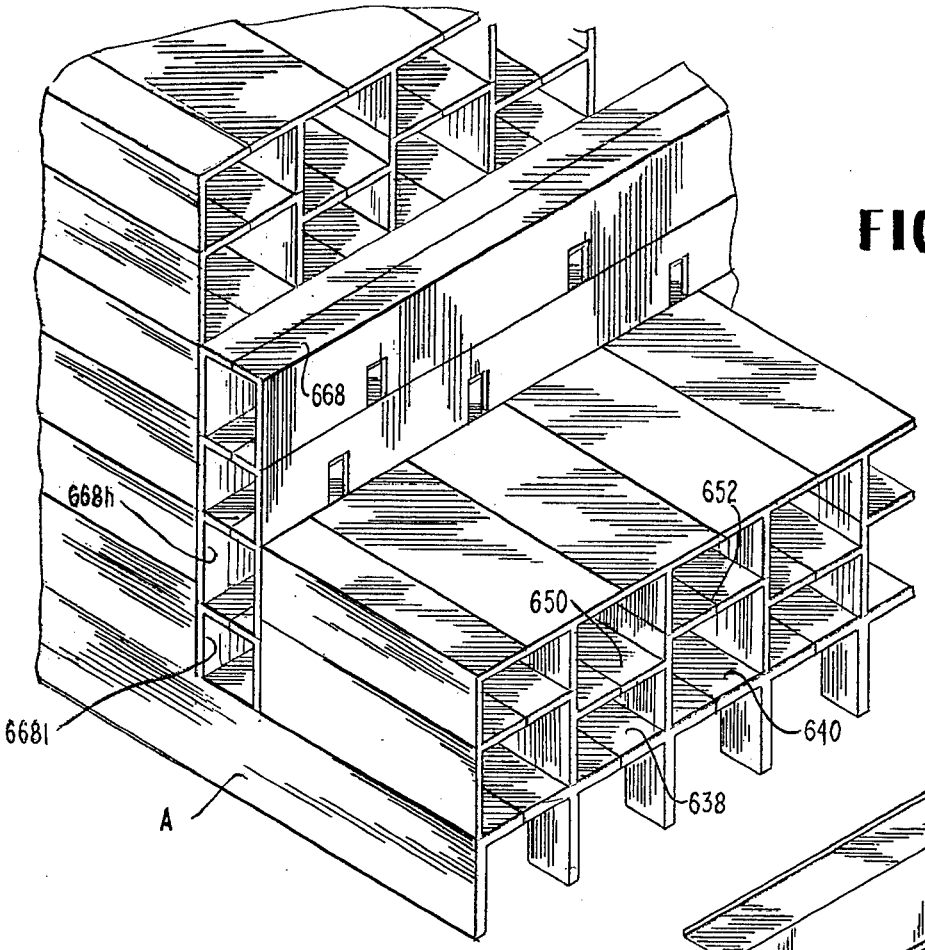
FIG. 65
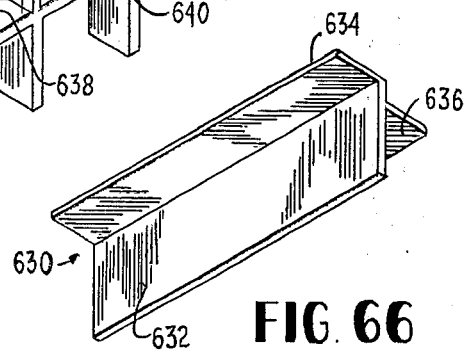
FIG. 66
FIG. 67
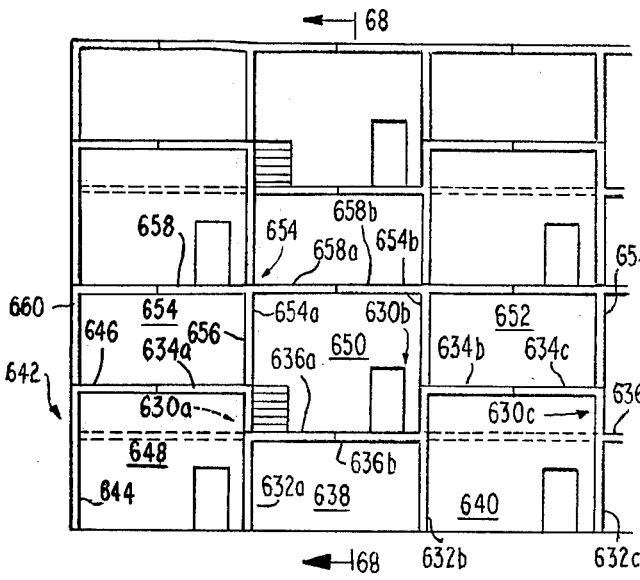
FIG. 68
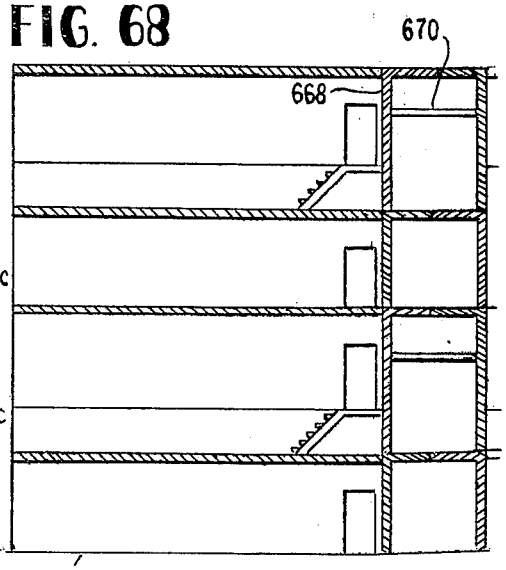

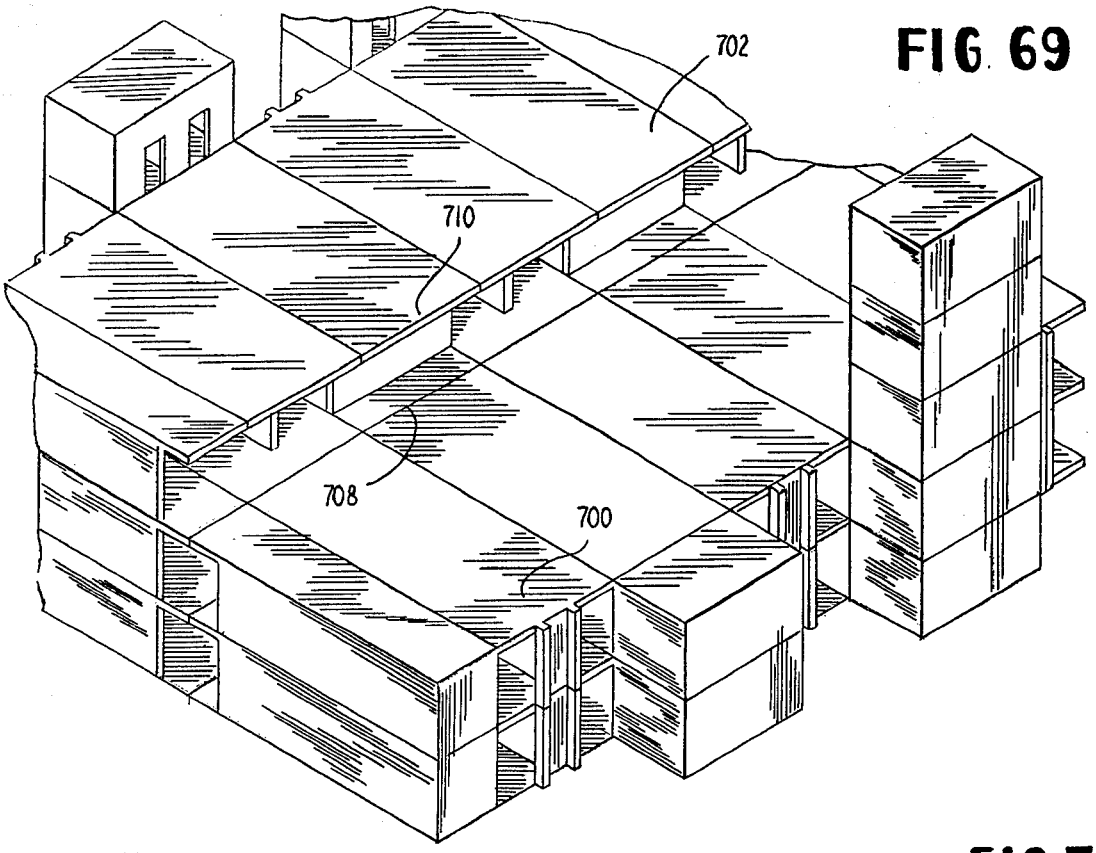
FIG. 69
FIG. 70
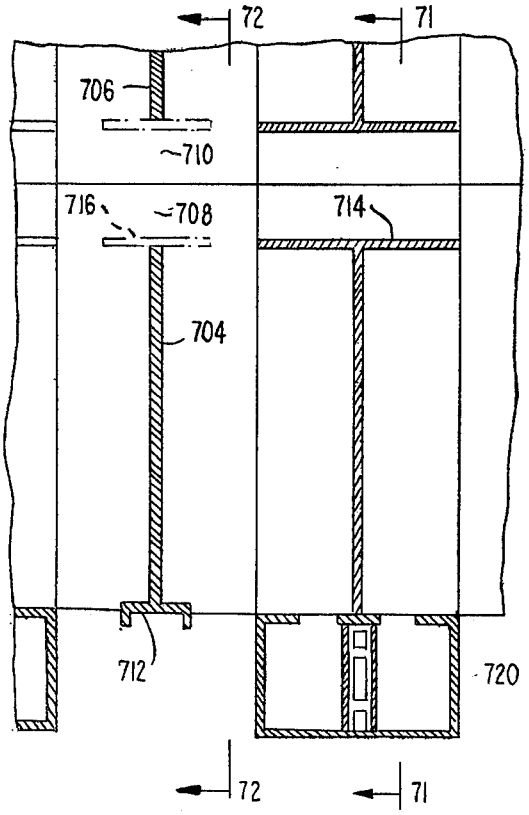
FIG. 71
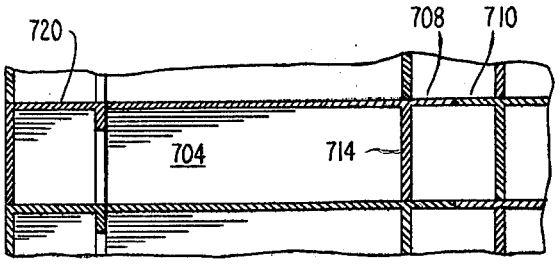
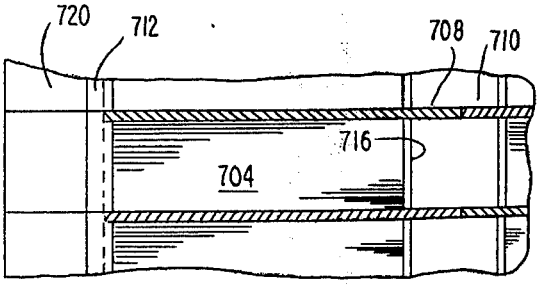
FIG. 72

FIG.73
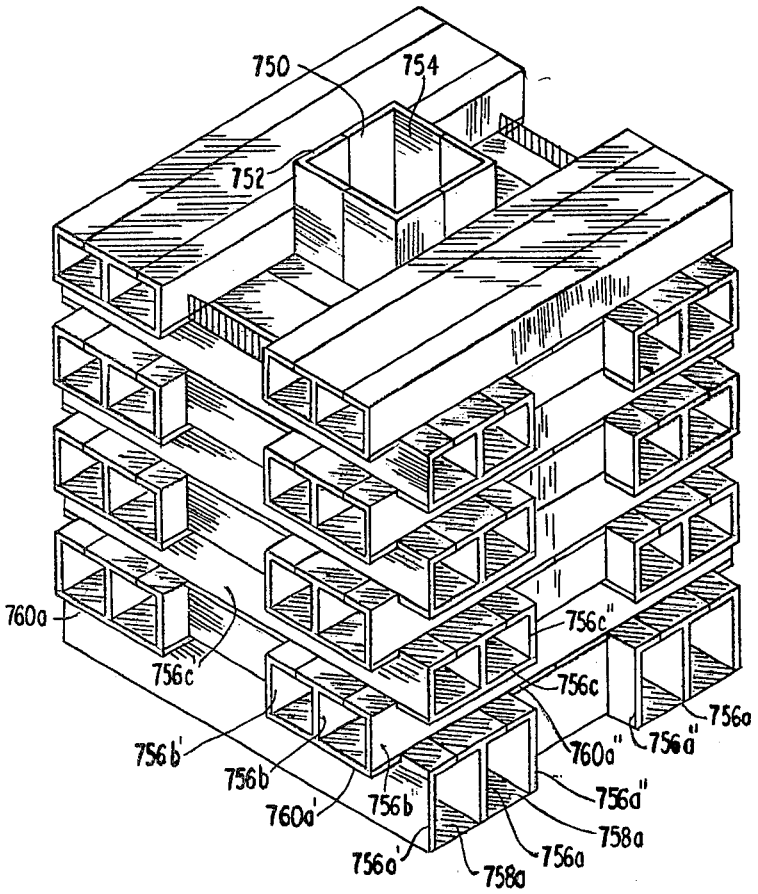
FIG.76
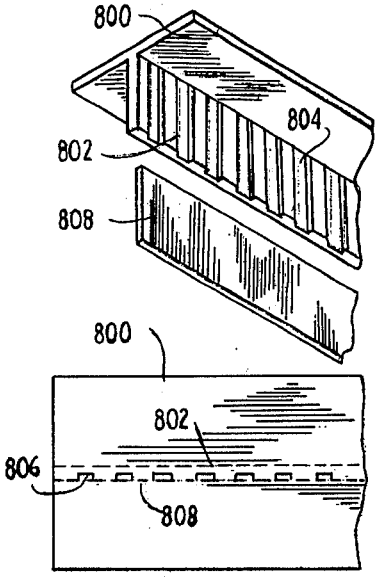
FIG.77
FIG.74
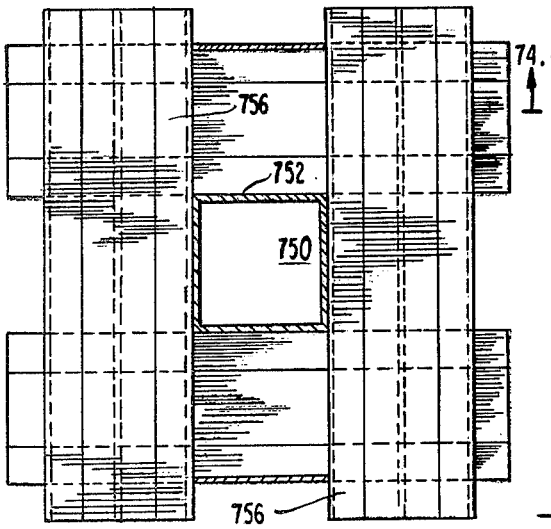
FIG.75
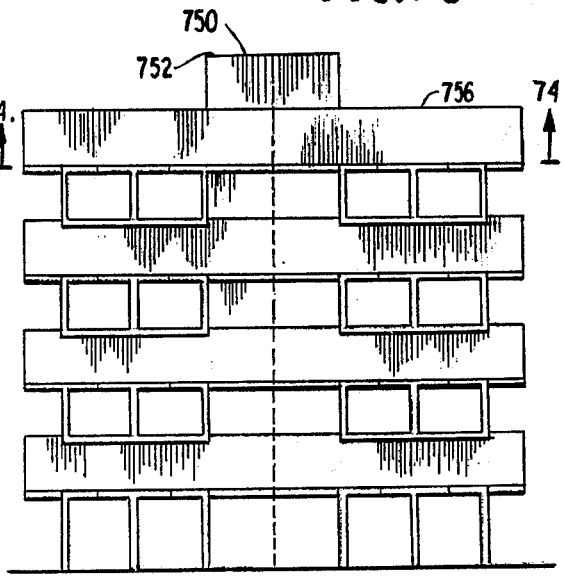

INDUSTRIALIZED BUILDING CONSTRUCTION

BACKGROUND OF THE INVENTION

This application is a continuation of application Ser. No. 80,540 filed Oct. 14, 1973, now abandoned which is in turn a continuation-in-part of my copending application, Ser. No. 807,217, filed Mar. 14, 1969, now abandoned.

The present invention relates to an industrialized building system and particularly relates to a construction system employing generally T-shaped elements (hereinafter called Tees) and, where applicable, modified Tees, i.e., half T-shaped or inverted L-shaped elements (hereinafter called modified Tees) which are uniquely formed and assembled to provide a substantial and varied degree of design flexibility. The system is equally adaptable, for example, to business or office buildings, residential buildings such as apartments, dormitories, etc., institutional buildings such as schools, hospitals, or any other construction calling for a plurality of separate internal units.

In the aforementioned copending application, Ser. No. 807,216, there is disclosed an industrialized building system employing building elements in the form of modified Tee and Channel shaped members which are erected and interconnected in a new and improved manner. This system, hereinafter referred to as the "Tee and Channel System" provides substantially improved industralized construction with a degree of structural and architectural flexibility vastly beyond that obtainable with heretofore known techniques. The construction system disclosed in the present application is a variation of and complementary to the aforementioned Tee and Channel System.

In the present invention, unique combinations of Tees and modified Tees, where applicable, are provided in an industrialized construction system complementary to the Tee and Channel System, and having special advantages under certain circumstances. As explained in the aforementioned application, Ser. No. 807,217, current practice in concrete construction generally involves poured in place column-and-slab techniques or skeletonized construction employing a framework of steel girders as a support for a precast concrete member.

These construction techniques possess significant disadvantages. For example, all are quite time consuming and require fabrication and erection of a great number of diverse elements. Inherent low dimensional tolerance and other inflexibilities require involved and expensive plumbing, electrical heating and air conditioning work after the building is particularly completed. Of course, the entire interior wall structure must be erected and finished separately, further increasing the cost and time involved in the project.

As a result of these known difficulties, intensive effort has been made over several decades to mechanize or otherwise improve the techniques of building construction. In most of the systems which have evolved, the construction elements are precast at a remote prefabrication site. Separately precast wall, ceiling and floor elements, or even entire rooms are preformed in a factory and brought to the construction site for erection.

Such modular-type construction possesses many theoretical, economic and technical advantages. Yet in practice, many problems typical of conventional construction remain unsolved. For example, effective integration of the basic structure with mechanical, electrical, etc. subsystems has not been achieved, costs remain high, and in general the economic and other realities of the American construction industry have not been taken into account in a satisfactory manner. Moreover, proposed systems utilizing precast or preformed modular type units are severely limited in flexibility of design from both functional and aesthetic viewpoints.

Because of remote fabrication, large storage areas adjacent to the fabrication plants and building sites are necessary. Additionally, when the precast or preformed units are assembled, the large number of pieces requires considerable finishing. For example, in the case of precast concrete units, much time is consumed in welding, grouting, and calking of the modules. Often the precast parts must be partially destroyed and thereafter required in the course of installation of the electrical, mechanical and plumbing subsystems.

As a result, the known modular-type construction systems fail to provide the anticipated reduction in costs, labor, construction time, etc. Of equal importance, such known modular-type units lack the functional versatility and flexibility in building design necessary to justify the substantial capital investment in equipment, etc. required for the use of these systems.

The need for improvements has become acute, and even critical with growing demands for low cost mass produced high quality housing. Yet even these demands, and concommitant federal and other financial assistance has heretofore failed to stimulate success.

The Tee and Channel System disclosed in the aformentioned copending Ser. No. 807,217, eliminates or minimizes the above discussed and other shortcomings of heretofore proposed building systems and provides an entirely new concept of building construction. A broad spectrum of building designs can be achieved with the Tee and Channel geometry by variously juxtaposing the two basic elements and variations thereof. For example, by disposing a pair of Tees in side-by-side relation with adjoining flanges attached, the stems of the Tees form the oppositely disposed side walls of a cell and the attached flanges form a ceiling for the room. By locating a Channel adjacent to like ends of a plurality of laterally adjacent Tees, there is provided a hallway, and doorways can be provided through a leg of the Channel to afford access between the hallway and the various cells defined by the Tees. By superposition of the Tees, there is formed a plurality of superposed and laterally adjacent cells, with the stems of laterally adjacent Tees forming common walls between laterally adjacent cells. The flanges of the laterally adjacent Tees form common floors and ceilings for the superposed cells. Likewise, the Channels are superposed to form hallways, with the web portions of the superposed Channels forming common floors and ceilings for the hallways.

BRIEF DESCRIPTION OF THE INVENTION

In contrast to the foregoing, the present invention constitutes an alternative line of development in which the above described Channel shaped elements are not employed. Instead, only T-shaped elements, as previously described, and, where applicable, modified T-shaped elements and/or bathroom modules are employed. According to the present invention, to construct multi-level buildings, the Tees are superposed one over the other to comprise a plurality of vertically extending laterally adjacent ranks of Tees and thereby form a plurality of superposed and laterally adjacent cells. By this superposition and lateral juxtaposition of ranks of Tees, the stems of laterally adjacent Tees form common walls between laterally adjacent cells while the butting flanges of the laterally adjacent Tees form a common floor and ceiling for the vertically superposed cells.

In certain embodiments, the tees are preformed with facade panels at one or both ends, transverse to the stems and flanges. These facade panels serve as exterior walls, either alone or in conjunction with glass window panels, balconies, etc. It is a significant feature hereof that the Tees are compatible with virtually any facade treatment and/or configuration thereby further expanding the flexibility and utility of the present construction.

In addition, the facade panels may serve as interior walls for the cells or hallways. For example, two such facade walls may be located in spaced relationship in two adjacent ranks of tees. This provides an open shaft between two adjacent ranks of cells, which serves a common plumbing chase for the two ranks. Substantial reduction in the time and cost of plumbing installations may be achieved in this manner.

In multi-level building construction utilizing the basic Tee, the end portions of the stems of the tees at one or both ends can be inset to form exterior or interior hallways with the end of flange portions of the superposed tees providing a continuous cantilevered exterior hallway adjacent like ends of laterally adjacent tees.

Further, a modified tee, i.e., an inverted L, can be formed to provide additional components of the building structure as needed in a specific building design. For example, the modified tee can be formed to provide end walls and ceilings and floor portions of superposed cells at the ends of the building. In a further form, the modified tees can be disposed such that their stems extend at an angle to the stems of the superposed laterally adjacent tees to form superposed hallways at one or other ends of the superposed laterally adjacent tees. The flanges of the superposed modified tees can be enlarged to provide hallways or corridors of various widths. Moreover, the modified tees can be disposed relative to one another to form a composite channel shaped member to form corridors or hallways and elevator lobbys on each level of a multi-story building as desired. The corridors may be located centrally as well as peripherally of the building. Also, enlarged modified Tees forming composite channels can be positioned on one end in butting relation to the elevator lobbys to form elevator towers, the towers lying in communication with the lobbys through doorways cut in the legs of the modified tees.

Likewise, as in the Tee and Channel System, the Tees, and modified Tees, in accordance with the present system are such that the height of the stems are comparable to the height of an erect human, whereby the basic construction elements alone are employed to define the internal compartmentalization or cellular configuration of the building. Correspondingly, the horizontal dimensions of the flanges of the Tees are sufficient to provide rooms and hallways without need of intervening like or different elements.

According to this invention, the flanges of the Tees are preferably large enough to permit subdivision of the large cells for additional design flexibility. Even further flexibility may be achieved by provision of passages through the stems and flanges of the Tees allowing construction of two story cellular units, or large one story units in which a Tee stem serves as an internal subdividing wall.

The Tees, and modified Tees where applicable, are preferably formed of reinforced concrete. It should be understood, however, that a significant feature of the new practices disclosed herein is the direct adaptability to continuing advances in material sciences and other related fields. For example, Portland cement, sand and gravel, may be mixed to produce conventional heavyweight concrete or lightweight foamed concrete. Alternatively, and other structurally suitable material may also be employed. It will be appreciated that the Tees and modified Tees may be formed with post or pretensioning tendons as desired.

The Tees and modified Tees where applicable, are precast in properly shaped forms, preferably at the construction site. The forms are adjustable to provide variations in length, width, and height for the Tees in accordance with a particular building design. This also permits use of one form for the Tees forming the internal cells, as well as the hallways, the elevator lobbies, and the elevator tower. To facilitate use during cold weather, the forms preferably include heating apparatus to promote rapid curing of the concrete. After curing, the elements are stripped from the forms for immediate use. Cranes are provided at the construction site for lifting the finished Tees and modified Tees where applicable, from the forms and directly disposing the same in their final position in the building structure. For example, the Tees are lifted directly from the forms and stacked on top of each other to form plural ranks of tees. This immediately defines the laterally and vertically juxtaposed cells of the building in their final positions.

Preforming the construction elements at a remote plant is feasible, but location of the forms and other equipment at the construction site eliminates hauling the preformed elements. Immediate use also eliminates the need for large storage areas either at the construction site or at a remote plant. Moreover, formation of the basic elements needed in the erection of the building eliminates concern for delivery schedules and reduces handling, probability of breakage, and costs.

The forms are readily modified to provide additional components of the building structure as needed in a specific building design. For example, the modified Tees, i.e., the elongated L-shaped members, are formed by blocking off one of the flanges. The modified Tees are likewise lifted from the Tee form by the cranes and directly disposed in final position, for example, one on top of the other with one leg of the modified Tee attached to an adjacent Tee flange. This provides end walls and ceiling and floor portions of superposed cells at the ends of the building. Pairs of modified Tees may also be directly disposed to form composite channels with corresponding flanges joined one to the other to form common ceiling and floor portions of superposed hallways or balconies and wall portions for elevator towers.

The flange forming portion of the forms for the Tees and modified Tees can be widened as desired to provide cells having variable stem to stem distances. Also, the edges of the flanges can be formed to an angle relative to the stem to provide an arcuately arranged building with the stems lying in non-parallel angularly related directions. For example, a full circular building can be formed.

Electrical wiring and outlets are integrally cast with the Tees and modified Tees thus eliminating the need for later costly and time consuming installation. Piping or ducting for heating, ventilating, air conditioning, or in the case of hospitals, oxygen, may also be integrally cast in the stems and/or flanges of the Tees. Precast facade panels at the ends of the Tees may also have vertically extending ducts communicating with the longitudinally extending ducts in the flanges or directly opening into the space behind the facade. The vertical ducting may run the full height of the building. Suitable vent openings in communication with the ducts are formed when the member is cast to provide circulation into the various cells and hallways.

Like the Tee and Channel System, an important feature of this invention is the ready adaptability to a systemized approach to subsystem installation. This means that heating and plumbing layouts may be preplanned for maximum speed and ease of installation without fear that low dimensional tolerance or other inaccuracy in the casting of the construction elements will cause difficulties during subsystem assembly. Moreover, certain prefabrication techniques known in modular construction have been adapted to use in the present system whereby complete plumbing subassemblies may be preassembled at ground level on the construction site and lifted into place immediately upon erection of the associated structural components.

Also like the Tee and Channel System, the construction disclosed herein produces significant savings in time, labor, space and expense. For example, a multistoried building, the modified Tees forming the composite channels which, in turn, form the elevator lobbies are first poured and erected to form a plurality of superposed elevator lobbies. The elevator tower is next poured in the modified Tee forms and vertically positioned on one end to form a composite vertically extending channel adjacent the previously erected elevator lobbies. The elevator structure is then complete and ready to be turned over to the mechanical trades for elevator runway rail installation.

While the foregoing is being done, the initial Tees are being preformed. When ready, the Tees are erected on top of each other to provide a full rank of Tees, for example, on opposite sides of the previously erected elevator core. The modified Tees forming the hallways in addition to the elevator lobbys are formed and erected one over the other in end-wise registry with the elevator lobbys as the vertical erection proceeds. Additional Tees are formed and subsequent ranks of Tees are erected on one or both sides of the hallways in accordance with the building design with each rank forming a plurality of superposed cells with the previously erected next adjacent rank of Tees. It will be appreciated that as each Tee is superposed on the next lower Tee, the flanges are connected one to the other, either welded or by the post tensioning cables.

The above described erection procedure for the ranks of Tees progresses from the middle of the building toward one end thereof or simultaneously toward opposite ends thereof and is completed when the inverted L-shaped members are formed and erected. It will be noted that the foundation and related work immediately precedes the erection of the ranks of Tees and this provides adequate operating room for cranes as well as minimizing construction time. Moreover, as soon as a first pair of adjacent ranks of Tees are erected, the finishing trades may enter this portion of the building to commence their work. That is to say, the finishing work follows closely behind the erection of the building structure thereby effecting further savings in construction time. After one end of the building is completed, additional ranks of hallways and tees are constructed outwardly from the elevator core assembly toward the opposite end of the building. In this manner, the total erection is accomplished in an orderly safe and efficient manner with the minimum expenditure of time and money.

The system disclosed herein provides an excellent compliment to the Tee and Channel system disclosed in copending application Ser. No. 807,217. Like the Tee and Channel system, the present system is adaptable to a wide variety of functional and aesthetic demands. For example, buildings of circular or polygonal shape or having a wide variety of other configurations may readily be constructed. Buildings having central hallways with rooms on opposite sides thereof can be readily constructed utilizing the Tees. Alternatively, multilevel buildings with exterior or interior hallways can be formed by insetting end portions of the stems of the Tees. In this manner, the end flange portions of the superposed Tees provide a continuous cantilevered exterior hallway adjacent like ends of laterally adjacent Tees. As noted previously, circular or polygonally shaped buildings can be provided. For example, the lateral edges of the flanges of the Tees can be angled relative to the stems whereby the stems of the laterally adjacent Tees are angularly related one to the other. The Tees may thus extend radially from a central building core.

As in the Tee and Channel system, there is a limitation on the height of the multi-level building which can be constructed utilizing the superposed Tees depending on various factors including the distance between the laterally adjacent stems, which distance defines the width of the cell and hence, to a large extent, determines the weight of the overall Tee. For example, where tees having 4-inch thick flanges and stems are utilized with the flanges extending to provide a 16-foot distance between the stems of adjacent tees, a height limit of about ten storys is imposed. If a 12-foot distance from stem to stem utilizing Tees of like thickness is provided, the building can be constructed to a height of about 20-storys. While the thickness of the flanges and stems could be increased to permit greater distances between the stems of laterally adjacent tees and thereby permit construction of a higher multistory building, the weight of the additional material utilized to form the thicker flanges and stems becomes somewhat prohibitive. Accordingly, a variation of the present invention and per se useful with the Tee and Channel System as well as with the invention hereof provides for Tees formed to enlarged thicknesses to provide greater stem to stem distances between laterally adjacent stems with voids or cores running laterally through the flanges (and stems as desired) of the Tees to minimize their weight. In fact, by properly sizing the cores or voids, Tees having flange and stem thicknesses about double the thickness of the flanges and stem of a specified Tee, with both Tees having approximately like weights can be provided. Accordingly, it has been found possible to extend the lateral stem to stem distance between adjacent tees to provide enlarged cells or bays while concommitantly permitting the construction of multi-level buildings to increased heights, [or at least heights on the order of the heights previously obtainable with the tee and channel system].

In the erection process previously described, the ranks of Tees and modified Tees may be vertically post tensioned by coupling rods or tendons inserted into the voids or cores at each Tee is superposed over another Tee. Specifically, a plurality of rods are secured to an anchor plate at the base of the building. The first level Tees are then disposed over the upstanding rods with the latter being received within the voids or cores. The rods, of course, could be inserted through the cores and secured at their lower ends after the first level of Tees are in place. Anchor or bearing plates and nuts are then disposed over the rods at their upper ends. The rods may be tensioned by suitable jacking apparatus and the nuts then tightened down. To post tension the next level of Tees the post tensioning rods used in the next level may either be threaded to the nuts with the cores or voids of the next level Tees receiving the upstanding rods as the Tees are disposed in place, similarly as the first level Tees are erected, or the post tensioning rods in the next level can be inserted through the cores or voids of the next level Tees after the latter have been superposed over the first level Tees. In the latter instance, the rods are threaded at their lower ends to the nuts on the upper ends of the lower level rods. In each case, bearing plates and nuts are disposed over the upper ends of the rods and the latter are post tensioned as before. Alternately, the building may be vertically post tensioned after full erection utilizing the cores or voids are conduits for containing the post tensioning dendons. The post tensioned connection between the superposed Tees may be employed as the sole connections between such Tees in lieu of the welded connections therebetween previously described or as supplemental connections therefor.

Furthermore, the building may also be horizontally post tensioned in a like manner with the rods being disposed in the cores or voids extending through the flanges of horizontally adjacent Tees. The post tensioned connections between the horizontally adjacent Tees may be employed as the sole connections between such adjacent Tees in lieu of the welded connections therebetween as previously described or as supplemental connections therefor. It will be appreciated that the cores or voids may provide conduits for heating, plumbing and electrical lines.

A variation of the present invention provides precast bathroom modules in the form of a rectangular box open at its lower end, each module providing a pair of bathrooms in back to back relation. The modules are cast in lengths identical to the width of the Tee flanges and, when the building is erected, are superposed one over the other to form a rank of modules whereby the upper walls thereof form common floors and ceilings for the superposed bathrooms. Ranks of shortened Tees are then butted against the outer walls of the modules and ranks of long Tees are disposed on either side of the short Tees and the rank of modules whereby a pair of adjacent cells are provided on each level with an individual bathroom serving each cell. A variation of the foregoing provides ranks of precast bathroom modules having flanges which when a pair of ranks of such modules are laterally spaced one from the other, form superposed hallway sections with the butting flanges forming the common ceilings and floors for the hallway sections. The tees for use with this construction are provided with flanges which extend beyond the end edges of the stems whereby the ranks of long Tees form superposed hallway sections in registry with the hallway sections formed by the bathroom modules, the extended flanges on the tees forming the common ceilings and floors for the superposed hallway sections formed thereby.

In a further form hereof, the Tee flanges may be angled upwardly from the stem to provide a vaulted ceiling and decorous external roof treatment. In a still further form hereof, the flange on one side of the tee is elevated above the flange on the other side of the Tee. By juxtaposition of these variously formed tees, cells having step down or step up areas can be provided.

Accordingly, it is a primary object of the present invention to provide a novel cellular industrialized building system and method providing optimum flexibility in building design, fully responsive to current demands for mass produced, low cost, high quality housing, and complementary to the system disclosed in copending U.S. Patent application Serial No. 807,217.

It is another object of the present invention to provide a novel industrialized building system and method utilizing a single basic shape with certain modifications for forming both the structural components and main partitions, walls, floors and ceilings of buildings.

It is still another object of the present invention to provide a novel industrialized building system and method which minimizes costs, construction time, space and labor.

It is a further object of the present invention to provide an industrialized building system utilizing Tee shaped elements juxtaposed to form a plurality of vertically extending laterally adjacent ranks of Tees defining a plurality of superposed and laterally adjacent cells. It is a related object of the present invention to provide an array of laterally adjacent cells having a common wall formed by the stem of a Tee and superposed cells having a common floor and ceiling defining the flanges of the laterally adjacent Tees. It is also a related object to provide such an array of cells having passageways through the Tees to provide multi-story and multi-room cells.

It is another object of this invention to provide an industrialized building system utilizing Tee shaped elements to provide enlarged bays or cells between the stems of adjacent Tees and wherein Tees are superposed to form superposed enlarged bays or cells. It is a related object to construct the Tees in a manner to provide increased structural strength to support an multi-level building structure without significant increase in the weight of the Tees.

It is another object of this invention to provide an industrialized building system utilizing modified Tee elements to form with the full Tees an array of cells and/or interconnecting network of hallways or corridors.

It is still a further object of the present invention to provide an industrialized building system utilizing pairs of modified Tee elements connected one to the other in lateral and superposed juxtaposition to form a plurality of composite superposed channels forming a rank of superposed hallways and/or elevator lobbys with the legs of the modified Tees forming common ceiling and floor portions of next adjacent superposed hallways and/or elevator lobbys. It is a related object to provide such a building construction having an elevator tower and lobby assemblage formed solely from modified Tee elements.

It is a further object of the present invention to provide an industrialized building system for constructing multi-level buildings utilizing basic T-shaped elements and half T-shaped elements wherein increased building heights can be obtained.

It is a still further related object of the present invention to provide an industrialized building system for constructing multi-level buildings utilizing basic T-shaped elements and half T-shaped elements wherein the elements can be readily and easily vertically or horizontally post tensioned.

These and further objects and advantages of the present invention will become more apparent upon reference to the following specification, claims, and appended drawings, wherein:

Figure 1:
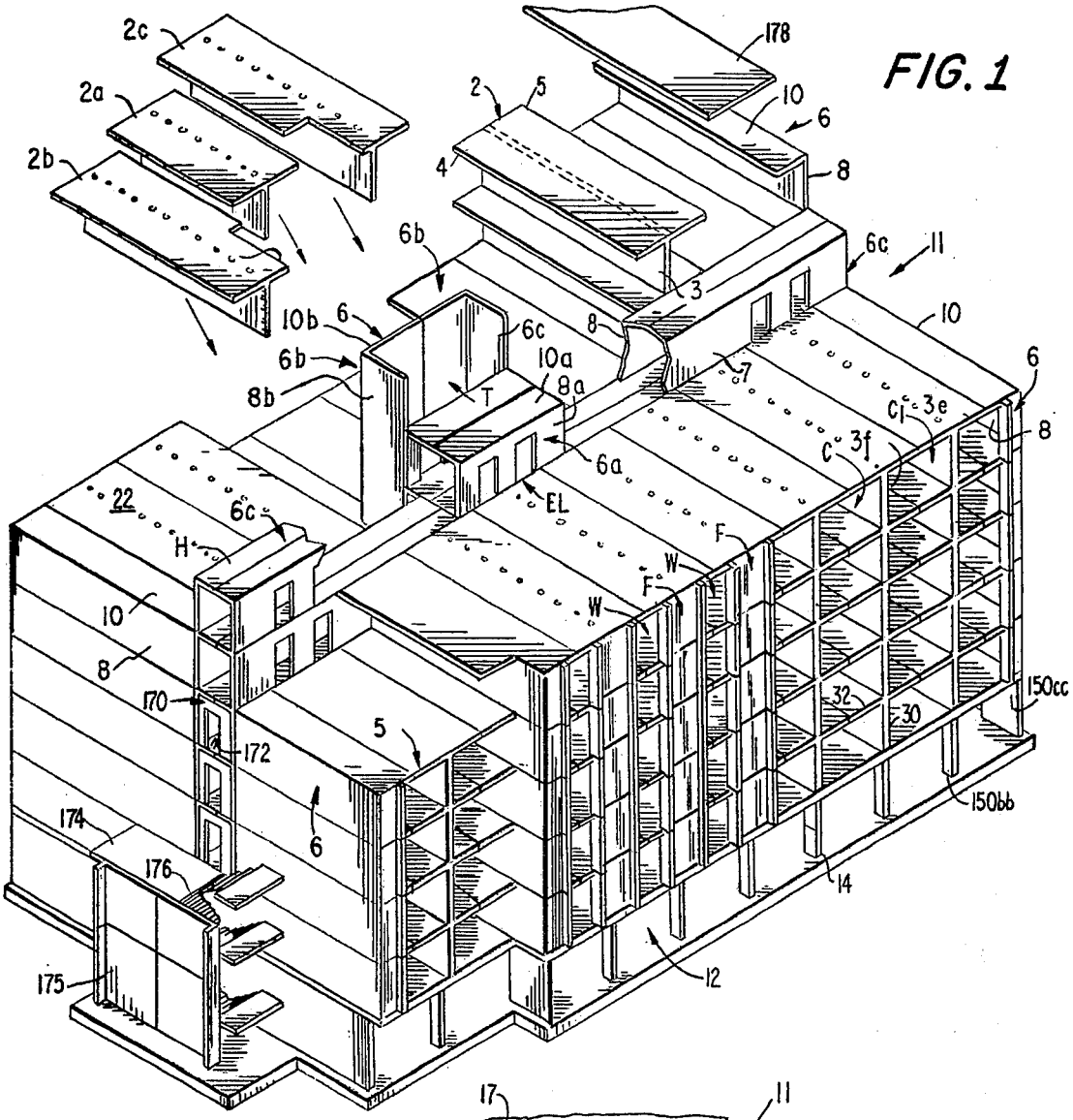
FIG. 1 is a schematic perspective view, with portions in exploded justaposition, illustrating a building constructed in accordance with the principles of the present invention.
Figure 2:
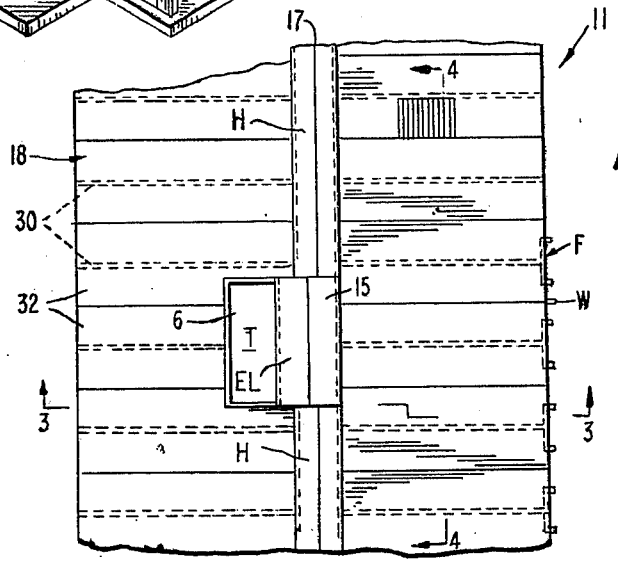
FIG. 2 is a fragmentary top plan view thereof.
Figure 3:
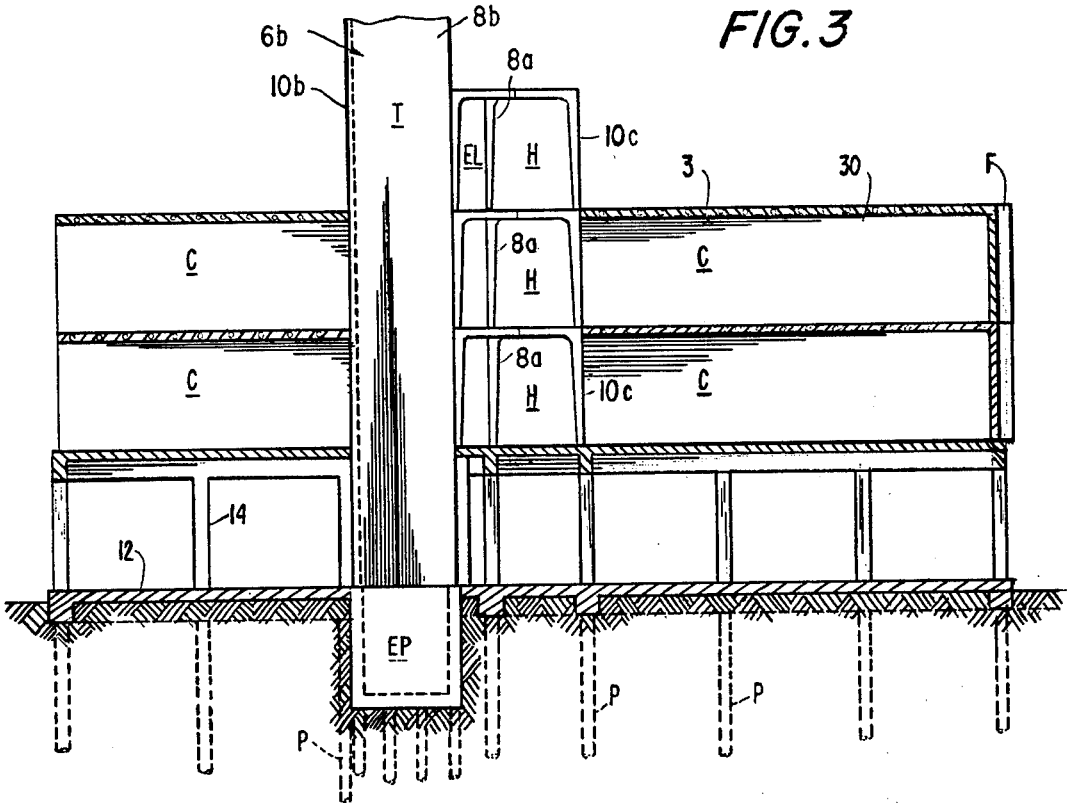
Figure 4:
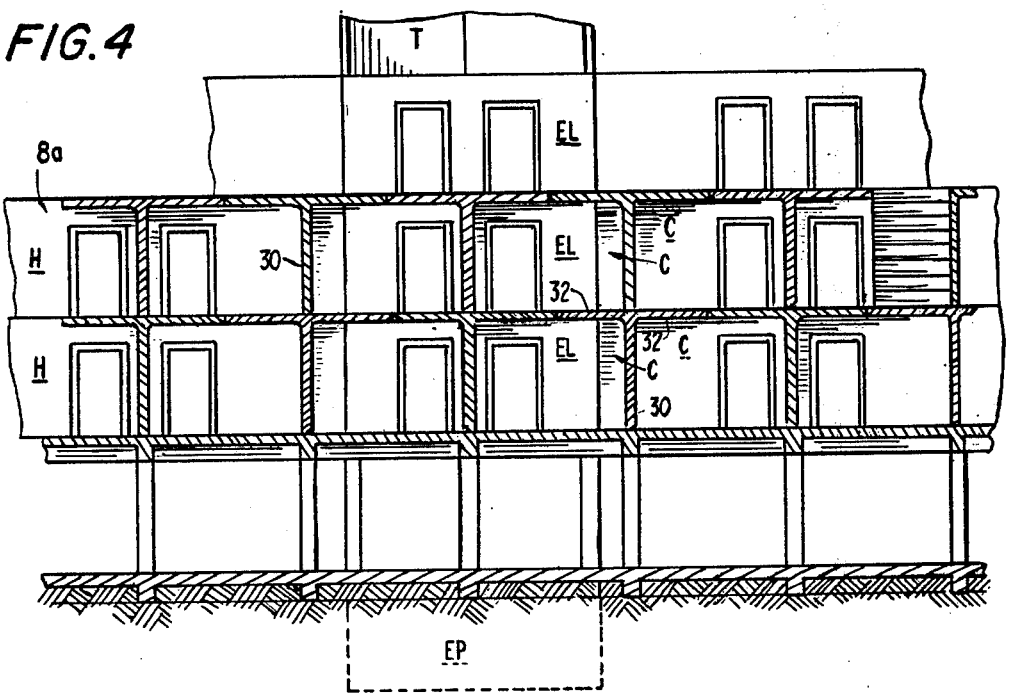
Figure 5:
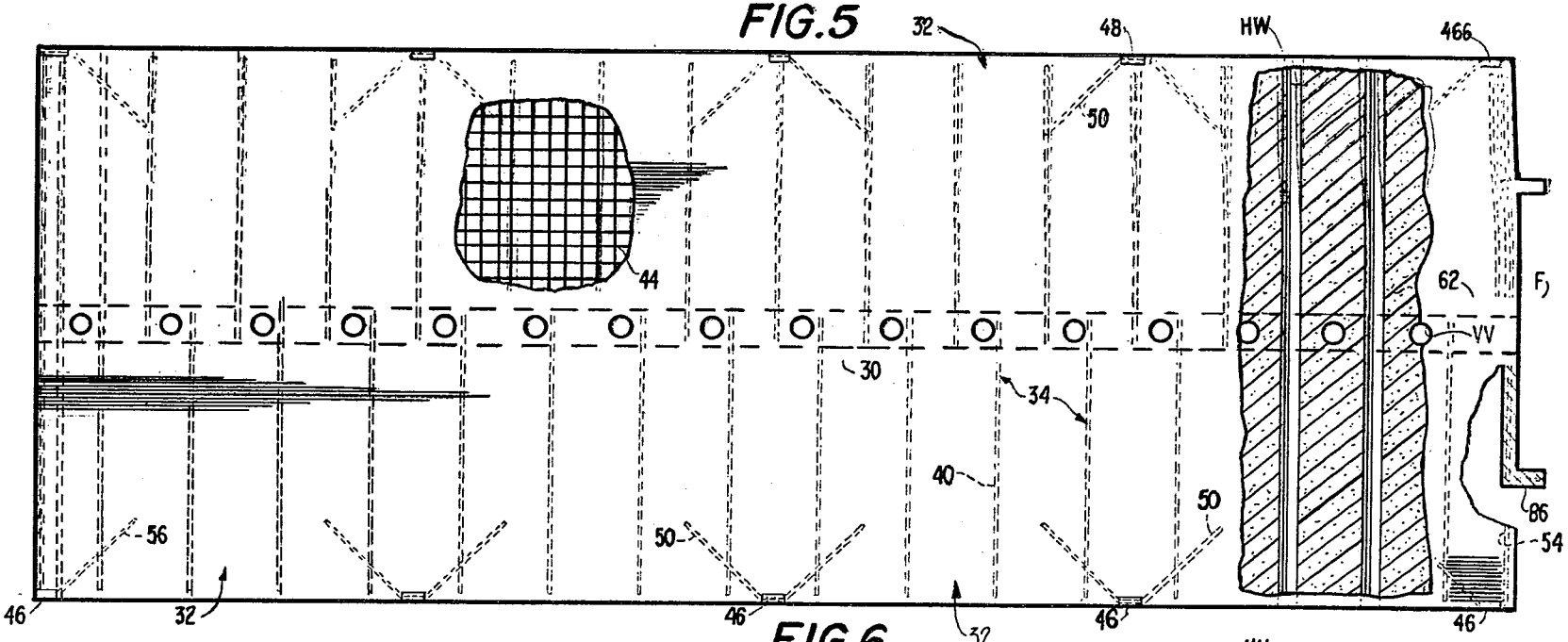
Figure 6:
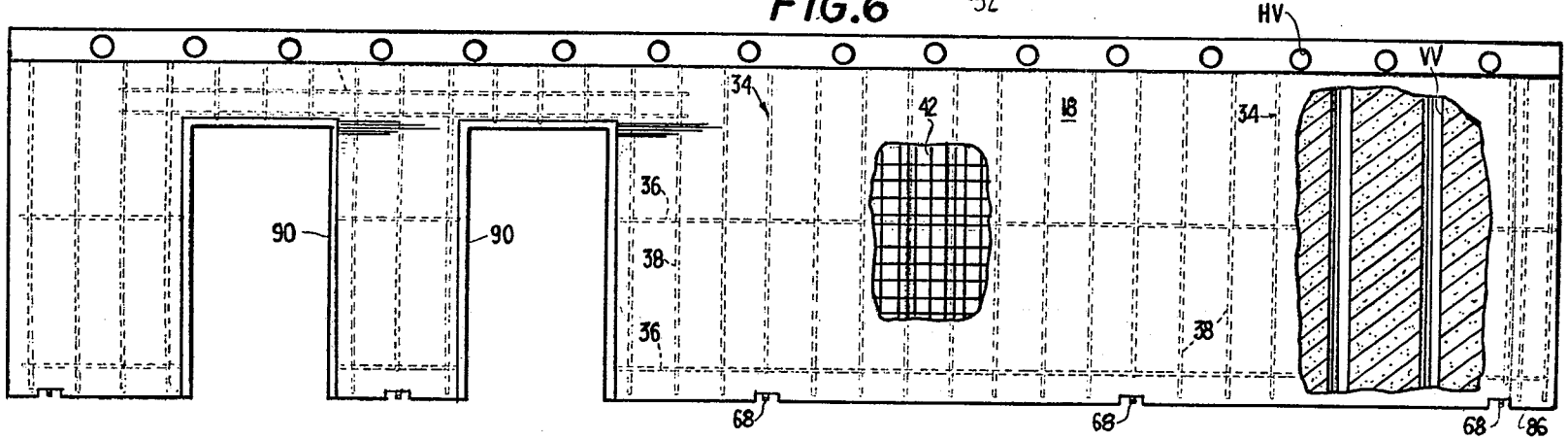

FIGS. 3 and 4 are enlarged cross-sectional views thereof taken about on lines 3—3 and 4—4 respectively in FIG. 2;

FIG. 5 is a top plan view of a Tee module employed in the building construction illustrated in FIG. 1 and shown with parts broken away for ease of illustration;

FIG. 6 is a side elevational view of the Tee element with parts broken away for ease of illustration;

FIG. 7*a* is an end elevational view of the Tee element with the facade in the background;

FIGS. 7*b*–7*d* show enlarged views of a portion of FIG. 7*a;*

FIG. 8 is an end elevational view of a pair of half-Tee shaped elements forming a composite channel as employed in the builiding construction illustrated in FIG. 1;

FIG. 9 is a side elevational view of one of the half-Tee elements illustrated in FIG. 8 with parts broken away for ease of illustration.

FIG. 10 is an enlarged fragmentary cross-sectional view showing the interconnection of the stem of a Tee element with an immediately underlying Tee element;

FIG. 11 is a fragmentary cross-sectional view taken about on line 11—11 in FIG. 10;

FIG. 12*a* is an enlarged cross-sectional view showing the interconnection between flanges of a pair of adjacent Tee elements;

FIG. 12*b* is an enlarged fragmentary top plan view of the interconnection shown in FIG. 12*a;*

Figure 25:
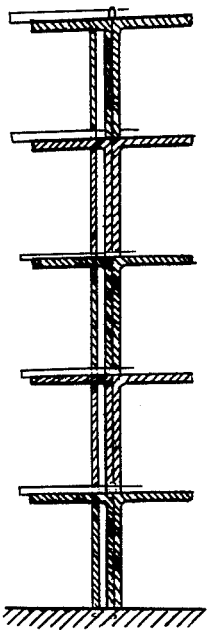
Figure 26:
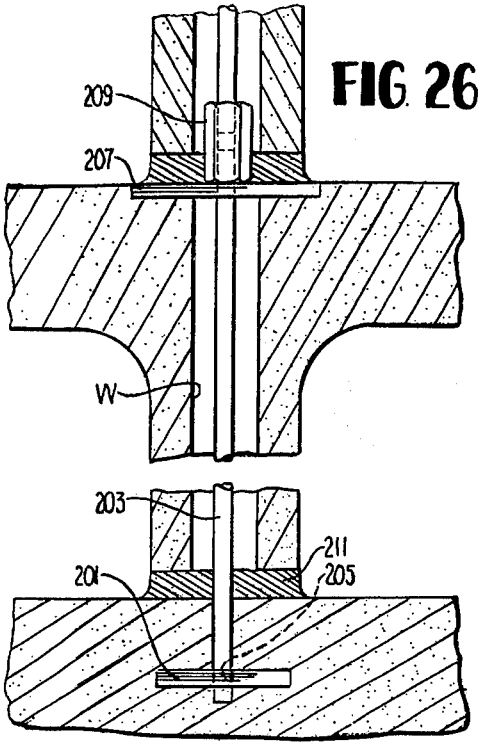
Figure 27:
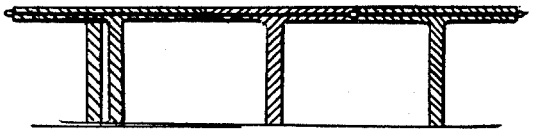
Figure 28:
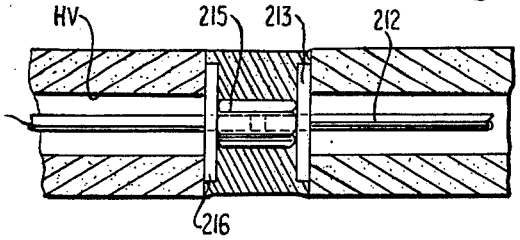
Figure 29:
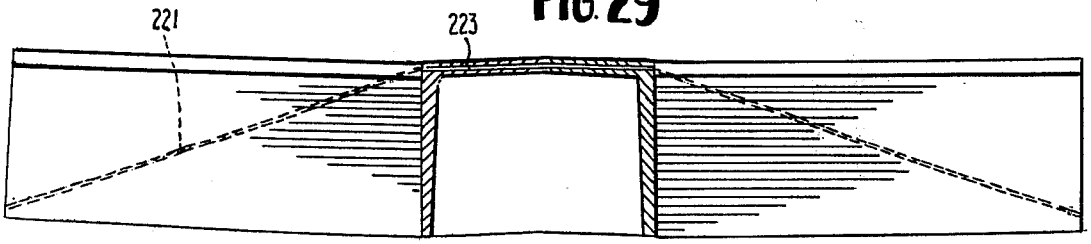
Figure 32:
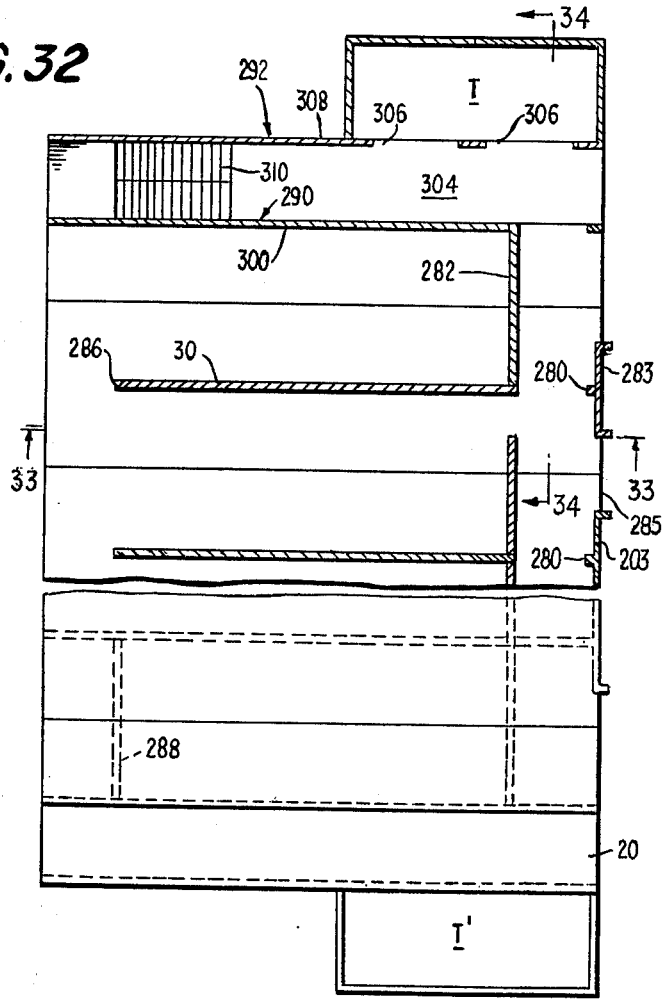
Figure 33:
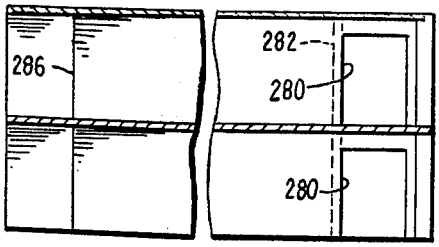
Figure 34:
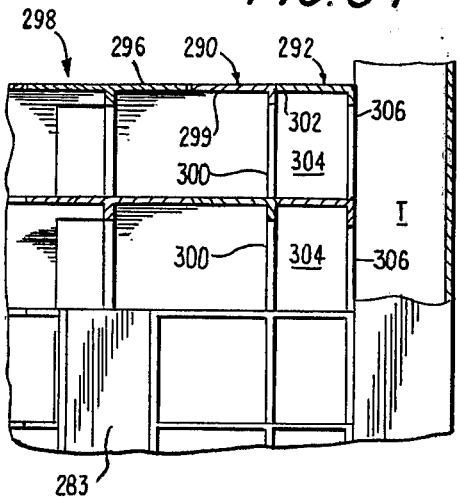
Figure 40:
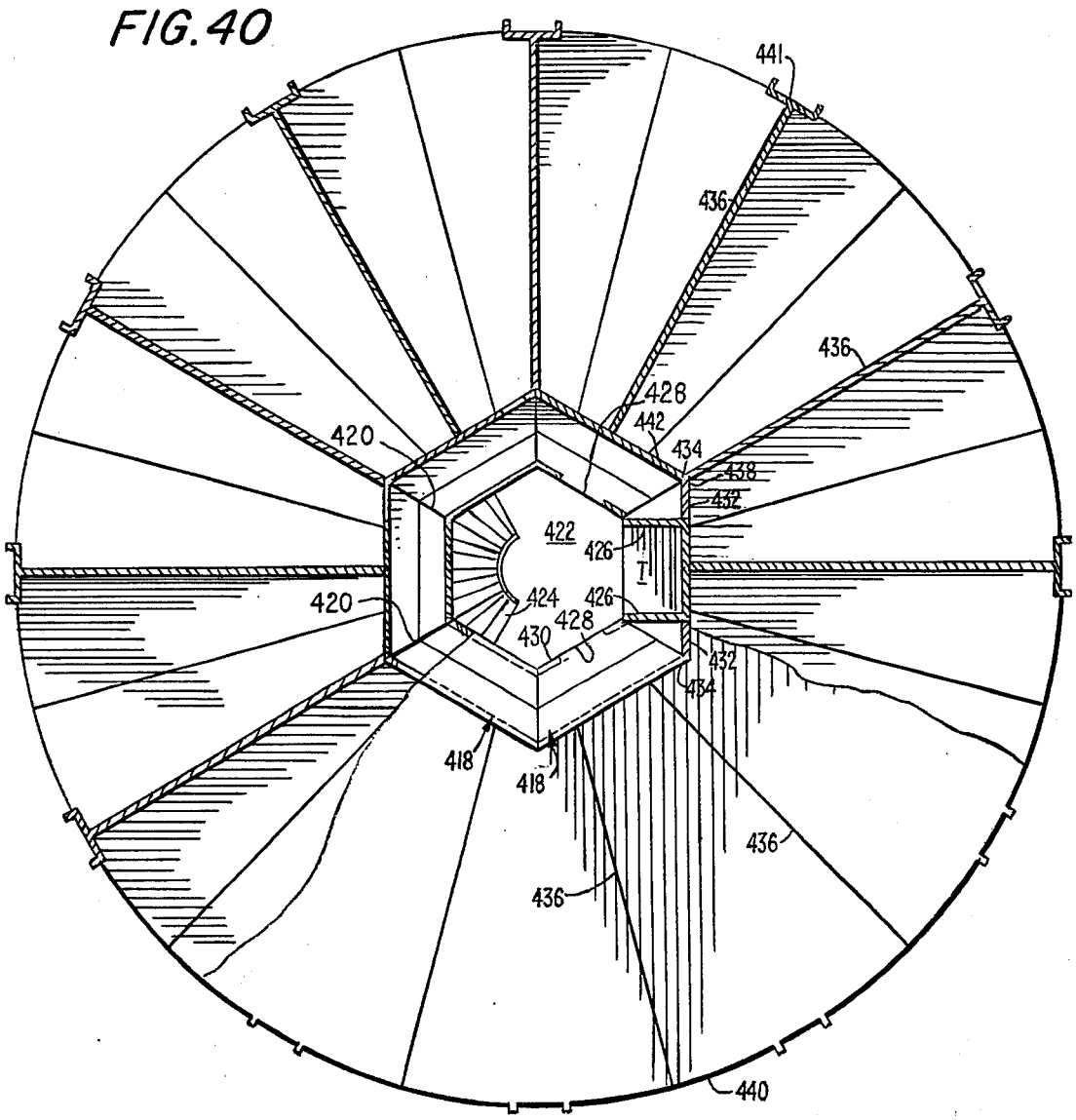
Figure 41:
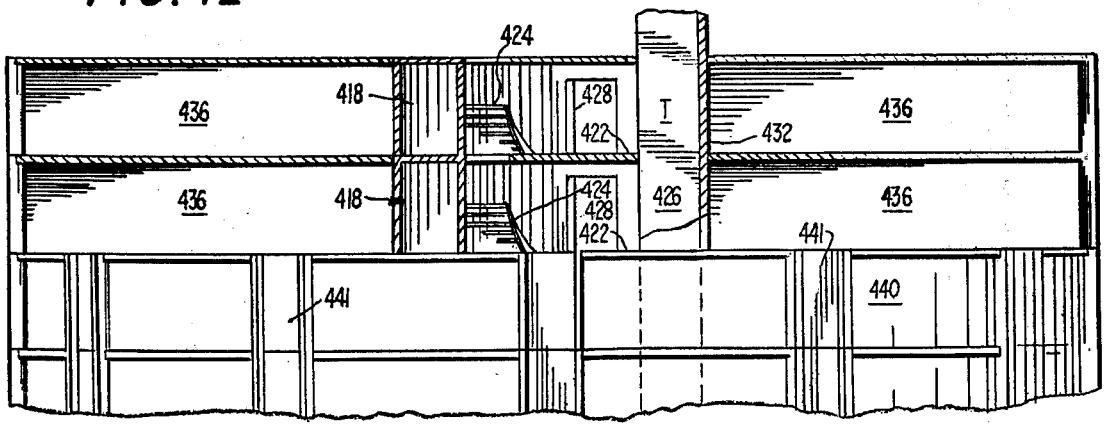

FIG. 13 is a view similar to FIG. 12*a* showing an alternate interconnection for adjacent Tee flanges;

FIG. 14 is an enlarged fragmentary cross-sectional view illustrating the joint between the leg of a modified Tee and an underlying modified Tee as well as the lateral joint formed between the modified Tees and the ends of a pair of superposed Tees;

FIG. 15 is an enlarged fragmentary horizontal cross sectional view taken on line 15—15 of FIG. 14;

FIG. 16 is an enlarged fragmentary horizontal cross-sectional view illustrating the joint between a modified Tee and the ends of a pair of adjacent Tee elements;

FIG. 17 is a fragmentary perspective view of a plurality of adjacent ranks of Tee elements illustrating an alternative facade configuration;

FIG. 18 is a fragmentary top plan view of an end portion of one of the Tee elements of FIG. 17 illustrating a further form of construction thereof and shown with portions broken out for ease of illustration;

FIGS. 19–24 are schematic perspective illustrations of the method of constructing the building illustrated in FIG. 1 hereof, the figures showing the sequency of assembly steps with the final structure being illustrated;

FIG. 25 is a cross-sectional view of a plurality of superposed Tees illustrating vertical post tensioning of the Tees;

FIG. 26 is a fragmentary enlarged cross-sectional view illustrating a joint between the post tensioning rods of a pair of superposed Tees;

FIG. 27 is a cross-sectional view of a plurality of laterally adjacent Tees illustrating horizontal post tensioning of the Tees;

FIG. 28 is a fragmentary cross-sectional view illustrating a joint between the post tensioning rods of a pair of horizontal adjacent Tees;

FIG. 29 is a schematic view of a post tensioning arrangement;

FIGS. 30*a* and 30*b* are fragmentary perspective views illustrating another form of the Tee construction;

FIG. 31 is a fragmentary perspective view of a Tee and modified Tee construction showing a ducting arrangement;

FIG. 32 is a horizontal cross sectional view of another building design in accordance with the present invention utilizing Tee and modified Tee elements;

FIG. 33 is a fragmentary cross sectional view thereof taken about on line 33—33 in FIG. 32 and illustrated with portions broken out for ease of illustration;

FIG. 34 is a vertical sectional view taken about on-line 34—34 in FIG. 33;

FIG. 35 is a schematic view on another all-Tee building;

FIG. 36 is a perspective view of yet another building construction in accordance with this invention;

FIG. 37 and 38 are fragmentary cross-sectional views of portions of FIG. 40;

FIG. 39 is a schematic plan view of an arcuate building utilizing the Tee and modified Tee construction hereof;

FIG. 40 is a top plan view of a circular building utilizing the Tee and modified Tee construction system, certain portions being broken away and in cross section to illustrate the various parts;

FIG. 41 is a side elevational view of the circular building with portions broken away and in cross-section;

FIG. 42 is a fragmentary top plan veiw with portions broken out and in section illustrating a precast concrete construction for the flanges of a Tee;

FIG. 43 is a fragmentary side-elevational view thereof;

FIG. 44 is an end view of the Tee schematically illustrating the reinforcement therefor;

FIG. 45 is an enlarged cross sectional view of the form sides with the reinforcing bars disposed therein prior to pouring concrete;

FIG. 46 is a fragmentary side elevational view of another form of building construction according to the present invention;

FIGS. 47–49 are fragmentary perspective views of the various forms of Tees employed in the building construction of FIG. 46;

FIG. 50 is a side elevational view of a tee illustrating its employment in forming a cell having an enlarged ceiling;

FIG. 51 is a side elevational view of a tee illustrating its employment in forming a cell having an enlarged ceiling;

FIG. 52 is a fragmentary perspective view of a building construction according to another form of the invention hereof;

FIG. 53 is a perspective view of a bathroom module for use in the construction illustrated in FIG. 52;

FIG. 54 is a fragmentary cross-sectional view of the building construction illustrated in FIG. 52;

FIG. 55 is a fragmentary perspective view of still another form of building construction hereof;

FIG. 56 is a perspective view of a bathroom module for use in the construction illustrated in FIG. 55;

FIG. 57 is a fragmentary horizontal cross-sectional view of the construction illustrated in FIG. 55;

FIGS. 58 and 59 are fragmentary cross-sectional views taken about on lines 58—58 and 59—59 respectively in FIG. 57.

FIG. 60 is a fragmentary perspective view of still another form of building construction hereof;

FIGS. 61 and 62 are perspective views of the basic T-shaped elements forming the building construction illustrated in FIG. 60;

FIG. 63 is a fragmentary side elevational view of the building illustrated in FIG. 60;

FIG. 64 is a cross-sectional view thereof taken about on line 64—64 in FIG. 63;

FIG. 65 is a fragmentary perspective view of still another form of building constructed in accordance with the present invention;

FIG. 66 is a perspective view of one form of building element employed in the buiding illustrated in FIG. 65;

FIG. 67 is a fragmentary side elevational view of the building illustrated in FIG. 65; and FIG. 68 is a fragmentary cross-sectional view thereof taken about on lines 68—68 in FIG. 67.

FIG. 69 is a fragmentary perspective view of a still further form of building constructed in accordance with the present invention;

FIG. 70 is a fragmentary horizontal cross sectional view thereof;

FIGS. 71 and 72 are cross sectional views thereof taken about on lines 71—71 and 72—72 respectively in FIG. 70;

FIG. 73 is a fragmentary perspective view of a still further form of building constructed in accordance with the present invention;

FIG. 74 is a plan view thereof;

FIG. 75 is a side elevational view thereof;

FIG. 76 is a fragmentary perspective view of another form of Tee employed in the building construction hereof; and FIG. 77 is a fragmentary plan view of the Tee illustrated in FIG. 76.

DETAILED DESCRIPTION OF THE INVENTION

As noted above, the systemized industrialized building construction system of the present invention employs a basic element, the Tee, and a modified Tee where applicable. In various arrangements and configurations as hereinafter amplified, the Tees, and modified Tees where applicable, are utilized in all of the constructions according to this invention. Several different constructions following the basic principles of the invention are shown and described herein, these being illustrative of only a few variations of the many possible building designs utilizing essentially an all Tee construction.

The basic element is illustrated in perspective in FIG. 1 and comprises an elongated Tee such as that denoted 2 having a vertical stem 3 and a pair of flanges 4 and 5 extending substantially normal to the stem 3 along opposite sides of the latter. The modified Tee is generally denoted 6 and comprises a half-Tee having a stem 8 and a flange 10 to one side of the stem. The modified Tees 6 are utilized to form the ends of the buildings, the hallways, elevator lobbies, and the elevator tower where applicable in a particular building design. The basic and modified Tees in their various assemblages provide both structural support for the building and the exterior facades and interior partition walls.

Of special significance is the fact that the Tees and modified Tees constituting the building blocks of the system are of such dimensions that these elements per se form full sized side and end walls, floors and ceilings of cells such as rooms, halls, etc. comprising a building without the need for further components. In other words, the Tees and modified Tees are of minimum height width and length sufficient to comprise the structural walls dividing the building into separate units, together with connecting hallways and the like as necessary, suitable for human occupancy and/or movement.

Referring now specifically to FIGS. 1-7, there is illustrated a multi-story building erected utilizing the basic Tee construction including in this form, the modified Tee construction, of the present invention, the method of construction of this building being described hereinafter. Particularly, the building, generally designated 11 is formed on a foundation including, for example, a plurality of pilings P (FIG. 3) and a foundation floor or slab 12 constructed in the usual manner, and having a plurality of upstanding columns 14 arranged in a manner compatible with the Tee construction system as amplified below. [Alternatively, the Tee construction can be started utilizing a ground floor slab in lieu of the beam type construction]. Columns 14 may be precast or poured in place concrete as desired and extend vertically to provide support for a sub or first floor of building 11 as well as for the assembly of Tee and modified Tee elements which form the remainder of the building upwardly from the sub or first floor. The column type construction illustrated is employed for example to provide an enlarged lobby and/or parking area in the specific building illustrated. Also, a column type construction can be utilized at the top of the building and at any intermediate level or plurality of levels thereof to provide an enlarged area as the particular building design dictates.

Building 11 of FIG. 1 essentially comprises four functional elements; elevator lobbies, E.L., an elevator tower T, hallways H connecting with the elevator lobbies, and a plurality of internal cells C off the hallways and elevator lobbies. These elements are formed solely of basic components of the present construction system, i.e., Tees and modified Tees.

As the elevator lobbies and tower and the hallways are the first elements formed and erected in the building design disclosed in FIGS. 1-4 in a manner hereafter described, their construction will not be described. To form elevator lobbies, E.L., a plurality of performed modified Tees 6*a* are stacked one on top of the other and in lateral juxtaposition one to the other with their flanges 10*a* lying in a common horizontal plane to form a pair of side by side ranks of superposed modified Tees 6*a*. The paired ranks form a plurality of composite, superposed, horizontally disposed channels. Elevator tower T comprises a pair of modified Tees 6b having enlarged flanges 10b. Modified Tees 6b are disposed on their ends on a previously prepared elevator pit E.P. (See FIG. 3) in lateral juxtaposition one to the other with their flanges 10b lying in a common vertical plane to form an elongated vertically extending composite channel. Modified Tees 6b are erected so that their stems 8b abut the sides of the stacked modified Tees 6a forming the elevator lobbies E.L. Openings are provided through the stems of the stacked modified Tees 6a into the vertically extending channel formed by modified Tees 6b to provide access to one or more elevator cabs later to be installed within the elevator tower, or to the cells, maintenance or storage rooms, etc.

Hallways H are formed similarly as the elevator lobbies form a plurality of preformed modified Tees 6c stacked one on top of the other and in lateral juxtaposition one to the other with their flanges 10c lying in a common horizontal plane to form a pair of side by side ranks of superposed modified Tees 6c. The paired ranks form a pluarlity of composite superposed horizontally disposed, hallway forming channels. The hallways H formed by modified Tees 6c extend longitudinally from the open ends of the elevator lobbies E.L. As illustrated in FIGS. 1 and 3 the width of hallways H is less than that of elevator lobbies E.L. whereby the elevator lobbies are wider than the adjacent hallways. This is useful in certain instances, e.g., in hospitals, hotels, etc. to provide extra freedom of movement in the vicinity of the elevators. However, it should be understood that the elevator lobbies and hallways may be made of equal width simply by adjustment of the forms in which the modified Tees are cast.

Also, as previously noted, the height of the stems forming elevator lobbies E.L. and hallways H is sufficient to provide the full wall height for each story of the building whereby stacking of the Tees and proper interconnection as explained below immediately results in a completed structure for the lobbies and hallways.

Internal cells C are formed by interconnection of a plurality of Tees 2. As illustrated, Tees 2 are superposed to form a plurality of laterally adjacent ranks or tiers of cells. In the illustrated construction, the Tees directly abut the hallways H, elevator lobbies E.L. or, in the case of Tees 2a–2c, the flanges 10b of the modified Tees 6b forming elevator tower T. The spaced stems of laterally adjacent Tees, e.g. stems 3e and 3f form sidewalls for cells such as $C_1$ while the legs of the modified Tees forming hallways H form third interior walls for the cells. Doorways are preformed in the modified Tee stems providing access between the hallways and the cells.

As seen in FIG. 1, one form of Tee 2, provides a facade F at its outer end common to adjacent cells extending between the floor and ceiling of the associated cells. The facade may extend less than the full width of the Tee to provide an open or window area W between the ends of laterally adjacent facades. Thus, when the Tees are vertically superposed, the end facades F and window areas are vertically aligned as illustrated on the left side of the building in FIG. 1. Other external treatments, e.g., balconies, may also be provided as explained hereinafter. As previously noted, the flanges of adjacent Tees are connected together to form common ceiling and floor between cells on adjacent stories. To close off the ends of the building and to provide additional superposed rooms with the outstanding flanges of the end Tees, there is provided a plurality of elongated L-shaped members, modified Tees 6, which are inverted and superposed on top of each other with their inwardly directed flanges 10 connected to the associted outstanding flanges 5 of the outermost ranks of Tees.

It will be appreciated that the stems of the superposed Tees lie in respective vertical alignment and thus serve as basic structural components of the building. Accordingly, the foundation columns 14 for the building illustrated in FIG. 1 are arranged in spaced laterally extending column lines to provide underlying structural support for the stems of the cell forming Tees. Similarly, other spaced columns 14 are positioned in vertical alignment with the stems of the superposed modified Tees forming the hallways H and the elevator lobbies E.L. In order to support the loading on the building and to provide Tees of the size essential to the present construction, the Tees are uniquely formed in a manner as will now be described.

The Tees and modified Tees may be formed of conventional heavyweight concrete. Regular or quick setting concrete formulations may be used. Low density aerated or foamed concrete, such as disclosed in U.S. Pat. No. 3,062,669 dated Nov. 6, 1964 or U.S. Pat. No. 3,144,346 dated Aug. 11, 1964 may be employed. The disclosures of the foregoing patents are incorporated herein by reference in their entirety as though fully set forth herein. The foregoing materials are generically denoted hereinafter as concrete, and the following description is written with specific reference to concrete materials. However, it will be understood that the Tee and modified Tee elements can be formed of other materials. For example, the elements may be formed of molded or extruded reinforced plastic. The elements may also be formed by providing cores of foamed urethane or frameworks comprised of metal beams with sheet metal plates forming the skin for the foamed core or metal framework. Various other materials or combinations of materials may likewise be utilized as will become apparent to those skilled in the art.

For casting concrete Tees and modified Tees, a suitably shaped form of generally conventional nature may be employed. Alternatively, Tee forms such as described respectively in U.S. Pat. No. 3,724,143, to which reference is hereby made, may be employed. As a further alternative, prestressed concrete extrusion techniques may also be employed.

The construction of a basic Tee is fully described and illustrated in my copending application Ser. No. 807,217, filed Mar. 14, 1969, the disclosure of which is incorporated herein by reference to that application as though here fully set forth. The Tee construction there disclosed may be utilized in each of the building designs herein described and illustrated and, indeed, in any building design utilizing the basic all-Tee construction of the present invention. The following is a description of another form of a Tee and half-Tee construction useful with the all-Tee construction disclosed herein and also useful with the Tee and Channel construction of application Ser. No. 807,217.

Referring now to FIGS. 5, 6, and 7a, there is illustrated a form of Tee construction having a stem 30 and a pair of flanges 32 extending substantially normal to the stem in opposite directions at its upper edge. As compared with the Tees disclosed in application Ser. No. 807,217, the stems and flanges of the present Tees are formed thicker than their counterparts disclosed in that application as the present Tees would normally be employed in constructing buildings having extra wide bays or cells or in buildings extending higher than for example 20 stories wherein the increased weight of the Tees disclosed in application Ser. No. 807,217 (since their stems and flanges would necessarily require thickening to carry the increased loads) would become prohibitive. The thickened stems and flanges of the present Tees are provided with voids or cores extending therethrough. Particularly, stem 30 is provided with vertically extending longitudinally spaced, preferably cylindrical cores or voids VV whereas horizontally extending and spaced, preferably cylindrical cores or voids HV are provided through the flanges 32 transversely from one edge to the other. In the illustrated form, the voids VV in the stem 30 are horizontally spaced and do not intersect the voids HV in flanges 32. It will be appreciated that such voids may be located as to intersect one with the other as desired. The cross-section of the cores or voids may be circular, elliptical, rectangular, or any other configuration as desired.

In the illustrated form, the Tee is precast of concrete material in forms provided at the construction site. To provide Tees constructed of such concrete material having the requisite size, strength, and characteristics essential to their utilization in the building construction system herein disclosed, a plurality of longitudinally spaced, inverted L-shaped, reinforcing rods 34 and a plurality of horizontally extending reinforcing rods 36 are contained in each of the Tees. L-shaped rods 34 are disposed such that their vertical legs 38 extend through the entire height of stems 30 between voids VV, while their horizontal legs 40 extend outwardly to the ends of flanges 32. The rods 34 are longitudinally spaced with their horizontal legs 40 alternately extending in opposite flanges. A vertically extending reinforcing wire mesh 42 is disposed between legs 38 of rods 34 and between the walls of voids VV and the external side wall of stem 30, with legs 40 alternately crossing over at the top of the mesh as seen in FIG. 11.

Horizontal reinforcing rods 36 are also disposed bwtween the legs 38 of rods 34 and between the walls of voids VV and the external side wall of stem 30, and, as seen in FIG. 6, a pair of rods 36 are provided along the lower edge and intermediate portions of the stem. Additional longitudinally extending reinforcing wire mesh 44 is disposed on top of the horizontal legs 40 of rods 34 and is coextensive with the flnges of the Tee either outwardly or inwardly of voids HV.

The above described reinforcement may be supplemented if necessary by pre and/or post-stressing techniques as will be described. The L-shaped rods 34 may be pretensioned and restrained before the concrete is poured, especially for low-rise buildings. Cables may be disposed between he mandrels utilized in the forms to form the voids in both the stems and flanges and pretensioned prior to pouring the concrete. Where the required pretensioning would be so great that the Tee could not support the force upon release of the restraint, post tensioning, i.e., after the concrete has been poured and has set to about 60% of its ultimate design strength, may be employed. The horizontal legs 40 of L-shaped rods 34 can be post stressed in the manner described to provide adequate structural integrity and resistance to the tensile stresses in flanges 32 of the Tee elements. Also, combinations of pre- and post-stressing may be employed. A particular form of post-tensioningg in constructing a building will be described hereinafter.

A plurality of connectors may be integrally cast with the Tees to provide for interconnection between laterally adjacent and superposed Tees as well as with the modified Tees as necessary in the course of construction. Supports are also integrally cast with the Tees to provide a column type loading as hereinbelow amplified. Referring to FIGS. 5, **12*a* and 12*b*, a plurality of angle brackets 46 are longitudinally spaced along the opposite lateral edges of the flanges 32 of the Tees. Preferably, brackets 46 are disposed intermediate the vertical extent or thickness of flanges 32 with the flange 48 of each bracket 46 lying flush along the lateral edges of the Tee flanges 32**.

To secure those brackets 46 lying intermediate the ends of the Tee to the edges of flanges 32, reinforcing rods 50 bent in a generally V-shape may be welded along the undersides of the inwardly extending flanges 52 of brackets 46 with the legs of rods 50 extending substantially at right angles and obliquely inwardly toward stem 30. The rods may be angled upwardly or downwardly to avoid passing through a void HV. Any desired number of brackets 46 may be provided along the opposite ends of flanges 32 and preferably a bracket 46 is located along the lateral edges of the flanges 32 adjacent to the ends. As seen in FIG. 5, a reinforcing rod 54 extends in underlying relation to the inwardly extending flanges 53 of brackets 46. The ends of the rods 54 extend obliquely inwardly toward the stem 30 as indicated at 56.

An alternative method of securing brackets 46 to the Tees is illustrated in FIG. 18 wherein an elongated U-shaped reinforcing rod 58 extends through flanges 32 between the brackets 46 on opposite sides of the Tee. Rods 58 are welded to the undersides of bracket flanges 52 as in the configuration of FIG. 5.

As illustrated in FIG. **12*a*, bracket flanges 52 are recessed from the top surface of Tee flanges 32. Also, the edges of flanges 32 about bracket 46 are preferably tapered as at 60** to provide ample space for welding together the brackets of the flanges of adjacent Tees as hereinbelow amplified.

A different technique for connecting adjacent Tee flanges is illustrated in FIG. 13. Here, the ends **40*a* of horizontal legs 40 comprising L-shaped reinforcing rods 34 extend beyond the vertical edges 32*a* of the Tee flanges 32 and are connected by a poured-in-place concrete joint. This construction is especially useful when post-stressing or rods 40 is employed. Thus, rods 40 are coated with a suitable retarding or debonding agent 63 to prevent rapid set of the concrete around the rods. After the concrete has been poured and allowed to set to a predetermined fraction of its ultimate design strength, rods 40** are stressed and secured in usual fashion with the concrete allowed to obtain its ultimate strength.

The Tee element is then stripped from the form and erected with the exposed rods ends 40 arranged to overlap each other as shown. The rod ends are tack welded to provide a temporary connection and a hand finished concrete joint 61 is placed between the ends **32*a* of the flanges 32, completely enveloping the exposed rod ends 40*a***. To provide a smooth finished joint, a simple flat form arrangement may be provided. The joint may be formed of concrete, preferably a quick setting formulation, as mentioned, or they may be formed of grout or expanding grount which will add stress to post stress rods or in some cases provide total pre-stressing. Other materials, such as a compatible epoxy resin may also be employed. A strong uniform connection may be provided in this manner.

Referring to FIGS. 5, 10 and 11, a plurality of longitudinally spaced plates 62 are integrally cast in the top of the Tee medially between the opposite lateral edges thereof, in vertical alignment with stem 30, and between voids HV. Preferably, plates 62 lie flush with the upper face of the Tee and are similarly spaced along the Tee as brackets 46 to lie between transversely aligned brackets 46. As seen particularly in FIGS. 10 and 11, a plurality of rods 64 having heads 66 may be welded or otherwise secured to plates 62. Rods 64 extend through and below horizontally extending wire mesh 44 and anchor the plates 62 to the Tee.

Supports, generally indicated at 68, are spaced along the lower edge portion of each Tee stem 30 between voids VV. As seen in FIGS. 6, 10 and 11, each support comprises an elongated plate 70 welded or otherwise secured to the upper end of a vertically extending cylindrical coupler 72. Coupler 72 is internally threaded to receive a bolt 74 about which is threaded a lock washer 76 and lock nut 78 whereby bolt 74 can be threaded into and locked in selected axial positions relative to coupler 72. Each bolt 74 extends from coupler 72 within a recess 82 formed through the lower edge of Tee stem 30 whereby access to bolt 74, lock nut 78 and bolt head 80 can be obtained from either side to stem 30 during construction of the building as amplified below.

Referring back to FIGS. 5 and 6, a facade or panel F may be integrally formed on one end of the Tee as desired. Where an end facade is utilized, it may include a plurality of vertically extending laterally spaced reinforcing rods and a wire reinforcing mesh, not shown. In the form illustrated, the facade F extends laterally a distance short of the edges of flanges 32 and a pair of decorative flanges 86 are formed and project outwardly along its opposite lateral edges.

Referring to FIG. *7a*, each of the facade panels F is provided with a leveling lug 68*a* identical in construction to supports 68 illustrated in detail in FIGS. 6, 10 and 11. Leveling lugs 86*a* are located in a pair of rabbet grooves 87 in the back surface of the facade panel F as illustrated. This provides access from inside the building to leveling lugs 68*a* during erection, but retains a smooth, unbroken exterior facade surface. Rabbet grooves 87 may be filled with grout or suitable dry packing after the Tee element has been erected and the leveling lugs 86*a* properly adjusted.

It should be noted that the particular shape of the end facade F herein illustrated is only exemplary. It is a particular advantage of the present invention that other end fascade shapes and treatments may be provided with equal facility. For example, facades F may be laterally offset on the stem as illustrated in the building of FIG. 17 or may be provided in various external shapes for example, a diamond shape, the facade shape being virtually unlimited. Also, precast emblems, crests, figurines, etc. may be provided on the face of the facades. Epoxy bonded exposed aggregate facings may also be provided.

As illustrated, the facade panel F extends approximately one-half the width of flanges 32. This provides an open space between adjacent facade panels in the erected building to accomodate a window panel W as illustrated in FIG. 1. Alternatively, facade panel F may be wider or narrower as desired, but it will be understood that, although the width of the facade panel may exceed the total width of the two flanges, to assure geometric compatability it is preferable to maintain facade width no wider than the Tee width.

Also as illustrated in FIG. *7a*, the facade panel F extends the full height of Tee stem 30 thereby providing a continuous unbroken facing in the erected building. Alternatively, the facade panel may be longer or shorter as required by the particular design of the building under construction. As a further alternative, the facade panel may project upwardly above the Tee stem 32 thereby providing a precast railing or parapet for a balcony or walkway on the vertically adjacent Tee.

Doorframes or bucks, indicated at 90, are preferably cast integrally with the Tee at selected locations along the stem 30. The door frames may comprise either wood or steel frames, and as seen in FIG. 6, a plurality of longitudinal reinforcing rods 92 are disposed above the head frames.

As illustrated in FIG. *7a*, the corner or junction between the under surfaces of Tee flanges 32 and and the adjacent sides of stem 30 is cast in the form of wide radius 88*a*. This is quite convenient and provides an interesting and decorative treatment which may be desirable in certain instances and may provide a cut off for paint and acoustical ceiling, spray or tile, wallpaper, etc. Other corner treatments as shown in FIGS. *7b–7d* are also possible. For example, FIG. *7b* shows a precast cove molding 88*b* formed of a wide radius section 89*a*, a horizontal offset 89*b*, between the radius and one of flanges 32. Other molding effects or treatments are as chamfer 88*c*, shown in FIG. *7c* and tight radius 88*d* shown in FIG. *7d*. The latter is especially useful where an internal right angle corner is desired. The tight radius avoids the necessity of casting a sharp interior edge while producing essentially the same aesthetic effect.

Referring now to FIGS. 8 and 9, there is shown a pair of modified Tees 6 for forming hallways, elevator towers, building ends (employing a single modified Tee) and elevator lobbies as the building design dictates, each modified Tee 6 comprising a flange portion 100 and a stem 102. To provide sufficient strength, modified Tees 6 are preferably but not necessarily cast with a plurality of integral longitudinally spaced, inverted L-shaped reinforcing rods 104. As with the full Tee, horizontally and vertically extending voids HV and VV may be respectively formed in the flange portion 100 and stem 102 of modified Tee 6 to reduce the weight of the modified Tee as necessary, and to provide conduits for plumbing, heating lines etc. and post-tensioning devices in a manner to be described. The voids in the stem and flange portions may intersect or lie in spaced relation each from the the other similarly as the full Tees. Rods 104 extend vertically within stems 102 between the void walls and the face of the stem and are bent at their upper ends to extend within a part of flange portion 100. Wire reinforcing mesh (not shown) may be added as required throughout stems 102 and through flange portions 100.

As in the case of the full Tees, a plurality of door bucks 109 arre integrally cast in the stems 102 of the modifed Tees 6 at selected positions therealong in accordance with the building design. As seen in FIG. 9. longitudinally extending reinforcing bars 106 are provided along lower edge portions of stems 102 and additional longitudinal extending reinforcing bars 108 are located above the head frames of door bucks 109 similarly as Tees 2 are constructed. The side of the bars and their spacing may be varied in accordance with the height of the structure.

The modified Tees are cast of concrete material utilizing the same forms as employed in casting Tees 2 with one of the flange portions of the form being blocked off. The stems 102 of the modified Tees may, if desired, be tapered to facilitate removal of the modified Tee from its form. However, it should be understood that stems having a constant width throughout their height can be formed and that either tapered or constant width stems may be utilized in both Tee and modified Tee construction. The modified Tees may also be pre-tensioned or post-tensioned similarly as the full Tees.

Various supports and connectors are carried by the modified Tees for respectively carrying the building load and connecting the modified Tees to one another and to the various Tees of a particular building design. Supports, generally indicated at 110, are provided at longitudinally spaced positions along the lower edge portions of stems 102. The supports are cast integrally with the modified Tees and protrude outwardly into rectangular cutouts or recesses 112.

With reference FIGS. 14 and 15, supports 110 are generally similar to supports 68 in the lower edge portion of each Tee stem 30. Thus, each support 110 comprises an elongated plate 114 welded or otherwise secured to the upper end of a vertically extending cylindrical coupler 116. Coupler 116 is internally threaded to receive a bolt 118 about which is threaded a lock washer 120 and lock nut 122 whereby bolt 118 can be threaded into and locked in selected axial positions relative to coupler 116. A bolt head 124 is located on the lower end of bolt 118. The extension of bolts 118 from coupler 116 within recesses 112 provide access to bolt head 124 and lock nut 118 from either side of leg 102 during construction of the building as amplified below.

Referring still to FIGS. 14 and 15, a plurality of angle brackets 128 are formed at longitudinally spaced positions along the upper lateral edge portions of the modified Tee 6. The upper flanges 130 of brackets 128 preferrably lie flush with the upper face of flange portion 100 and their side flanges 132 are inset from the side faces of the associated stem 102. Brackets 128 are welded to the reinforcing rods or may be provided with rods, not shown, similar to rods 64 shown in FIG. 11. The brackets 128 can be inset from the upper face of the flanges, if desired.

For lateral connection of the modified Tees the end of a Tee, plates 136 (FIG. 16) having rods 138 secured thereto are integrally cast with the modified Tee at spaced longitudinal positions along the side edges of the stem 102 adjacent flange portion 100. The plates 136 lie flush along the stem 102.

As an illustrated example of the dimensions of the Tees employed in the construction of the building illustrated in FIG. 1 and in comparing the instant Tees with those disclosed in application Ser. No. 807,217, and present Tees are preferably 7 feet 11 inches in height from the lower edges of the stems to the underfaces of the flanges. Whereas previously the Tees which were constructed having 4 inch thick stems and flanges were preferably formed to 12 feet 4 inches wide between opposite edges of the flanges, the present invention can provide a Tee having a distance on the order of 26 to 32 feet between the opposite edges of the flanges whereby enlarged bays or cells between the stems of adjacent Tees can be formed as will be described. Moreover, an 8 inch thick cored stem or flange having voids 5½ to 6 inches in diameter on 8 inch centers obtains very nearly the same weight as a 4 inch solid Tee construction obtains without voids, thus it is possible to form much wider bays or cells with the cored construction hereof than with a solid construction and also to construct the building to a height much greater than would be practical with a solid Tee construction. Preferably, the Tees have an overall length of about 33–40 feet.

The Tee element shown in FIG. *7a*, radius of corner **88*a*** between the stem and each flange is preferably about 5¾ inches. However, this could vary to suit architectural requirements. The illustrated end facade F may be about 6 feet wide but may extend to a greater or lesser extent as desired.

For the alternative corner treatments of FIGS. *7b–7d*, the cove molding has a radius **89*a* of 5⅜ inches, and offsets 89*b* and 89*c* of about ½ inch. Chamfer 88*c*** (FIG. *7c*) is preferably but not limited to the hypotenuse of a 45° - 45° right triangle with dimensions **89*d* about 4 inches. The chamber is therefor approximately 5.6 inches long between stem 30 and flange 32. Radius 88*d*** in FIG. *7d* should be at least about 2 inches.

In utilizing the modified Tees to form hallways H for the building illustrated in FIG. 1, the stems 102 of the hallway modified Tees are of the same height as the Tee stems, e.g. 7 ft. 11 inches, plus a 1 inch layer of grout between vertically aligned Tees as explained below. When formed of concrete material, the flange portions 100 have a preferred thickness identical to the thickness of the full Tee flanges. The hallway in this form and utilizing a pair of such modified Tees is preferably about 6–8 feet wide. The thicknesses of the modified Tee stems 102 may taper from juncture with flange portion 100 to its lower edges or be constant in cross-section throughout their height. The modified Tees may be formed in lengths of approximately 33 to 40 feet with the particular length utilized depending upon the particular building design. In the building construction illustrated in FIG. 1 utilizing Tee and modified Tee elements having the foregoing dimensions, a typical Tee weighs on the order of 1000 to 1050 per lineal foot. A typical modified Tee formed to the foregoing dimensions and of similar material weighs about 700 to 850 pounds per lineal foot. The elevator tower, 10 feet 8 inches in width weighs about 1350 to 1400 pounds per lineal foot.

It will be understood that the foregoing is offered not by way of limitation on the various dimensions and weights of the Tees and modified Tees but only as exemplary of their use as full sized components of the building illustrated in FIG. 1. The dimensions may be changed as desired in accordance with various building designs. The lateral extent of the Tee flanges may be reduced or increased to provide narrower or wider rooms as desired. Likewise, the height of the Tee stems may be raised to provide rooms having higher ceilings (or to accomodate suspended ceilings and mechanical and electrical fixtures. The width and height of the modified Tees may also be altered to provide larger hallways, or elevator lobbies, and, as noted previously, the width of a pair of modified Tees can be greatly extended to form elevator tower T. It will be further appreciated that the length of the various Tees and modified Tees as well as other dimensions may be changed in accordance with a particular building design.

Referring back to FIG. 1, it will be recalled that the Tees are disposed in lateral juxtaposition so that the stems from the oppositely disposed side walls of the cells. The flanges of such adjacent Tees are also connected to form ceilings and floors for the vertically superimposed cells. To effect the connection between the flanges, the Tees are positioned with the edges of the adjacent flanges in close but spaced lateral relationship and with the respective angle brackets 46 in lateral registry as seen in FIGS. 12*a* and 12*b*. A plate 140 is placed in recess 60 to overlie and bridge between the horizontal flanges 52 of each of the laterally registering brackets 46. Plate 140 is then welded to the brackets 46. The recesses 60 and the space between the adjacent brackets 46 and between the edges of the juxtaposed flanges 32 are later filled with grout. As will be appreciated, the construction of FIG. 13 eliminates the extra weld plate 140, and the angle 48, but of course requires the hand-finished joint, and the temporary welds on the extending pre-tensioned rod ends 40*a*.

Referring back to FIG. 1, it will be recalled that the Tees are superposed one over the other with the stems 30 lying in vertical alignment to support the aggregate compressive load of the structure. Referring to FIGS. 10 and 11, the lower edge of each superposed stem 30 is spaced from the upper face of its underlying Tee with the supports 68 and plates 62 providing a temporary load bearing connection. At each support 68, the bolt 74 is threaded within its coupler 72 and locked by washer and nut 74 and 76, respectively, such that the head 80 of bolt 74 extends below the lower edge of the stem 30.

When a Tee is placed in position, the bolt heads 80 register vertically with and bear against the anchor plates 62 of the underlying Tee. The bolt heads 80 are tack welded to plates 62 to provide a temporary connection with access to the weld joints from either side of the superposed stem being provided through recesses 82.

After the supports 68 are properly adjusted and tack welded, a layer of grout 81 preferably about one inch thick is dry packed in the space between the undersurface of Tee stem 30 and the upper bearing surface of flanges 32 of the underlying Tee. Then, with the grout providing a support for the weight of the upper Tee, the tack weld between plate 62 and bolt head 80 is broken and the bolt 74 backed off slightly to transfer the entire weight of the Tee to grout layer 81. In certain cases, the bolt 74 need not be backed off but many may be left in the welded position. Recess 82 is then completely packed with grout to seal off support 68 and to provide a finished appearance for the stem-to-flange connection. The superposed Tees are thus anchored vertically with the plates 62 with the dry packed grout distributing the load of the bolt heads 80. This avoids undue load concentrations and cracking and/or chipping of the concrete material.

As explained above, the modified Tees are also superposed to form a plurality of hallways or elevator lobbies. The interconnection between vertically adjacent modified Tees is shown best in FIGS. 14 and 15. Here the adjustable supports 110 along the lower edges of stems 102 are vertically aligned with the angle brackets 128 integrally cast in the lateral edges of the underlying Channels. During erection, bolts 118 are positioned so that heads 124 extends approximately one inch below the lower edge of the stems and bear against the upper falnges 130 of the underlying bracket 128. In this manner, the lower edges of stems 102 of each superposed modified Tee are spaced from the upper face of the underlying modified Tees with the superposed modified Tees being supported by the bolts 124 bearing on the angle brackets 128.

Bolt heads 124 are then tack welded to brackets 128 to provide temporary support. Then, a layer of grout is dry packed in the space between the undersurface of modified Tee stem 102 and the upper bearing flange portion 100 of the underlying modified Tee. Then, with the grout providing a support for the weight of the upper modified Tee, the tack weld between bracket 128 and bolt head 124 is broken and the bolt 118 is backed off slightly to transfer the entire weight of the modified Tee to the grout layer. Recess 112 is then competely packed with grout to seal off 110 and to provide a finished appearance for the stem to stem connection. The connection between the flange portions 100 of the adjacent modified Tees is provided similarly as the connection between the flanges of adjacent Tees as described previously with respect to FIGS. 12*a* and 12*b*.

The connection between the ends of the Tees and the modified Tees for example, when a pair of modified Tees form a hallway for the rooms formed by the Tees, is also illustrated in FIGS. 14–15. Here, a plate 142 is welded to overlie the ends of support plate 62 at the inner end of Tee 144*a* and the horizontal leg 130 of bracket 128 at the corner of the modified Tee. The joint is completed by grout as before upon erection of the overlying Tee 144*c*.

Referring to FIG. 16, there is shown a connection between a modified Tee and a pair of flanges of adjacent Tees. Here, a plate 148 overlies the upper flanges of brackets 46 provided on the ends of adjacent flanges 32 and projects outwardly from the ends of the Tees to provide a welded connection with the plate 136 anchored adjacent the top of the modified Tee. Again, all recesses surrounded the welded joints are dry packed with grout after the welded connections have been completed.

Figure 19:
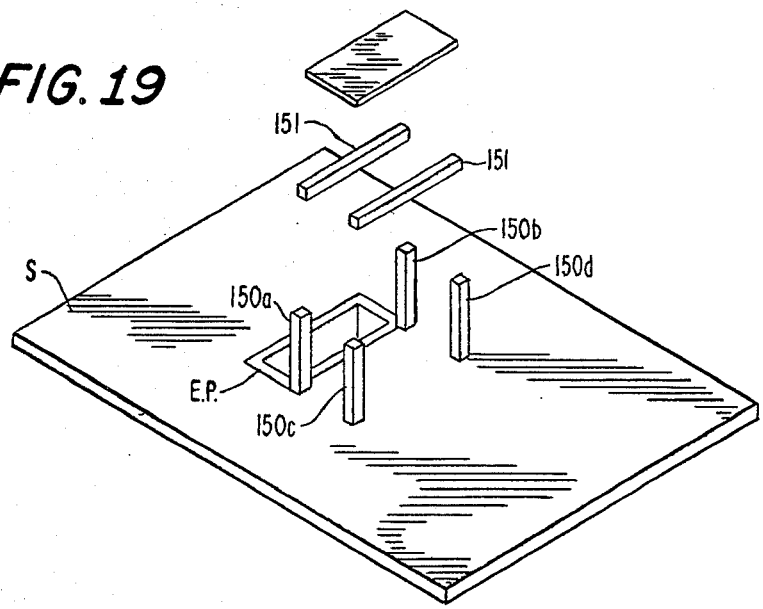

The procedure for erecting a building such as illustrated in FIG. 1 hereof, utilizing the Tee and Channel system is best understood from references to FIGS. 19–24. In FIG. 19, there is illustrated schematically the initial stage of construction wherein the pilings have been set in place and an initial concrete floor slab S and elevator pit E.P. have been poured and allowed to achieve about 40% design strength, e.g. about 3 days. These phases of construction are conventional, and it should be understood that other types of foundations may be employed as necessary or desirable in accordance with local soil conditions, etc.

As an initial step in providing the Tee building construction hereof and with particular reference to FIG. 19, four columns 150*a*–150*d* are erected on the foundation adjacent the elevator pit E.P. in vertical alignment with pilings below the slab S (see FIG. 3) to provide column support for the superposed elevator lobbies as below-amplified. Columns 150*a*–150*d* may be steel, or precast or poured in place concrete. Note that the columns are spaced both longitudinally and laterally in accordance with the respective length and width of the elevator lobbies. A plurality of steel, or precast or poured in place concrete beams 151 are located in top of columns 150*a*–150*d*. The beams and columns may be connected by weld plates or by suitable poured in place concrete jointery. A concrete floor slab 152, either precast or poured in place, is located within the column supported beam layout to provide a floor for the first elevator lobby Channel.

Figure 20:
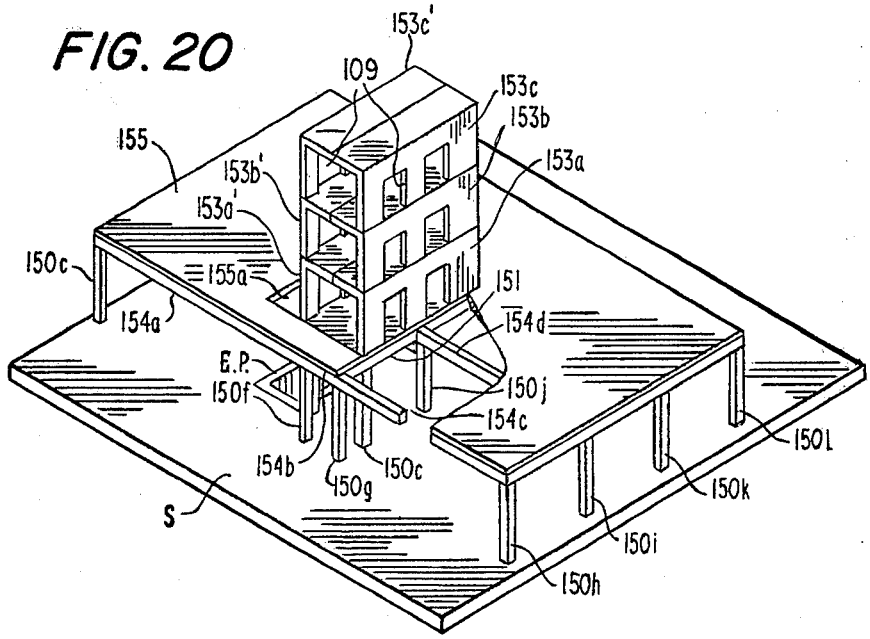

Referring next to FIG. 20, a plurality of precast modified Tees 153*a*–153*c* and 153*a*′–153*c*′ are lifted into place e.g. by means of cranes to form a rank of elevator lobbies E.L. Particularly, the modified Tees in each rank are disposed adjacent one another to form the composite channel in each floor, the flanges 100 being welded to one another as previously described. As each pair of modified Tees are lifted into place, they are tack welded, and then finally secured to the underlying pair of modified Tees in the manner previously described with reference to FIG. 14. Modified Tees 153*a*–153*c* and 153*a*′–153*c*′may be poured the previous day, or earlier, and retained in the forms pending use. Actually for sufficiently long forms, e.g. as used in pouring the elevator tower modified Tees, two or more modified Tees may be poured in a single form. Longitudinally spaced bulkheads would be used to divide the form into sections of the proper length.

To assure adequate resistance to lateral loadings, such as wind loading for the elevator tower later to be erected the height of the initially erected elevator lobbies should be at least 40% and preferably about 60% of the height of the tower. Thus, for a 40 foot tower, preferably two or even three pairs of modified Tees, i.e. elevator lobbies, should be erected initially. The remaining modified Tees forming addtional elevator lobbies may be erected later as described below.

Concurrently with the formation and erection of lobbies E.L., a plurality of additional columns are erected transversely along opposite sides of the columns 150*a*–150*d* supporting the elevator lobbies. Four laterally extending column lines, each comprising four columns are erected spaced the distance between the stem of two adjoining to provide lines of supporting columns for the Tees later to be erected. One such column line, comprising columns 150*a* through 150*h* is shown at the left end of FIG. 20. Part of the adjacent column line including columns 150*j* is also shown, along with the front columns 150*k* and 150*l* of the third and fourth column lines respectively. The additional columns may be formed of steel, or precast or poured in place concrete.

Adjacent columns in a column line, are connected together by a plurality of beams to support the weight of the Tee elements later to be erected. Several beams are shown in FIG. 20, vis., beam 154*a* connecting columns 150*c* and 150*f*, and beam 150*b* connecting columns 150*f* and 150*g* beam 150*c* connecting columns 150*g* and 150*h* and beam 154*d* connecting columns 150*i* and 150*j*. The beams are made of steel, or precast or poured in place concrete or Fiberglass or other materials and may be secured to the associated columns by welding or poured in place concrete jointery as in the case of previously described beams 151.

After the above described columns and beams have beeen erected and interconnected, a flooring 155 is either poured in place or assembled from precast slabs over the beam and column array. Flooring 155 is provided with a rectangular aperture 155*a* aligned with elevator pit E.P. to receive the elevator tower modified Tees which are now ready for erection.

Figure 21:
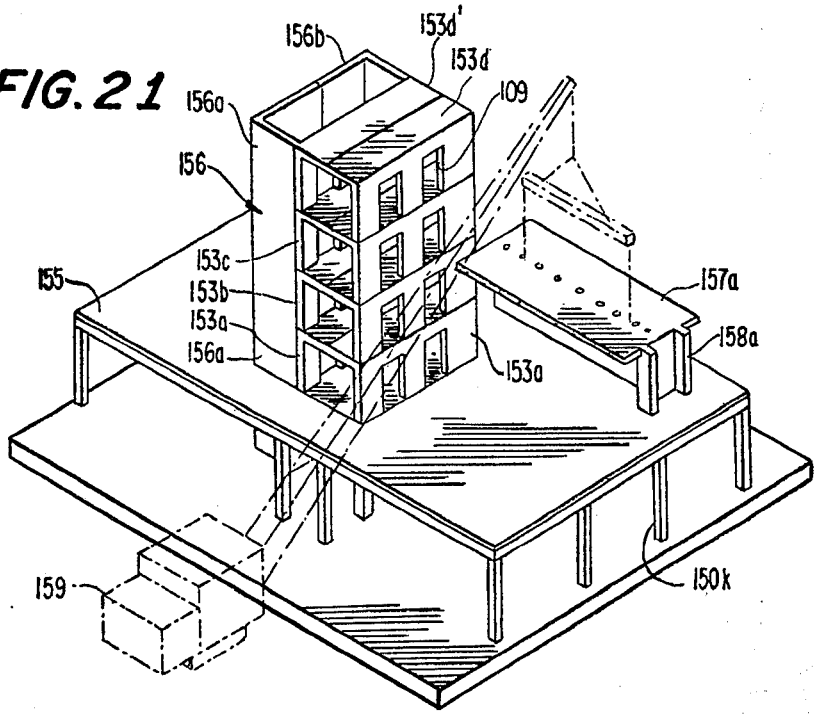

Accordingly, as shown in FIG. 21, the modified Tees 156*a* and 156*b* for the elevator tower 156 are lifted into position behind the elevator lobbies 153*a*′ and 153*c*′and lowered into place through aperture 155*a*. The modified Tees are positioned vertically on their ends and bear against the concrete facing at the top of previously prepared elevator pit E.P. with modified Tee stems 156*a* and 156*b* bearing against the back stems of elevator lobby modified Tees 153*a*′ through 153*c*′. The flanges of the modified Tees forning the elevator tower are secured one to the other similarly as the flanges in FIG. 12*a* are secured one to the other. The modified Tees 156*a* and 156*b* are connected to elevator lobbies 153*a*′–153*c*′ by suitable weld plates (not shown) provided along the edges of the stems and the end edges of the lobby modified Tees.

Elevator tower 156 may be cast as two modified Tees of sufficient length to extend the full distance from elevator pit E.P. to the top of the building. For taller buildings, one or more additional lengths of each modified Tee 156*a* and 156*b* may be provided.

After elevator tower 156 has been erected and secured, one or more additional lobbies such as formed by modified Tees 153*d* and 153*d*′ are erected as previously described to provide a complete rank of lobbies extending up to the full height of the elevator tower.

Figure 22:
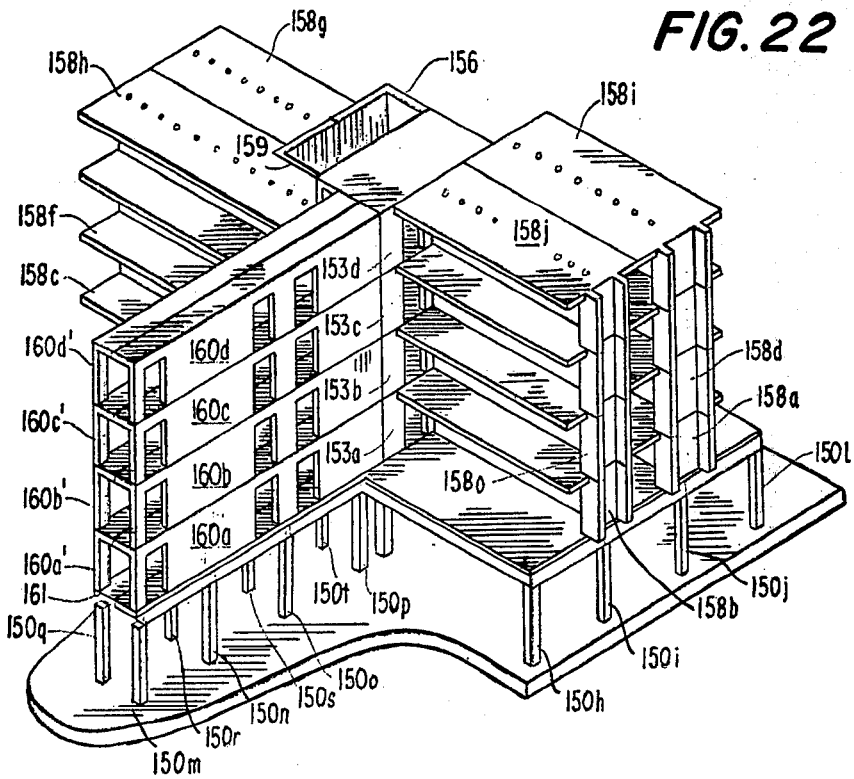

A plurality of doorways 109 are performed through the stems of the elevator lobbies 153*a*–153*d* and 153*a*′–153*d*′. (FIGS. 21 and 22). The doorways through the back stems form the elevator doorways for providing access between the elevator lobbies and the cabs of the elevators. The doorways through the front stems provide access to the building cells formed by the Tees, as described below.

Erection of the first Tee is shown in FIG. 21. Here, Tee element 157*a* is shown being lifted into place by a crane 159 and positioned on floor 155 above the column including column 150*k*. The inner end of Tee 157*a* abuts the front stem of modified Tee 153*a* while the opposite end carried an exterior wall facade 158*a*. In addition to providing the exterior wall, facade panel 158*a* stabilizes the Tee and prevents lateral tipping during erection. The inner end of Tee 157*a* is secured to elevator lobby 153 in the manner shown and described in connection with FIGS. 14 and 15.

Referring next to FIG. 22, an identical Tee (not shown) is erected over the column line including 150*k* on the opposite, i.e., back side of elevator tower 156. Then, another Tee 158*b* is erected on floor slab 155 adjacent to previously erected Tee 158*a* over the column line including column 150*i*. Tee element 158*b* is connected to elevator lobby modified Tee 158*a* in the same manner as Tee element 158*a* while the adjacent flanges of Tees 158*a* and 158*b* are connected together in the manner described in reference to FIGS. 12*a* and 15*b*, or FIG. 13. Tee element 158*c* is next erected with its stem overlying the column line including column 150*i*, that is, directly behind Tee element 158*b*.

As will be appreciated from the foregoing, construction of two ranks of Tees has now begun. These ranks are now completed, one level at a time until the top of the building is reched as indicated in FIG. 32. As an example of the erection sequence, Tee elements 158*d* and 158*e* are erected above elements 158*a* and 158*b* respectively. Then corresponding elements on the opposite side of the elevator (including one element not shown) and an adjacent element 158*f* are erected. Next Tee elements 158*g* and 158*h* are erected, followed by elements 158*i* and 158*j*.

The time involved in removing the Tees from the forms, lifting and interconnecting the elements in such that an entire level i.e., four Tees may be erected in a single day. Accordingly, to achieve best utilization of time, four separate Tee forms should be provided. The forms may be prepared and the concrete poured one day, and the next morning the forms may be stripped, and the four Tees erected and interconnected. Finally, before work concludes that day, the forms may be cleaned and prepared, and four new Tees poured for erection the next day.

Although not illustrated, it should be appreciated that two Tee forms may be located on each side of the building i.e., to the left and right in FIGS. 19–24. A pair of modified Tee forms may be employed, and may be located behind the crane shown in FIG. 31, or in any other convenient location. One or preferably two cranes are used to lift the Tees and modified Tees out of the respective forms and to position them for attachment to the adjacent elements, with the two cranes moving back and forth from one side of the building to the other as necessary, during erection. Alternatively, it should be understood that four cranes, two on each side of the building may be employed if desired and available.

Still referring to FIG. 22, it should be noted that elevator tower 156 and the hereinafter described rank of hallways 160*a*–160*d* cause a distortion in the longitudinal symmetry of the building. To accommodate this, the outline of the Tee elements may be varied as necessary. Thus, Tee elements 158*g* and its vertically aligned counterparts are somewhat shorter than Tee elements 158*i* and 158*j* and their vertically aligned counterparts are somewhat shorter than Tee elements 158*i* and 158*j* and their vertically aligned counterparts. Also, to accommodate the fact that the rank of hallways will be erected in alignment with the stems of elevator lobby modified Tees 153*a'* - *153d'*, Tee element 158*h* and the underlying Tees are cast in a modified configuration with a rectangular cutout 159 which engages with a stem of elevator tower modified Tee 156*a*. These modifications of the Tee elements may readily be accomplished by blocking out portions of the Tee forms when the modified elements are being poured.

Still referring to FIG. 22, concurrently with the erection of the first four ranks of Tees, two additional column lines including 150*m* through 150*t* and the associated beams are poured and appropriately interconnected in preparation to receive the overlying rank of modified Tees forming hallways 160*a* through 160*d*. The flooring 161 is poured on the beam and column array or precast to serve as the floor for the hallway defined by modified Tees 160*a* and 160*a'*.

As soon as the column, beam and floor array underlying the hallways has reached its proper strength, erection of the next two ranks of Tees and the rank of hallways may commence. As will be recalled, four Tee forms are available, two on each side of the building. Preferably, only a single rank on each side of the building is constructed at one time, thus two levels are placed in one day together with the hallways for those levels. Accordingly, with reference to FIG. 23, on one day, the modified Tees 160*a*, 160*a'* forming a first level hallway and modified Tees 160*b*, 160*b'* forming a second level hallway are erected. On the same day, Tee elements 158*k* and 158*L* followed by Tee elements 158*m* and 158*n* are also erected. On the next day, corridors 160*c*, formed by identified Tees 160*c'* and 160*d*, 160*d'* are erected followed by Tee elements 158*o* and 158*p* on the right side of the building and 158*q* and 158*r* on the left side of the building.

As will be understood, the underlying beam and column array and the precast or poured in place flooring for a particular rank of Tees should be completed several days before erection of that rank of Tees to allow the underlying structure to obtain the desired strength. As a practical matter, the substructure for two ranks may be prepared at one time, although it should be recognized that early construction of too large a portion of the substructure may require that the assembly cranes be spaced undesirably far from the point of erection.

Accordingly, additional column lines including columns 150*u*–150*x*, together with the associated beams and flooring should next be prepared. After these have reached about 40% of their ultimate design strength, the associated ranks of Tees may be erected in the manner previously described. The Tees are poured one day, allowed to set overnight, and are stripped from the forms and erected the next day. The erection of an entire rank of four Tees can be accomplished in two days in this manner.

The foregoing procedure continues with the substructure of columns, beams and flooring followed by the ranks of Tees erected vertically two ranks at a time until the end of the building has been reached. To form the exterior end walls for the cells defined by the last rank of Tees, a plurality of modified Tees 162 are provided. The ranks of modified Tees are erected vertically in the same manner as the previously erected ranks of Tees.

Figure 24:
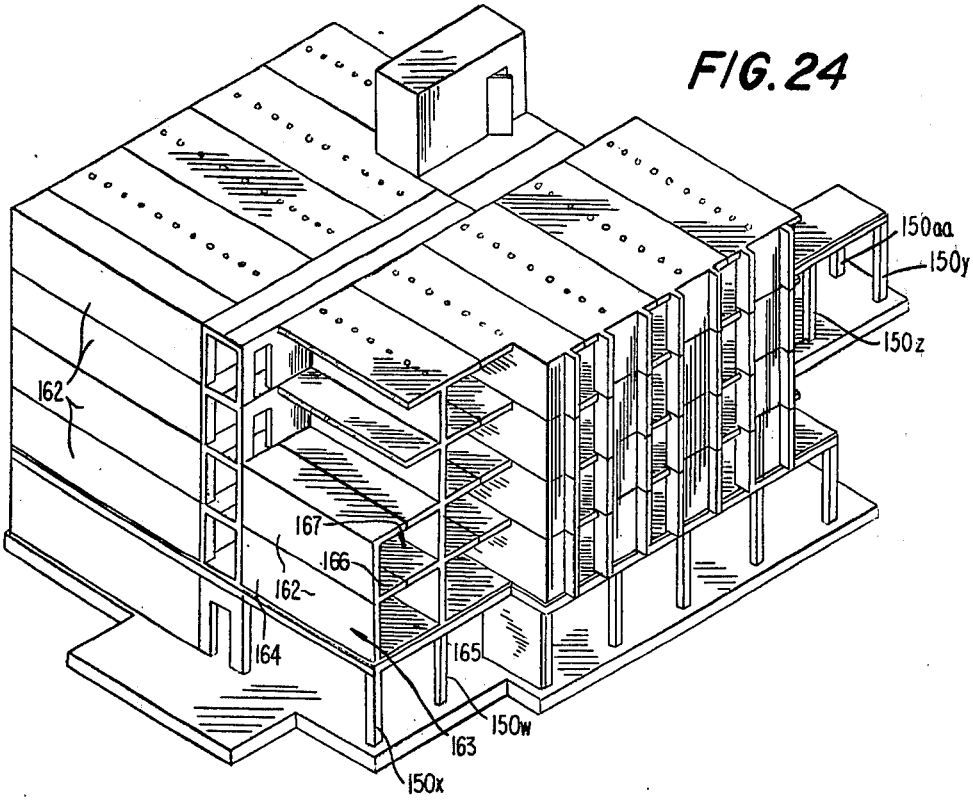

Thus, with further reference to FIG. 24, a vertical leg 164 of modified Tee 162 defines the outer wall of a cell 165 while the horizontal leg 166 provides a common wall and ceiling between cell 165 and an overlying cell 167. The horizontal flanges of the modified Tees are welded to the outwardly extending flanges of the adjacent Tees in the manner previously described for connecting the flanges of adjacent Tees. The inner end edges of the flanges of the modified Tees are also welded to the hallways in the manner previously described for connection of the inner edges of the Tee flanges to the hallways (FIG. 15). The stems of the superposed modified Tees are connected to the underlying members by welded connection in the same manner as the Tee stems are connected to the underlying Tee stems, (FIG. 15).

Upon erection of the rank of modified Tees 162, the entire structure of the left side of the building will have been completed. However, as shown in FIG. 24, the ends of the hallways as well as various portions of the first floor, i.e., below the Tee and Channel construction remain uncompleted. Thus, as illustrated in FIG. 1, a plurality of precast end hallway facades 170 may be provided for closing the hallways at the left hand end of the building. Doorways 172 are preformed in facades 170. A stairway, preferably formed of precast slabs 174 and preformed stairs may be provided along the end of the building. Alternately, the flanges of the modified Tees can be extended lengthwise to provide stairway landings. The stairway may be enclosed, as for example, by a stair tower 175 in a form of a pair of modified Tees positioned on end in the same manner as the elevator tower.

At this point, construction on the opposite side of the building i.e., on the right hand side in FIG. 24 may commence. Prior to this, however, it is preferred to complete the erection and installation of the elevator equipment including the elevator cabs, the elevator equipment floor, and the elevator penthouse. This may be understood from references to FIGS. 23 and 24.

Figure 23:
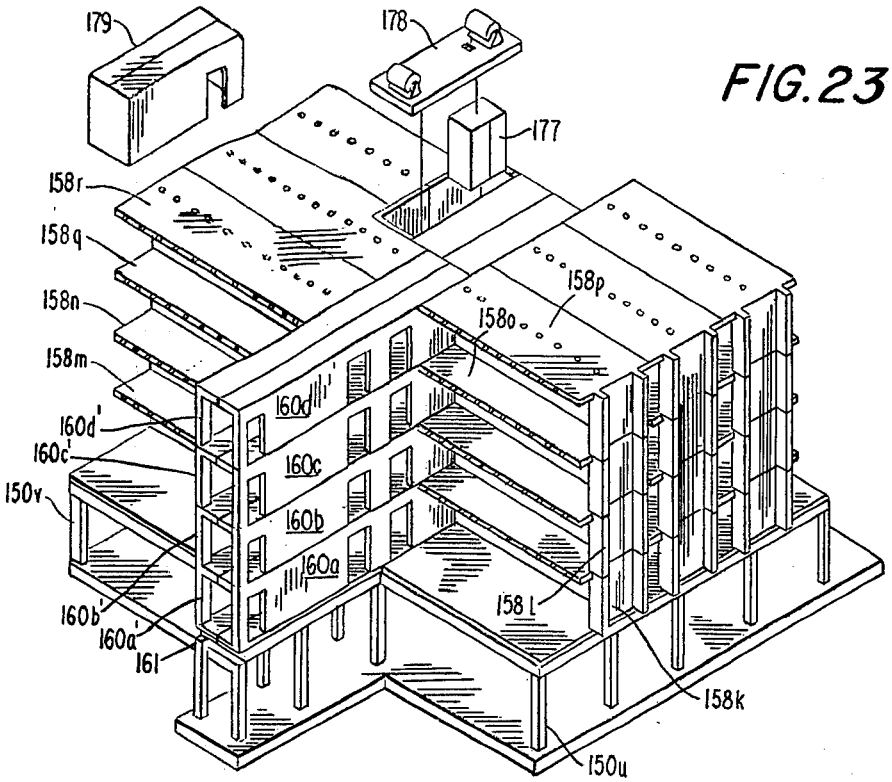

As illustrated in FIG. 23, the elevator assembly comprises at least one elevator cab 177, an elevator equipment floor 178, and an elevator penthouse 179. Elevator equipment floor 178 is a precast slab formed at any convenient time and stored pending use. Elevator penthouse 179 is a rectangular block housing, and is preferably so dimensioned to permit casting in the same forms as are used for casting the modified Tees.

According to the present construction system, the equipment floor 178 and the penthouse 179 are precast on the site while the elevator cab is completely preassembled at the factory. Prior to commencement of work on the second half of the building, a crane is brought around to the unfinished side of the building and the completely preassembled elevator cab is lifted into place and deposited in elevator pit E.P. at the bottom of elevator tower 156. Since the structure of the elevator tower was completely substantially prior to this time, sufficient time exists for the elevator assembly men to have installed the elevator guide rails whereby the installation of the elevator operaint equipment may commence while the building is only half completed.

The elevator hoisting motors, etc, are preassembled on equipment floor 178. As soon as elevator cab 177 is in place, equipment floor 178 is also lifted into place and the hoisting equipment connected to the elevator cab. Then, elevator penthouse 179 may be lifted into place and secured in any suitable fashion at the top of elevator shaft 156 thereby completing the elevator assembly.

Several advantages accrue from initial construction of the elevator core in the manner contemplated by the present invention. According to customary construction practices, the elevator tower is usually the last item completed, and elevator assembly is done from the inside of the building after erection. Since the elevator is usually located at the center of the building, reaching the same by means of cranes located on the gound is most often impossible. Accordingly, the elevator mechanism is brought to the construction site completely disassembled and the entire assembly procedure takes place in the elevator pit area.

Such an arrangement presents several obvious disadvantages, including inconvenience in working, and scheduling of delivery and installation. The present construction, on the other hand, allows complete factory preassembly and delivery of the completed elevator structure to the site at an advantageous time for immediate installation. In addition, it allows elevator assembly line before completion of the building, thereby making the same available for use by workers if desired during the intermediate and the final stages of construction.

Following installation of the elevator mechanism and penthouse, construction commences on the uncompleted half of the building. Construction process in the manner described for the first half of the building with one rank of Tees on each side of the elevator being constructed vertically to the full height of the building before the next rank of Tees is commenced. A pair of columns lines including columns 150*y*, 150*z*, and 150*aa*, (FIG. 24) together with the associated beams and slabs are pre-erected and allowed to set for a sufficient time to achieve the desired percentage of design strength and a rank of hallways corresponding to and longitudinally aligned with hallways formed by modified Tees 160*a*–160*d* and 160*a'*–160*d'* are erected, the hallway on a particular level preceding the Tees corresponding to the opposed rank on that level. Likewise column lines including columns 150*bb* and 160*cc* (see FIG. 1) along with the beam and floor structure is prepared to receive the ranks of Tees on the right side of the building.

Then the ranks of Tees and the rank of hallways proceeds as described for the left side of the building, and the ranks of Tees on opposite sides of the building with the vertical erection of the succeeding opposed ranks until the desired longitudinal extent of the building has been reached. Finally, modified Tees identical to elements 162 are erected and secured at the end of the building to provide the end walls for the last rank of cells. End facades, such as 170 (See FIG. 1) are provided at the end of the second half of the building and a stairway and stair tower similar to that at the left hand end of the building is then erected. This completes the entire structural assembly of the building.

While it will be appreciated that the specific erection procedure described may be subject to some variation without substantial departure from the concepts hereof, it should be recognized that the basic approach, i.e., vertical erection outwardly from a central elevator core possesses several distinct advantages. By this method, it is possible to erect the entire first half of the building and turn the same over to the finishing trades (and even to occupancy) during erection of the second half of the building. Actually, the carpenters, electricians, and painters may begin their work as soon as the first two pair of laterally adjacent ranks of Tees have been erected. In this way, the work of the finishing trades follows immediately behind the work of the erection trades thereby facilitating completion of the entire building very rapidly after the basic structural components have been erected. Likewise, as explained above, the elevator core comprising the tower and elevator lobbies may be quickly turned over to the elevator assembly trades so that the installation of the elevators may be rapidly completed. Moreover, it will be appreciated that the concrete construction of the Tees as described in my copending application Ser. No. 807,217 or the cored Tee construction described herein can be utilized in the foregoing building erection procedure depending upon the required height of the building and width of the bays or cells. For example, where enlarged cells or bays or a tall building is required, the cored construction can be utilized thereby saving in concrete materials as well as minimizing the dead weight of the building.

It is a particular feature of the present invention that the cored Tee construction readily adapts the structure to post-tensioning techniques, vertically and/or horizontally. Particularly, and referring now to FIGS. 25–26 there is illustrated a plurality of superposed Tees forming a rank or tier thereof as previously described with respect to the erection of the building illustrated in FIG. 1. In accordance with the present invention, the Tees may be post-tensioned vertically. To accomplish this, anchor plates 201 (FIG. 26) are integrally cast in the floor beams at predetermined points therealong in alinement with the stems of the Tees to be superposed thereon. A plurality of rods 203 may then be threaded into threaded openings 205 in the anchor plates to upstand from the beams a height slightly greater than the height of the Tee to be set on the beam. The first level Tee may then be disposed on shims, not shown, on the beam to space the Tee from the beam with the rods being received within voids VV. Alternatively, the Tee can first be disposed on the beam with the rods inserted downwardly through the voids and threaded from about the Tees into the threaded openings of the anchor. To post-tension the Tee, bearing plates 207 are disposed over the rods and nuts 209 are threaded over the upper threaded ends of the rods. Suitable jacking apparatus not shown, is then applied to the rods. After the appropriate tension is applied, the nuts 209 are tightened down against the bearing plates leaving the rods in a stressed condition.

To post-tension that next level Tee, a plurality of rods can then be threaded into the upper ends of nuts 209 to upstand from the first Tee. The second Tee is then disposed on shims, not shown, spaced along the first Tee with the rods being received in the voids thereof. Alternatively, the second Tee can be disposed over the first with the rods being inserted through the voids from above the second Tee for threaded engagement at their lower ends with nuts 209. A similar post-tensioning procedure as previously described is applied with respect to the second Tee. Subsequent Tees are likewise post-tensioned with the result that the vertical rank of Tees is post-tensioned throughout its height. Alternatively, the post-tensioning can be accomplished after the entire rank of Tees is erected as access to the upper and lower edges of each Tee stem is available by the spacing of the stems one from the other by the shims. Grout is applied as at 211 in the spaces between the Tees to provide substantial uniform loading. It will be appreciated that the Tees when post-tensioned vertically need not be welded one to the other and that the post-tensioning rods can provide the sole connection between the vertical ranks of Tees.

Preferably, vertical post-tensioning is provided at the ends of the Tees at the sides of the buildings and need not be provided interiorally of the building.

Referring now to FIGS. 27 and **28*k*, the Tee construction can be post-tensioned in a horizontal direction by utilizing the horizontally extending cores or voids HV extending transversely through the flanges of the Tees and modified Tees. Specifically, the cores of the horizontally adjacent Tees are alined one with the other and anchor plates, not shown, are provided along the outer edge of the Tee over selected voids. Post-tensioning rods 212 are provided through the cores and threaded to the anchor plates. Bearing plates 213 are disposed along the edge of the modified Tee flange. A nut 215 is threaded about the end of the post-tensioning rod and the rod is tensioned by a jack, not shown, with the nut being threaded down against bearing plate 213 whereby the flange is maintained under stress. When the next horizontally adjacent Tee is disposed in alinement with the post-tensioned Tee in accordance with the building procedure previously described, post-tensioning rods 217 are passed through the cores of next adjacent Tee and bearing plates 216, the rods being threaded to nuts 215. Similarly, the other ends of post-tensioning rods 217** are provided with nuts and bearing plates and the rods are post-tensioned as previously described. Likewise, next adjacent Tees and ultimately the modified Tees are post-tensioned with the result that the entire building structure is post-tensioned in a horizontal direction. It will be appreciated that the horizontal post-tensioning can be effected on both sides of Tees intermediate the building ends as the building is butted toward opposite ends as previously described. Alternatively, the horizontal post-tensioning can be effected when all the Tees are in place. This horizontal post-tensioning is preferrably effected along the outside of the building. It will be appreciated that the space between the edges of the adjacent flanges and about the nuts are filled with grout. Thus, the all Tee and modified Tee buildings can be post-tensioned either in the vertical direction or in a horizontal direction or both as desired. This can be effected rather simply as previously described during the erection process or effected as each vertical rank of Tees or horizontal extent of Tees is constructed.

Referring now to FIG. 29, the Tees can be post-tensioned along their length. Particularly, a post-tensioning cable or rod 221 can be disposed in the stem of the Tee extending diagonally from the lower edge at one end of the Tee. The post-tensioning can be accomplished while the Tee remains in the form. Likewise, the flanges of the modified Tees can be post-tensioned in the transverse direction by providing a post-tensioning cables or rods 223 in their form and applying a post-tensioning apparatus. The ends of the post-tensioning rods in the Tees can then be connected with the ends of the post-tensioning rods in the modified Tees to form a unitary structure extending lengthwise of the Tees and transversely of the modified Tees. For example, the Tees on opposite sides of a pair of modified Tees forming a hallway can be, in effect, post-tensioned one to the other by the foregoing described post-tensioning cables or rods, when the latter are interconnected one to the other as illustrated.

While the foregoing constitutes the detailed description of the components employed in the industrialized building system of this invention, and the method of utilization thereof, it should be understood that the flexibility of this system is such as to permit wide and substantial variation in the type of buildings which may be constructed and in the internal arrangement of the buildings.

Thus, to provide an enlarged cell, for example, a party room or large apartment, whether utilizing the cored construction or the standard construction of the Tees as described in my copending application, Ser. No. 807,217, a Tee element may be omitted and replaced by a poured in place slab 178 as illustrated in FIG. 1. The slab extends between the flange of the Tee, and the flange of an adjacent Tee or a modified Tee 6. Slab 178 is preferably post-tensioned in accordance with customary post-tensioning practice. In this manner, a cell having two or more times the width of the cells formed by adjacent ranks of Tees may be provided. In addition, the alternating Tee and slab arrangement may be continued through a larger portion of the building, as illustrated in FIGS. **30*a* and 30*b***. However, an arrangement in which thestem of Tee element rests on a slab should be avoided.

With furtherd reference to FIG. 1, the ranks of Tees at the right hand end of the building are not provided with facades. The cells so formed may be provided with partition walls inset from the edge of the building to form private balconies. Likewise, it should be understood that internal partitions may also be provided. This may be by use of conventional stud and wall board construction, plastering, or in any other desired fashion. Doorways may be precast in the stem of a Tee to provide a cell having the stem as a central dividing wall. Passages through the flanges of a Tee may also be provided whereby stairways can be installed to form a cell having two or more levels.

Electrical conduits, outlets and fixtures may be precast in the Tees and modified Tees as previously noted. Also, it is a significant feature hereof that heating, ventilating and air conditioning ducts may also be precast in the Tees and modified Tees. Further, the voids HV and VV may be utilized to provide conduits for heating ventilating and air conditioning ducts as well as electrical conduits as necessary. In FIG. 31, heating and ventilating ducts are illustrated utilizing the voids or cores in the Tees and modified Tees.

The vertically extending voids VV in both the full Tees and modified Tees when utilized lie in alinement one with the other and provide passages extending the height of the building. Passages indicated 180 can be precast in the full modified Tee in communication with the voids VV, the passages 180 opening through the stems of the full Tees and modified Tees into the cells or bays or hallways formed thereby. The opening into the cells or bays or hallways may be provided anywhere along the height of the wall forming a specified cell bay or hallway and, in the illustrated form, provide ducts communicating with such cells, bays or hallways adjacent the corresponding ceilings. Also, voids can be formed in the facade panels F which, when the Tees are superposed one over the other, lie in communication each with the other forming ducts along opposite sides of the building structure. Openings can be formed through the facades in communication with the voids to provide heating ventilating and air conditioning ducts for a particular cell or bay. Obviously, a ducting arrangement such as shown in my copending application Ser. No. 807,217 may also be employed with the construction hereof.

As an example of the flexibility in design offered in the present Tee construction, there is illustrated in FIGS. 32–34 another construction comprises of a plurality of Tees and modified Tees. In the building of FIGS. 32–34, a plurality of Tees are superposed to form a plurality of adjacent ranks of Tees as in the previous building construction. This provides a plurality of superposed and laterally adjacent cells. As before, the stems of the Tees define the oppositely disposed side walls for the cells. A hallway may be formed along one end of the cell structure on each level of Tees by forming a doorway through the stems adjacent to that end on each level as indicated at 280 in FIGS. 32 and 33. Partition walls 282 at the inner edges of the doorways 280 between the stems of adjacent Tees separate the cells from the hallways. Facade panels 283, connected by glass panels 285 provide the outer side of the hallway.

Alternately, hallways or open walkways may be formed by casting facades inset from the ends of the Tee flanges as described in connection with FIG. 35 below. The hallways and cells thus formed in either embodiment by the opposed flanges of the Tees provide ceilings for both the hallway and cells on one level while the same flanges provide the floors for the hallway and the cells on the next level.

As noted above end facades 283 may form portions of the outer wall comprising the hallways and the spaces between the facades may form windows 285. Alternately, the end facades may extend the full width of the Tees whereby a solid wall is provided. Correspondingly, by complete omission of the end facade, a hallway open on one side is provided. A suitable balcony railing may then be provided.

The ends of the stems at the opposite side of the building may be inset as at 286 to provide a common walkway along the opposite side of the building. Alternately, the stems may extend the full distance to the building edge. In that case partition walls, indicated at 288, may be located between adjacent stems inset from their ends to provide balconies as in the previously described embodidment. The ends of this building may be closed by the modified Tees previously described.

In the illustrated form, however, and particularly referring to FIG. 34, a a pair of modified Tees 290 and 292 are disposed in lateral juxtaposition on each level of the building. The horizontal flange 299 of the inner member 290 is connected, e.g., by welding or concrete jointery to the outstanding flange 296 of the end Tee 298 and the stem of member 290 is connected to the underlying inner member 290 whereby the inner members 290 form superposed side walls 300 of the room adjacent the end of the building.

The outer modified Tee 292 is connected to the inner member 290 at the end of its horizontal flange 302 and to the underlying outer member 292 to form a plurality of superposed hallways 304 along the end of the building. A pair of enlarged modified Tees set on their ends with their flanges secured one to the other in a common plane as previously described with respect to the tower disclosed in FIG. 1 hereof and with the open face of the composite channel thus formed lying adjacent the stems of the outer modified Tees, is provided to form an elevator tower T adjacent one end of the building. Suitable doors 306 are formed in the stems 308 of the outer members 292 at each level for communication with elevator cabs in the tower T. Preformed stairways 310 are also provided by forming openings through the flanges of the outer modified Tees 292 forming the end hallway. A similar elevator Tower T' and stairway arrangement (not shown) may be provided at the opposite end of the building.

Further alternatives for an all-Tee arrangement are illustrated in FIG. 35. Here, the building is constructed of two ranks including Tees 320 and 322, positioned longitudinally i.e., end to end. Preferrably, a relatively narrow clearance 324 is left between the ends 326 and 328 of adjacent Tees. This space extends vertically over the entire building and serves as a plumbing chase for adjoining plumbing walls 330 and 332. Alternatively, cutouts in the flanges and stems may be provided whereby the adjacent rank of Tees may actually be abutting.

Corridors or open walkways are provided on opposite ends of the building. Thus, as shown, on the left in FIG. 35, inset facades 334 provides end walls for the cells while cantilevered balconies are formed by the cantilivered overhang 336. Alternatively, as shown on the right side of FIG. 35, a closed hallway is provided by a rank of modified Tees 338. Elevators and/or stairways are provided as necessary, similarly as previously described.

FIGS. 36–38 show another form of all-Tee construction, especially useful for buildings requiring relatively large cells, such as schools. In FIGS. 40 and 41, the building 346 comprises two ranks of cells 348 and 350 separated by a longitudinal rank of corridors 352. Rank 348 is formed of two ranks of opposed Tees 354 and 356, separated by a slab 358, while correspondingly, rank 350 is comprised of two ranks of Tees 360 and 362 separated by a slab 364. The central longitudinal rank of corridors 352 is formed by opposed ranks of Tees 356 and 360.

As best illustrated in FIG. 37, Tees 354 and 362 differ substantially from the T-shaped elements previously described in that the flanges are of substantially different width. Thus, for Tees 354 right hand flanges 366 are substantially wider than left hand flanges 368. In fact, flanges 368 serve primarily as overhangs and/or walkways rather than as part of the internal cellular structure of the buildings. Correspondingly, on the opposite end of the building, left hand flanges 370 and Tees 362 are substantially greater in width than right hand flanges 372. For Tees 356 and 360, the flanges are shown to be of generally equal length; however, it should be understood that opposed inner flanges 374 may be made narrower than outer flanges 375 to produce corridors 352 of the desired width.

With reference still to FIGS. 36 and 37, the corresponding stems 376 of Tees 356 and 360 provide the inner walls for the ranks of cells 348 and 350. The outer walls of the cells in rank 348 are provided by stems 378 of Tees 354 while the outer walls of the cells in ranks 350 are provided by stems 380 of Tees 362. Doorways and/or windows may be provided in the respective stems 376, 378 and 380 to provide access between the cells and hallways and the overhanging walkways as necessary or desired.

Previously described techniques for interconnection of the building elements may be used in the case of the building 346. Thus, the interconnections between Tees 356 and 360 may be in the manner described in connection with FIGS. 12*a* or 13. The vertical interconnections between the Tees may be made in the manner described in connection with FIGS. 10 and 11. For elongated slabs 358 and 364, however, it is preferred that a composite poured in place post-tensioned construction be employed because of the large width of the slab. FIG. 38 shows schematically the manner in which this can be accomplished.

Here a portion of Tee 362 is sown including the ends of flanges 370 and 372. Slab 364 as shown in outline is to be poured in adjoining relationship with wide flange 370. Tee element 362 is formed with a plurality of elongated post stressing tendons 390 extending transversely through both flanges 370 and 372 and protruding outwardly into the area to be occupied by slab 364. Tendon 390 comprises a steel cable 392 similar to the post-tensioning cable previously described, and a plastic sheath 394 surrounding cable 392 at least over its entire length within Tee flanges 370 and 372. As shown at least a portion of cable 392 protrudes from sheath 394 in the region to be occupied by slab 364. A suitable tensioning jack indicated schematically at 396 is attached to the end of cable 392 beyond the outer end of right hand flange 372. A similar post-tensioning tendon 398 having a cable 400 and a sheath 402 extends in the opposite direction through slab 364 from right hand flange 375 of Tee 360.

To form slab 364, a suitable form is erected, and additional reinforcing welded wire fabric, (wire mesh) electrical conduit, or other items to be cast integrally with the slab are mounted in the form. The, concrete of the appropriate formulation is poured and allowed to set to approximately 40% of its ultimate design strength. At that point, the exposed ends of post-tensioning tendons 390 and 398 are substantially bonded to the poured in place concrete. The tendons are then stressed, which places the concrete in slab 364 in transverse compression. After the concrete has completely set, the tension on tendons 390 and 398 may be released. As will be appreciated the post stressing force on tendons 390 and 398 may be applied from beyond Tee flanges 372 and 374 respectively since the plastic sheath 394 surrounding cable 392, and the corresponding sheath 402 surrounding cable 400 permits stressing the tendons and the slab without resistance in the flanges of the respective Tees 360 and 362. Also, tendons 390 and 398 may be disposed within the voids HV formed in the flanges of the Tees when that type of Tee construction is utilized thereby obliviating the use of the sheaths about the tendons.

Building 346 may be constructed substantially in the order previously described in connection with FIGS. 19 through 24 or, when constructed of Tees and modified Tees having the voids or cores, the Tees and modified Tees of building 346 may be vertically or horizontally post-tensioned as previously described with respect to FIGS. 25–29. Thus, all of the advantages of vertical erection of an entire tier before proceeding to the next tier are still retained, although, it wil be appreciated in the present case, that erection proceeds longitudinally of the building rather than transversely. Since the Tee elements are longitudinally aligned, transversely extending walls may be erected at any desired point to determined the length of the individual cells.

As an alternative to the interconnection technique illustrated in FIG. 37, slabs 358 and 364 may be cast of an expansive concrete. Post-tensioning cables anchored in the adjoining stems extend into the poured slabs and are held there by bond of the concrete. As the latter expands during setting, the embedded cable is tensioned whereby adequate strength is imparted to the slab.

As yet further examples of the design flexibility afforded by use of the Tee construction described herein, a circular building as illustrated in FIGS. 40 and 41. Here, a plurality of Tees extend radially from a central building core formed of modified Tees. Particularly, the hub of the building may comprise a polygonal or round arrangement of a plurality of composite Channel shaped members 418 (each formed of a pair of modified Tees as previously described) disposed in end to end relation to form the sides of the polygon. The ends of the composite channel forming modified Tees are formed at an oblique angle as indicted at 420. This is accomplished by blocking off the flanges and stems of the modified Tees at the desired oblique angle when the same are to be case. When the modified Tees are connected together to form the composite channels and the latter are disposed in end to end relation such that the obliquely formed ends of adjoining composite channels are in registry, a hallway having a corner or a turn is formed. When a plurality of composite channels having obliquely formed ends are arranged in end to end relationship, a complete polygonally arranged hallway may be formed. In the illustrated form a plurality of like composite channels having identical obliquely formed ends are superposed and connected, for example, by welded connections to form a central building core or hub.

The modified Tees forming the composite channels which, in turn, form the hallways are arranged to provide a complete polygon with the hallways fully circumscribing an open courtyard, enclosed, if desired by a plastic dome or the like. In that case, the hallways may be constructed to provide a common internal balcony open to the courtyard. This is accomplished by substituting a single modified Tee for each composite channel 418 and disposing the stem of the modified Tee outwardly of its flange. A balcony railing of any suitable type is attached to the flange of the modified Tee to complete the balcony.

Precast or poured in place floow slabs 422 are provided at each level within the building core to provide a plurality of superposed central lobbies as illustrated in FIGS. 40 and 41. Also, stairways 424 are provided to connect the superposed lobbies.

For tall multi-story buildings, and enlarged composite channel formed as previously described of a pair of modified Tees is disposed on its end to form an elevaotr tower T. The tower T in FIGS. 40 and 41 forms a portion of the polygonally shaped building core, i.e., it interrupts the hallways formed by the angularly related superposed composite channels 418 with the stems 426 of the tower forming walls at opposite ends of the hallway at each level. In this form, the elevator tower T opens onto the lobbies 422 at the various levels and doorways 428 are formed through the stems of the inner modified Tees 418 to provide access from the elevator lobbies to the hallways. Geometric continuity is provided by wedge shaped members 432 suitably cast, as for example, in the Tee form with one of the flanges of the form blocked off completely, and with the other flange blocked off to provide the angle edges thereof indicated at 434.

To form cells extending radially from and about the building core described above, a plurality of Tees are superposed to form a plurality of ranks with the cells being defined between the oppositely disposed stems and superposed between the flanges of the Tees as before. However, in the illustrated form, the lateral edges of the Tees are angled outwardly from their inner ends as indicated at 436 to form in plan view, truncated pie shaped sextors, i.e., Tees having a longitudinally varying cross section. This is accomplished when the Tee sectors are cast, as by blocking off the edges of the flanges at the desired angles.

The inner end edges of the Tees are preformed for compatibility with the composite channels forming the central building core by similarly blocking off portions of the form in which the Tee sectors are cast. For example, the inner edges of the Tee flanges, indicated at 438, form a shallow outline for compatibility with the angled juncture between adjacent composite channels 418 forming the hallways. The inner edges of the Tee flanges which lie wholly adjacent the stems of the outer modified Tees forming the composite channels are formed in the usual fashion, i.e., at right angles to the stems. The outer end edges 440 of the Tee flanges may be arcuate as illustrated by arcuately blocking off the end of the Tee form when the Tees are cast. These outer edges may be straight, as in the previous forms, whereby a polygonally shaped building in plan view would result.

Various other designs may also be provided. For example, inwardly arcuate end edges may be formed to afford a scalloped effect in plan view. Likewise, the end facades 441 may be eliminated entirely and inset partition walls provided whereby private or continuous balconies are formed. Alternately, the end facades may be arcuate in shape to conform to the circular building, or may be offset from their associated stems, or may take various other configurations as desired in a particular building design. Doorways 442 as formed in the outer stems of the modified Tees forming composite channels 418 at each level for access between the rooms and hallways.

The circular or polygonally shaped building is constructed similarly to the buildings disclosed in the previous embodiments. The columns comprising the building foundation are arranged to provide a pair of concentric polygonal shaped column lines which extend below and provide support for the inverted polygonally arranged composite channels. At subsequent states of construction, the columns are fadially spaced about the building core to form radially extending column lines to support the truncated Tees. The column lines are provided with overlying beams and precast slabs also as in the previous embodiments. Preferably, the modified Tees are superposed on the foundation columns and connected one to the other at each level to form superposed hallways. The modified Tees forming Tower T are then set on their ends over a previously prepared elevator pit and connected one to the other. The rank of Tees extending from the back of the elevator tower as well as the wedge members 432 are then erected. The ranks on opposite sides of this first rank of Tees may then likewise be erected.

Additional modified Tees are then superposed on the foundation columns and beams to form additional composite channels and then one over the other and connected in angled endwise relation to the composite channels already erected. Additional ranks of Tees are then erected to extend radially from these composite channels. In this manner, the cells formed by the adjacent ranks of Tees erected during initial stages of construction are finished off as additional ranks of Tees are being formed and erected. To complete the construction, the composite channels are vertically erected to complete the inner core of the building. The ranks of Tees are then erected about the building coming full circle to complete the latter. Obviously, where large bays or cells are required or when the building is particularly tall, the Tee and modified Tee construction having the voids or cores may be utilized in conjunction with the post-tensioning techniques illustrated in FIGS. 25–29.

FIG. 39 shows a variant of the circular building shown in FIGS. 40 and 41. This building, denoted generally by 450 is curved, but the radius of curvature is much larger and the curve is not closed whereby a wide arcuate configuration is achieved.

Building 450 is formed of a series of ranks of laterally adjacent Tees 452 having truncated pie shaped flanges 454 as in the case of the building of FIG. 43. However, the angular relationship between the opposite longitudinal edges of the flanges is much smaller, i.e., the flange edges are much more nearly parallel. This has the effect of producing a much larger radius of curvature and consequently, the desired arcuate configuration.

The building construction is virtually identical to that previously described. Thus, front and rear corridors 456 and 458 are formed in any of the various ways previously described, for example, by inset facade panels and associated overhanging flanges, by composite channel shaped members formed by a pair of modified Tees, or by modified Tees provided with balcony railings. Continuous or private balconies may be provided. A central radial corridor 458 is also provided. This is formed by two opposed relatively narrow flanges as in the case of the school building of FIGS. 36 through 38 or by a composite channel shaped member or abutting modified Tees as in the previous embodiments. A centrally located elevator tower 462 may be provided by a pair of modified Tees erected on their ends and connected one to the other. Towers 464 and 466 disposed at the ends of the building to serve as elevator and/or stair towers are similarly constructed. As with the circular building of FIG. 40–41, the Tees and modified Tees can be formed with the horizontal and vertical voids and post-tensioning techniques applied.

In the illustrated form the Tee is precast of concrete material in forms provided at the construction site. It has been found that a 20 story building can be erected utilizing Tees having four inch width stems and flanges. To provide Tees constructed of concrete material with stems and flanges only 4 inches in width, and having the requisite strength, and characteristics essential to their utilization in a multi-level building reinforcing bars in the form of a pair of frameworks are provided in the Tee stem. Particularly, and referring to FIGS. 42–45 each framework 441 and 443 comprises a plurality of vertically extending reinforcing bars 445 located preferably on 12 inch centers. In a preferred form, and for use in a stem eight feet three inches in height, five horizontally extending reinforcing bars 447 are interconnected with the longitudinally spaced vertically extending bars disposed in each framework 441 and 443. Preferably, the horizontally extending bars 447 are located upwardly along the stem at respective distances from the lower edge of the stem, as illustrated in FIG. 44, 5¾ inches, 25¾ inches, 50¼ inches, 75½ inches, and 97½ inches. When located in the forms, the frameworks 441 and 443 are spaced one from the other and from the sides 449 of the form by a plurality of locator pins 451 extending transversely between opposite sides of the form. The pins are suitably secured to the frameworks. For a four inch thick stem, the frameworks lie ¾ inch from the corresponding sides of the form. It will be appreciated that where four inch wall thicknesses in both the stems and flanges of the Tees are utilized, the stems and flanges are not provided with the cores or voids described previously. However, where stems and flanges are utilized, for example, on the order of 8 inches thick, the cores or voids would be utilized, the cores or voids extending between the framework of reinforcing bars. Also note that, with the foregoing formed reinforcing bars, and their particular location within the stem, i.e., the height of the horizontal bars above the lower edge of the stem, the stem is particularly well suited for the formation of doorways therethrough as only three of the horizontally extending reinforcing rods and two of the vertically extending rods in each framework need be cut to form any one standard sized doorway.

For reinforcing the flanges, horizontally extending wire mesh 453 is disposed in the forms coextensive with the flanges of the Tee and reinforcing rods 455 extend through the flanges from one edge to the other. Along the opposed edges there is provided a plurality of longitudinally spaced brackets 457 which are welded to the ends of the reinforcing rods 455. When the Tees are disposed in side by side relation as previously described, suitable brackets, not shown, are welded between the laterally registering brackets 457 to connect adjacent Tees one to the other.

Various decorative and functional design configurations can be provided along the sides of the buildings described herein. For example, the sides of the building can be formed with overhangs to form balconies, shaded areas at ground level or intermediate levels, etc. In the form hereof illustrated in FIG. 46, the Tees may be provided with roof overhangs 461 which extend outwardly from the edge of the Tee stems. The roof overhangs can be formed in virtually any desired architectural design with or without the facades as illustrated in FIG. 46. In FIG. 46, there is illustrated an overhang 463 in the form of a dihedral, the apex 465 of the overhang 463 lying coincident with the plane containing the stem 467 of the Tee 469. This particular Tee is individually illustrated in FIG. 47. When adjacent Tees are provided with a similarly formed overhang 463, a longitudinally extending accordion-type roof line or effect is provided along the lower level of the building illustrated in FIG. 46. The Tees 471 forming the second level of the building in FIG. 46 are similarly constructed and also include end facades 473, the dihedral 475 projecting outwardly from the facade. At the next level, a dihedral 477 having a lateral extent equal to the width of the end facade 479 is provided. It will be appreciated that arcuate overhangs either convex or concave or other forms of overhangs can be provided as desired.

Referring now to the upper level of the building construction shown in FIG. 46, it will be noted that the roof line comprises a plurality of laterally spaced peaks between opposite ends of the building. To accomplish this roof formation, the Tees 481 for the upper level are formed such that their flanges 483 extend upwardly at an angle from the associated stems 485. For example, the flanges 483 in FIG. 46 extend upwardly from the stems to form an included angle therewith of about 110°. There is thus formed, not only a peaked roof for external decorous treatment, but also a cathedral type ceiling for the cells formed by the adjacent tees along the upper level of the building. The Tees 481 are readily formed utilizing the same molds as the Tees with right angularly related stems and flanges by disposing elongated wedge shaped mold parts along the upper edge of the mold part forming the stem.

Referring now to FIG. 50, there is illustrated a Tee 480 for use in any one of the building constructions hereof. In this form, there is provided an enlarged opening 482 in the stem 484 intermediate its ends. The upper edge 486 of the opening is spaced back from the lower face of the flanges 488 such that the area of the Tee between the edge 486 of opening 482 acts as a beam. There is thus provided a large open area comprised of adjoining cells substantially uninterrupted by a stem. The building loadings are carried by the end stem sections 490 and these Tees 480 may be utilized where enlarged cells or rooms are required and it will be appreciated that several of such Tees 480 disposed adjacent one another may form halls.

To provide larger rooms or areas having an increased ceiling height, the Tees can be disposed on either precast or poured in place columns whereby the flanges of the Tees forming the ceiling are elevated above the floor an additional height corresponding to the height of the columns. This is illustrated in FIG. 51 wherein a pair of Tees 487 having enlarged openings in their stems 489 (in this case the openings extend through one end of the associated stem) and an intermediated Tee 491 having the lower portion of its stem 493 entirely removed cooperate to form an elongated Tee span having an enlarged opening between adjacent cells, the cells having increased height due to the disposition of the Tee stems 489 on precast or poured in place columns 495. Columns 495 are, in this form, elongated in cross section in the direction of the span of the Tees. It will be appreciated that Tee stems and hence the columns may have a width on the order of 12–16 inches depending upon the building design and loading to be carried. The forms for the Tees are adjustable to provide stems having this width whereby at the ends of the Tee span illustrated in FIG. 51 a column loading is provided by columns 495 and the stems 489 of Tees 487. The Tee span is preferrably longitudinally reinforced by both longitudinal and vertical post-tensioning rods 497 and 499 respectively, the rods 497 extending the length of the Tee span. It will be appreciated that with this form of the invention, it is possible, utilizing Tees elevated on columns and having elongated portions cut out of their stems to form cells of practically any desired height and, through the use of post-tensioning techniques, and additional Tees modified to form in effect a T-shape beam, cells of any desired length whereby gymnasiums, swimming pools, etc. can be provided utilizing the basic Tee construction hereof.

Referring now to FIGS. 52–54 there is illustrated another embodiment of the present invention, particularly useful for institutional construction such as motels. In this form, bathroom modules, generally indicated 500, are precast in the form of generally rectangular units having side walls 502, 504, 506 and 508 and an upper wall 510, the bottom of the enclosure formed by such walls being open. Suitable forms are provided for this purpose at the construction site and each form provides a rectangular bathroom module suitable for the simulaneous installation of a pair of individual bathrooms in back to back relation for adjacent cells. For this purpose, a pair of door bucks 512 and 514 are precast side 508 of the bathroom module 500. As illustrated in FIG. 52, openings 516 are formed through the central portion of upper wall 510 and opening 516, in conjunction with a pair of spaced plumbing walls 518 and 520 installed within the module either immediately after its withdrawal from the form or upon installation of the module in the building, form a vertically extending plumbing chase which may extend the full height of the building when the bathroom modules are finally erected.

When bathroom modules 500 are utilized in the form of the building illustrated in FIG. 52, the building is constructed as previously described with the following exceptions. As the ranks of vertically extending Tees are erected on one or both sides of the hallways, ranks of building modules including the precast rectangular bathroom modules 500 and shortened Tees 522 are also disposed on one or both sides of the hallways. For example, before, after or concurrently with the placement of the first level Tee, a first level bathroom module 500 is disposed in place with its back wall 502 butted directly against the near leg of one of the modified Tees forming the hallway. That is to say, the bathroom module is disposed on the initial beams or slab as the case may be in back-to-back relation with the stem of the modified Tees 524 forming the hallways. Additional bathroom modules are then superposed one on top of the other to form a vertical rank of bathroom modules with the openings 516 in the upper walls thereof in vertical registry each with the other whereby a vertically extending plumbing chase throughout the height of the building is formed.

The rectangular bathroom modules 500 are constructed such that each module extends longitudinally a distance equal to the transverse extent of the Tee flanges between their opposite side edges. To complete the building structure outwardly from the side of the hallway, a plurality of Tees 522 shortened in length by the width of the bathroom module 500 and having end facades as previously described are superposed one over the other in the previously described manner. The inner end edges of the shortened Tees 522 are disposed to butt the side wall 508 of the bathrom modules between doorways 510 and 512. When the adjacent rank of Tees is erected, such Tees 524 extend full length between the external side of the building and the hallways whereby the stems of such next adjacent rank of long Tees 524 and the stems of the short Tees form superposed cells 526, a part of each cell on each level being formed by an end and side wall portion of the corresponding bathroom module. Access to the bathroom in each cell is thus provided by corresponding doorway through side wall 508 of the bathroom module. Likewise, a superposed rank of full-length Tees is erected on the other side of the bathroom modules toward the opposite end of the building and the shortened Tees 522 form with such latter full length Tees a plurality of superposed cells each having a bathroom provided by the other half of the corresponding bathroom module, access thereto being provided by the other doorway through side wall 508 of the bathroom module. It will be appreciated that bathroom modules 500 are thus superposed one over the other alternately along the length of the building on opposite sides of the hallways with each superposed bathroom module providing an individual bathroom for each of the next adjacent cells. It will be further appreciated that the bathroom module and short and long Tee combinations can be useful in the Tee and Channel System described in my copending application, now U.S. Pat. No. 3,894,373.

A further embodiment of a building construction in accordance with the present invention is illustrated in FIGS. 55–59. In this form, the modified Tees forming the composite channels for the hallways or the full channel sections as in the Tee and Channel System disclosed in my copending application, now U.S. Pat. No. 3,894,373, may be completely eliminated with the Tees and the bathroom modules to be described cooperating to form superposed hallways. In this form, bathroom modules 560 having side walls 562, 564, 566 and 568 and an upper wall 570 are precast in a suitable form similarly as previously described but with the addition of a flange 572 extending in coplanar relation with upper wall 570 of bathroom module 560 and to one side thereof. The flange extends a distance approximating one-half the width of a hallway. The upper walls 570 are provided with openings 574 similar as in the previous embodiment and, when the bathroom modules 560 are subdivided by partition walls 576 and 578 (FIG. 57) to form the plumbing chase, form a pair of bathrooms in back-to-back relation for adjacent cells.

To erect a building having central superposed hallways with cells on either side of the hallways, the precast concrete bathroom modules 560 are superposed one over the other the full height of the building. Particularly, a pair of ranks of bathroom modules 560 are erected in spaced side-by-side relation one to the other with the flanges 572 extendng toward one another. The edges of flanges 572 may be secured one to the other similarly as previously described with respect to the connection between the flanges of adjacent Tees. With the foregoing disposition, it will be appreciated that the flanges 572 of the spaced ranks of bathroom modules 560 form short sections 577 of superposed hallways with the flanges 572 forming common floors and ceilings therefor. Also, the near walls 568 of the bathroom modules at each level from the opposite side walls of the hallway sections.

The bathroom modules 560 can be first erected in a central portion of the building with the erection proceeding from the central portion outwardly to opposite ends of the building or alternatively the building can be erected starting at one end and working toward the opposite end. To build outwardly toward the sides of the building from the superposed ranks of bathroom modules, shortened Tees 574 are superposed one over the other on opposite sides of the bathroom modules to extend therefrom outwardly towards the building sides. The shortened Tees 547 are provided with facades 576.

To form cells at each building level with the shortened Tees 574 and bathroom modules 560, a pair of ranks of elongated Tees 580 are erected on one side of the shortened Tees and bathroom modules, the ranks of long Tees being disposed endwise relative to one another. Each Tee 580 in these ranks is, however, provided with a flange 582 extanding lengthwise beyond the inner end edge 584 of its stem 586 similarly as the flanges 572 of the bathroom modules extend beyond side walls 568. Thus, when the long Tees 580 are superposed one over the other and in end-to-end relation one with the other with the end edges of the flanges 582 in juxtaposition, the stems 586 of long Tees 580 form with the corresponding stems 588 of the short Tees 574 and parts of the walls of the bathroom modules on each side of the building a plurality of superposed cells. Also, the contiguous end flanges 582 of the long Tees 580 may be connected one to the other similarly as the lateral edges of the Tee flanges are connected one to the other to form common ceilings and floors of hallway sections 590 superposed one over the other. Such latter superposed hallway sections also form continuations of the hallway sections formed by the flanges of bathroom modules 560. Likewise, a pair of ranks of long Tees 580 may be superposed one over the other and in end to end relation on the other side of bathroom modules 560 to form with the bathroom modules and short Tees a plurality of superposed cells on opposite sides of the building. The flanges of the long Tees 580 are connected one to the other and form superposed continuations of the hallway sections 577 previously formed by the flanges of bathroom modules 560 and the flanges of elongated Tees 580 on the other side of the bathroom modules. The two bathroom modules on each level in the central portion of the building thus provide individual bathrooms for four cells while simultaneously forming ceiling and side wall portions of the central hallway through the building. Interior partition walls 592 (FIG. 57) may be provided to close the interior ends of long Tees 580, the partitions 592 forming common walls between the hallways and cells. To build towards the end of the building, a plurality of bathroom modules 560 are superposed one over the other in back-to-back relation with their flanges 572 joining one another to form a pair of laterally spaced ranks of bathroom modules adjacent the inner ends of the long Tees 580. Short Tees are superposed one over the other as previously described and extend toward opposite sides of the building to form cells with long Tees 580. The next construction step provides for the erection of the long Tees 580 in a vertical rank adjacent the short Tees 574 whereby an additional four cells on each level are provided with each cell having an individual bathroom, the latter forming one-half of a bathroom module 560. The flanges 572 of the bathroom modules and the flanges 582 of the long Tees 580 provide additional hallway sections 590 at each level. It will be appreciated that the ends of the buildings can be closed by the superposition of a rank of modified Tees as previously described with the modified Tees disposed in endwise relation to one another and butting one another medially of the width of the hallways.

Referring now to FIG. 60, there is illustrated still another form of building constructed in accordance with the present invention. In lieu of the slab and beam construction illustrated as part of the building shown in FIG. 1 hereof, the building illustrated in FIG. 60 employs a plurality of tees formed substantially as shown in FIG. 50 to form the lower level of the building. Particularly, the Tees 600 comprise an elongated Tee having flanges 602 and a stem 604 which is provided with an opening 606 intermediate the ends of the stems and which opening extends for the major portion of the length of Tee 600. The step 604 has an enlarged thickness in view of its disposition forming the lower level of the building. The portion of the stem and flanges intermediate the ends of the stems serves as a T-shaped beam. Thus a plurality of Tees 600 are disposed in side-by-side relation and form a substantially open enlarged area at the lower level of the building. The Tee stems, in effect, provide the column loading support for the building and can be formed to increased heights as desired. The ends of the lower level of the building can be closed off by utilizing the modified Tees as previously described and indicated at 608 in FIG. 60.

In this form of building, the heights of the cells defined by the adjacent Tees vary from level to level. For example, by utilizing Tees having an increased stem height, i.e., the Tees indicated generally at 610 in FIGS. 60 and 61, it is possible to form a cell having a height greater than the standard 8 foot room height. A cell height of 10 or 12 feet or more may be provided as desired. Accordingly, the stem 612 of Tee 610 may extend in height 10 or 12 feet or any height as desired and this increased height is indicated at A in FIG. 61.

For reasons to be described, the flanges 614 of Tee 610 extends at one end beyond the end edge of the stem 612 to form an overhang or projecting end flange 616. The next level building construction may be formed by utilizing Tees of a standard height, for example 8 feet, disposed adjacent one another in superposed relation over Tees 610. The Tees generally indicated 618 on the second level may therefore have stems 620 of a standard 8 foot height, and, when superposed over Tees 610 the flanges 614 form the common floor and ceiling between superposed cells, i.e., cells 624 and 626. Suitable openings may be provided through the flanges 614 of Tees 610 to provide access between super adjacent cells 624 and 626 respectively. In this manner, there is provided a pair of superposed cells of different heights.

In the building form illustrated in FIG. 60, the Tees 618 are coextensive in length with the flanges 614 of Tee 610 such that, when Tees 618 are superposed over Tees 610, the end flange portion 616 of Tee 610 form a ceiling for a hallway 622 as well as the floor for a portion of cells 626 formed by the super adjacent Tee 618. When the Tees 610 forming the cells for a particular level are disposed in end to end relation and in side by side juxtaposition to form end to end cells as illustrated, it will be appreciated that the end flanges 616 of Tee 610 abut one another to form the ceiling for a hallway 622. As cell 624 and 626 form a particular unit in the building illustrated in FIG. 60, there is no need for an entrance hallway on the level of cells formed by the Tees 618 and, accordingly, a hallway 622 is provided at every other level. The hallway floors comprise end portions of the flanges of the Tee 618 and the ceilings comprise the end flanges 616 of the Tees 610. Suitable partition walls, not shown, are provided adjacent the inner end edges of stem 612 of Tee 610 whereby laterally spaced walls for hallways 622 can be provided. Also, partition walls can be disposed intermediate the sides of the building adjacent the juncture of Tees 618 to segregate the units on one side of the building from the units on the other side. As illustrated in FIG. 64, the hallway 622 need not extend the full height of stems 612 and a ceiling partition wall 623 may be provided, if desired, spaced below the ceiling forming the end flanges 616. The space between the partition wall 623 and the end flanges 616 may be utilized for the heating, ventilation and air-conditioning systems.

Referring now to the form of building illustrated in FIGS. 65–68, the first level A of this building may be constructed similarly as illustrated in FIG. 60. In this form, two distinct heights of cells are provided on each level and the height of adjacent cells alternates from one end of the building to the opposite end. In contrast to the building construction illustrated in FIG. 60 wherein a particular unit was formed by a superposed cells, a unit in the building illustrated in FIG. 65 is comprised of a pair of adjacent cells with such cells being different in height. Thus, this form of the invention provides, for example, in an apartment building, a living room of enlarged ceiling height having either an adjacent bedroom area on the same level but of reduced height or a bedroom area elevated from the living room, i.e. provides a sunken living room. To accomplish this, the basic building element of this form of builiding construction is illustrated at 630 in FIG. 66 and comprises a stem 632 having a flange 634 projecting normally to one side thereof along its upper edge and a flange 636 projecting normally to stem 632 from the opposite side thereof, but spaced below the upper edge of stem 632. That is to say, flanges 634 and 636 are vertically spaced one from the other along opposite sides of the stem. Thus, to form a pair of adjacent cells, for example, cells 638 and 640 as illustrated in FIGS. 65 and 67, pairs of building elements 630 are disposed in side-by-side relation one with the other at every other building level with adjacent elements 360 having like height flanges opposing one another. It will be appreciated that the stems 632 of adjacent elements 630 form the oppositely disposed side walls of cells defined therebetween with the ceilings therefor being defined by the opposing flanges. the cells 638 and 640 on alternate levels having high and low ceilings depending upon whether the ceiling is formed by opposing flanges 636 or 634 respectively. The end of the building is enclosed by a modified Tee indicated 642 having a stem 644 of increased height comparable to the height of stem **632*a* and a flange 646 in opposing relation with the flange 634*a* thereby to form an end cell 648 of enlarged ceiling height. The flanges 646 and 634*a*** form the ceiling for the end cell.

To form the next superposed building unit comprised of cells 650 and 652, Tees indicated generally at 654 having stems 656 of normal height, i.e., about 8 feet, and flanges 658 are superposed on the Tees 630 with the stems in vertical alinement with the stems of the underlying elements 630. Thus it will be appreciated that the opposing flanges of adjacent Tees **654*a* and 654*b* form a ceiling for the cell 650 while the stems of Tee 654*a* and 654*b* form the oppositely disposed side walls thereof. Also, the flanges of the Tees 654*b* and 654*c* form a ceiling for the cell 652 with the stems thereof forming the oppositely disposed side walls therefor. There is thus provided a pair of laterally adjacent cells 650 and 652 with the cell 650 having an enlarged ceiling height. To close off the end of the building on that level, a modified Tee 660 similarly as previously described is superposed over the enlarged modified Tee 642 with its flange in opposing relation to the flanges of Tee 654. Accordingly, alternating levels of the building ar formed utilizing the element illustrated in FIG. 66 and the standard Tee element illustrated in the building construction of FIG. 1**. Additional pairs of building levels may be added similarly as described.

The hallways for the building construction illustrated in FIG. 5 may be a superposed channel construction as illustrated in the Tee and Channel system of my copending application, now U.S. Pat. No. 3,894,373, or may be formed of pairs of modified Tees as previously described herein. The hallways 668 will of course be staggered in height in accordance with the particular building level served. For example, the hallway 6681 serving cell 638 has a height corresponding to the height of the flanges **636*a* and 636*b* whereas the hallway 668*h* serving the next superposed cell 650 has a height extending from flanges 636*a* and 636*b* to flanges 658*a* and 658*b*. Doorways are precast into the legs of the channels or modified Tees as applicable for access into the cells on the corresponding level. As in the previous embodiment, a partition wall 670 spaced below the web portion of the channel or opposing flanges of the modified Tees as applicable can be provided thereby to provide a space for the heating, ventilation, and air-conditioning systems. Suitable stairways 672** are provided for intercommunication between adjacent cells of each particular unit.

Referring now to the embodiment hereof illustrated in FIGS. 69 – 72, two sets of Tees 700 and 702 similar to the long Tees of the embodiment illustrated in FIGS. 55 – 59, are superposed one over the other and laterally juxtaposed to form a plurality of laterally adjacent ranks of Tees. The sets of Tees 700 are also disposed in end to end relation with one another. The end edges of the stems 704 and 706 of the Tees 700 and 702 respectively are inset from the end edges of the corresponding flanges whereby the overhanging end flanges 708 and 710 form common floor and ceiling sections for superposed hallway sections extending longitudinally through the central portion of the building. The Tees on each of the opposite sides of the hallways are preferably of equal length and facade panels 712 are provided on alternate Tees to provide an external wall treatment. On the intermediate Tees 700, there is provided an interior wall 714 which forms a portion of the hallway wall. Suitable interior partition panels 716 may be secured in place, after the foregoing described construction is complete, along the inner edges of the stems 704 and 706 (FIG. 70) to complete the hallway wall structure.

In this form, a plurality of box-like bathroom modules 720, similar to the modules 500 previously described with respect to FIG. 53, are superposed one over the other along the ends of alternate Tees to form a plurality of laterally spaced ranks of superposed bathroom modules along the outside of the building. The bathroom modules 720 are subdivided, as described previously, to provide a pair of bathrooms, each bathroom serving the cell on opposite sides of the Tee stem of which the bathroom module forms a longitudinal extension.

Referring now to the embodiment hereof illustrated in FIGS. 73 – 75, there is illustrated another form of substantially all Tee or modified Tee construction wherein the Tees on each level are interleaved with the Tees on next adjacent levels. In this form, a central tower or core 750 is first erected. Tower 750 may comprise a plurality of modified Tees 752 stood on end and interconnected to provide a substantially rectangular central shaft 754 in which elevator rails and elevator cabs, not shown, and/or stairways may be disposed. In this building, two sets of Tees each including a plurality of Tees 756 disposed laterally adjacent one another are located along a pair of the opposite sides of central tower 750 with each set forming a plurality of laterally spaced cells extending along one side of the building. On the next level, two sets of Tees each including a plurality of Tees disposed in laterally adjacent positions are located along the other sides of the central core or tower 750 such that the superposed set of Tees extend transversely relative to the underlying sets of Tees on the next adjacent lower level. The above described construction is repeated throughout the height of the building with the sets of Tees on any one level being interleaved with the sets of Tees of next adjacent upper and lower levels.

Particularly, and as an example of this form of building construction, the lower level sets of Tees 756*a* are disposed on a pair of the opposite sides of central tower 750. Each set includes three longitudinally extending Tees 756*a*, 756*a'* and 756*a''* which are disposed in side by side relation such that a pair of laterally adjacent cells 758*a* are provided. It will be appreciated that the Tees at the lower level of the builidng may have stems of enlarged heights, in comparision with the Tees forming the remainder of the building, as to provide lobby areas of greater ceiling height. More particularly, the outermost Tee 756*a'* of each set of Tees on the opposite sides of core 750 is formed such that a portion of the outwardly extending flange is blocked off. That is to say, the outermost Tee 756*a'* is provided with a pair of flanges 760*a*, the opposite end edges of which are inset from the ends of the stems with the opposed end edges spaced one from the other. The innermost Tee 756*a''* of each set of Tees at the lower level of the building is identical to the outermost Tee 756' but of opposite hand whereby inwardly extending flange portions 760'' are formed. Thus, when the sets of Tees at the lower level of the building are disposed adjacent opposite sides of tower 750, a pair of the modified Tees 752 forming a part of tower 750 are received between the flanges 760*a''* with the lateral edges of the flanges 760*a''* of the sets of Tees being joined one to the other.

To construct the next level of the building, similar sets of Tees are disposed along the other opposite sides of the building such that the superposed sets of Tees extend transversely relative to the underlying sets of Tees. The sets of Tees on each level are identical in all respects except as to their relative position. That is to say, the Tees 756*b*, 756*b'* and 756*b''* are disposed at right angles to the sets of Tees at the lower level of the building. It will be appreciated that the flanges of the underlying Tees including the flanges 760*a'* and 760*a''* thereof form the floors for the cells defined by the Tees at the next level. The building construction is repeated as described to the full height of the building and a column loading is effected by the superposition of Tees. With the foregoing construction, the ends of each set of Tees are thus cantilevered outwardly beyond the underlying supporting Tees a distance corresponding to the width of the flange on one side of the underlying Tees. The cells defining by such Tees can extend outwardly beyond the width of the flange of the underlying Tee by post tensioning precast slabs along the lower edges of the cantilevered stems, the stems acting as beams supporting the floor forming slabs. The areas which are open and defined between vertically registering cantilevered ends of the sets of Tees at every other level define balconies, suitable openings being provided through the stems of the intermediate Tees to provide access thereto.

Referring now to FIGS. 76 and 77, there is illustrated a modified form of Tee 800 wherein the stem 802 has a plurality of longitudinally spaced vertically extending grooves 804 precast therewith and opening laterally to one side of stem 802. A plurality of openings are formed through the top of Tee 800 in registry with grooves 804 whereby the grooves 804 and openings 806 define a plurality of recessesextending vertically throughout the full height of the Tee. It will be appreciated that when Tees 800 are superposed one over the other and recesses 804 lie in vertical alignment one with the other, such recesses 804 define a plurality of recesses extending vertically the full height of the building. These recesses may be employed for running wires, plumbing, ducts, etc. to the various cells formed by the Tees. To provide a wall structure covering the recesses 804 and the associated wires, etc. contained therein, a standard sheet of wallboard 808 may be applied as illustrated to the side of the stem containing recesses 804.

SUMMARY

In the foregoing, there has been described a series of embodiments employing a form of the new and improved industrialized and systematized building construction techniques disclosed in applicatiion Ser. No. 807,217. The present sytem has many significant advantages not only in terms of reduced cost and time involved in the basic construction, but in adaptability to an integrated systematized approach to construction of the entire building, i.e., from the first stages of erection through the last stages of finishing.

In terms of the structure, the present system has many significant advantages over previously known industrialized building systems, including reduced overall level of work skill, casting of structural elements directly at the building site with minimal need for stockpiling and reduced handling cost and time, ease and speed of interconnection between elements and rapid delivery of the central elevator core and adjacent vertical ranks of cells to the electrical and mechanical finishing trades.

In addition, the present system provides great advantages in terms of flexibility in design and construction unavailable and even inconceivable for other industrialized construction systems. On the other hand, because of the integrated and industrialized approach to design and constructiion, computer techniques may be readily adapated to all phases of the planning, design and engineering procedures for a project.

The improved system of this invention possesses several other advantages, all of which combine to enhance the attrativeness of the present system. For example, the facade bearing Tees are self-supporting whereby no bracing and shoring is required during erection. For the non-self-supporting members such as Tees without facades and modified the rapid and simple erection procedure allows the elements to be supported by a crane while the initial interconnections are made. Thereafter, the previously erected portions of the building provide the necessary support. This allows the elimination of time and expense of erecting bracing for the construction elements.

Because of the integrated approach to the plumbing, heating and electrical subsystems, including the casting in place of the various electrical conduits, etc. with preplanned access and interconnections, a finishing topping on the concrete to hide the electrical conduits, etc. is unnecessary. This allows the interior finishing trades to begin work much earlier and reduces substantially the cost of construction and financing.

Because many of the partition and exterior walls as well as the floor and ceilings are integrally cast, cross-sectional thickness of the various construction elements can be reduced, with consequent reduction in the dead load and cost of the structure, and an increase in usuable internal space for a given building size. Where large bays or cells or increased building heights are required, the Tees and modified Tees can be simply formed with cores to increased thickness thereby reducing the weight of the overall structures. Also, with the cored constructin herein described post-tensioning techniques can be utilized. Additional important and significant features of the invention will be appreciated by those skilled in the art in light of the foreging description.

The invention may be embodied in other specific forms without departing from the spirit or essential characteristics thereof. The present embodiments are therefore to be considered in all respects being indicated by the appended claims rather than by the foregoing description, and all changes which come within the meaning and range of equivalency of the claims are therefore intended to be embraced therein.

What is claimed and desired to be secured by United States Letters Patent is:

1. A building construction for human occupancy having a plurality of cells each including at least a floor, a ceiling, and a pair of oppositely disposed side walls comprising first, second and third elements forming portions of said cells, each of said first and third elements including an elongated member having a stem and a flange extending substantially normal to said stem along one side thereof, said second element including a member having a stem and a pair of flanges extending substantially normal to said stem along opposite sides thereof, said first, second and third elements being arranged in respective substantially side-by-side relation with said second element intermediate said first and third elements, the respective flanges of said second element lying in opposed relation with the flanges of said first and third elements, the stems of said first and second elements and said second and third elements lying in spaced generally parallel planes and respectively forming the generally oppositely disposed side wall portions of cells defined therebetween, a fourth element forming portions of said cells, said fourth elements comprising a box like member having side and end walls and a horizontal wall lying in a plane containing common edge portions of said side and end walls, said fourth element having a lateral dimension substantially coextensive with the width of said second element, said fourth element being disposed between said first and third elements and adjacent an end of said second element with said horizontal wall lying in substantial coplanar relation with the flanges of said first, second and third elements, the walls of said fourth element forming wall portions of said cells, said stems and said latter wall portions extending substantially he entire distance between the floors, and ceilings of said cells sufficiently to at least accommodate an adult human being standing in an erect position on the floor, and means connecting the opposing flange of said first and second elements and said second and third elements and connecting said fourth element to at least one of said first, second and third elements.

2. The building construction according to claim 1 wherein said fourth element includes an interior partition wall dividing said element into two discrete areas, first means providing access between one of said cells and one of said areas, and second means providing access between the other of said cells and the other of said areas.

3. A building construction according to claim 1 including a hallway comprising a member having a length at least equal to the distance between the stems of said first and third elements, at least a portion of said hallway comprising a wall portion having a height substantially coextensive with the height of said elements, said hallway member and said elements being relatively arranged such that the edges of the stems of said first and third elements and the flanges thereof at like ends of the respective cells and the wall portion of said hallway member lie in close juxtaposition, said hallway wall portion forming at least a portion of an end wall for said cells.

4. The building construction according to claim 1 wherein like end edges of the stems of said first and third elements are inset from their corresponding flanges to provide projecting end flanges, said fourth element having a flange projecting to one side thereof and lying in said plane, the flange of said fourth element lying in coplanar relation with the end flanges of said first and third elements and projecting therewith to form horizontal wall portions of a hallway extending along one side of the cells defined by said elements.

5. A building construction for human occupancy having a plurality of cells each including at least a floor, a ceiling, and a pair of oppositely disposed side walls comprising first, second and third elements forming portions of said cells, each of said first and third elements including an elonated member having a stem and a flange extending substantially normal to said stem along one side thereof, said second element including a member having a stem and a pair of flanges extending substantially normal to said stem along opposite sides thereof, said first, second and third elements being arranged in respective substantially side-by-side relation with said second element intermediate said first and third elements, the respective flanges of said second element lying in opposed relation with the flanges of said first and third elements, the stems of said first and second elements and said second and third elements respectively forming the generally oppositely disposed side wall portions of cells defined therebetween, a fourth element forming portions of said cells, said fourth element comprising a box like member having side and end walls and a horizontal wall lying in a plane containing common edge portions of said side and end walls, said fourth element having a lateral dimension substantially coextensive with the width of said second element, said fourth element being disposed between said first and third elements and adjacent an end of said second element with said horizontal wall lying in substantial coplanar relation with the flanges of said first, second aand third elements, the walls of said fourth element forming wall portions of said cells, said stems and said latter wall portions extending substantially the entire distance between the floors and ceilings of said cells sufficiently to at least accommodate an adult human being standing in an erect position on the floor, means connecting the opposing flanges of said first and second elements and said second and third elements and connecting said fourth element to at least one of said first, second and third elements, said third element including a flange extending substantially normal to its stem along the opposite side thereof, fifth and sixth elements forming portions of said cells, said fifth element including a member having a stem and a pair of flanges extending normal to said stem along opposite sides thereof, said sixth element including an elongated member having a stem and a flange extending substantially normal to said stem along one side thereof, said fifth and sixth elements being arranged in respective substantially side-by-side relation adjacent said third element with said fifth element lying intermediate said third and sixth elements, the respective flanges of said fifth element lying in opposed relation with the flanges of said third and sixth elements, the stems of said third and fifth elements and said fifth and said sixth elements forming the generally oppositely disposed side wall portions of respective cells defined therebetween, a seventh element forming portions of said latter cells, said seventh element comprising a box-like member having side and end walls and a horizontal wall lying in a plane containing common edge portions of said side and end walls, said seventh element having a lateral dimension substantially coextensive with the width of said fifth element, said seventh element being disposed between said third and sixth elements and adjacent an end of said fifth element with its horizontal wall lying in substantial coplanar relation with the flanges of said fifth and sixth elements, the walls of said seventh element forming wall portions of said latter cells, said stems and said latter wall portions extending substantially the entire distance between the floors and ceilings of said latter cells sufficiently to at least accommodate an adult human being standing in an erect position on the floor, and means connecting the opposing flanges of said third and fifth elements and said fifth and sixth elements and connecting said seventh element to at least one of said third, fifth and sixth elements.

6. A building construction for human occupancy having a plurality of cells each including at least a floor, a ceiling, and a pair of oppositely disposed side walls comprising first, second and third elements forming portions of said cells, each of said first and third elements including an elongated member having a stem and a flange extending substantially normal to said stem along one side thereof, said second element including a member having a stem and a pair of flanges extending substantially normal to said stem along opposite sides thereof, said first, second and third elements being arranged in respective substantially side-by-side relation with said second element intermediate said first and third elements, the respective flanges of said second element lying in opposed relation with the flanges of said first and third elements, the stems of said first and second elements and said second and third elements respectively forming the generally oppositely disposed side wall portions of cells defined therebetween, a fourth element forming portions of said cells, said fourth element comprising a box-like member having side and end walls and a horizontal wall lying in a plane containing common edge portions of said side and end walls, said forth element having a lateral dimension substantially coextensive with the width of said second element, said fourth element being disposed between said first and third elements and adjacent an end of said second element with said horizontal wall lying in substantial coplanar relation with the flanges of said first, second and third elements, the walls of said fourth element forming wall portions of said cells, said stems and said latter wall portions extending substantially the entire distance between the floors and ceilings of said cells sufficiently to at least accommodate and adult human being standing in an erect position on the floor, means connecting the opposing flanges of said first and second elements and said second and third elements and connecting said fourth element to at least one of said first, second and third elements, fifth, sixth and seventh elements forming portions of said cells, each of said fifth and seventh elements including an elongated member having a stem along one side thereof, said sixth element including a member having a stem and a pair of flanges extending substantially normal to said stem along opposite sides thereof, said fifth, sixth and seventh elements being arranged in respective substantially side-by-side relation with said sixth element intermediate said fifth and seventh elements, the respective flanges of said sixth element lying in opposed relation with the flanges of said fifth and seventh elements, the stems of said fifth and sixth elements and said sixth and seventh elements forming generally oppositely disposed wall portions of respective third and fourth cells defined therebetween, an eighth element comprising a box-like member having side and end walls and a horizontal wall lying in a plane containing common edge portions of the latter side and end walls, said eighth element having a lateral dimension substantially coextensive with the width of said sixth element, said eighth element being disposed between said fifth and seventh elements and adjacent an end of said sixth element with said horizontal wall lying in substantial coplanar relation with the flanges of said fifth, sixth and seventh elements, the wall of said seventh element forming portions of said third and fourth cells, said stems of said fifth, sixth and seventh elements and said latter wall portions of said eighth element extending substantially the distance between the floors and ceiling of said third and fourth cells sufficiently to at least accommodate an adult human being standing in an erect position on the floor, said fifth, sixth and seventh elements being respectively superposed over said first, second and third elements, the stems of said superposed elements being in substantial vertical alignment with the respective stems of the underlying elements, said eighth element being superposed over said fourth element, with the side and end walls of said eighth elements being in substantial vertical alignment with the respective side and end walls of the unerlying fourth element, means connecting said opposing flanges of said fifth and sixth elements and said sixth and seventh elements, means respectively connecting said fifth, sixth, and seventh elements to said first, second and third elements, the opposing flanges of one of said first, second and third elements or said fourth, fifth and sixth elements forming the common floor and ceiling between said first and third cells and said second and fourth cells.

7. The building construction according to claim 1 wherein like end edges of said first, third and fifth and seventh elements are inset from their corresponding flanges to provide projecting end flanges, said fourth and eighth elements having flanges projecting to one side thereof and lying in the respective planes containing said horizontal walls, the flange of said fourth element lying in coplanar relation with the end flanges of said first and third elements and projecting therewith to form a horizontal wall portion of a first hallway extending along one side of the cells defined by said first, second, third and fourth elements, the flange of said eighth element lying in coplanar relation with the end flanges of said fifth and seventh elements and projecting therewith to form a horizontal wall portion of a second hallway superposed over said first hallway and extending along one side of the cells defined by said fifth, sixth, seventh and eighth elements, one of said horizontal wall portions forming a common ceiling and floor for said first and second hallways respectively.

8. A building construction for human occupancy having a plurality of cells each including at least a floor, a ceiling, and a pair of oppositely disposed side walls comprising first, second and third elements forming portions of said cells, each of said first and third elements including an elongated member having a stem and a flange extending substantially normal to said stem along one side thereof, said second element including a member having a stem and a pair of flanges extending substantially normal to said stem along opposite sides thereof, said first, second and third elements being arranged in respective substantially side-by-side relation with said second element intermediate said first and third elements, the respective flanges of said second element lying in opposed relation with the flanges of said first and third elements, the stems of said first and second elements and said second and third elements respectively forming the generally oppositely disposed side wall portions of cells defined therebetween, a fourth element forming portions of said cells, said fourth element comprising a box-like member having side and end walls and a horizontal wall lying in a plane containing common edge portions of said side and end walls, said fourth element having a lateral dimension substantially coextensive with the width of said second element, said fourth element being disposed between said first and third elements and adjacent an end of said second element with said horizontal wall lying in substantial coplanar relation with the flanges of said first, second and third elements, the walls of said fourth element forming wall portions of said cells, said stems and said latter wall portions extending substantially the entire distance between the floors and ceilings of said cells sufficiently to at least accommodate an adult human being standing in an erect position on the floor, means connecting the opposing flanges of said first and second elements and said second and third element to at least one of said first, second and third elements, fifth and sixth and seventh elements forming portions of said cells, each of said fifth and seventh elements including an elongated member having a stem and a flange extending substantially normal to said stem along one side thereof, said sixth element including a member having a stem and a pair of flanges extending substantially normal to said stem along opposite sides thereof, said fifth, sixth and seventh elements being arranged in respective substantially side-by-side relation with said sixth elememt intermediate said fifth and seventh elements, the respective flanges of said sixth element lying in opposed relation with the flanges of said fifth and seventh elements, the stems of said fifth and sixth elements and said sixth and seventh elements respectively forming the generally oppositely disposed side wall portions of cells defined therebetween, an eighth element forming positions of said cells, said eighth element comprising a box-like member having side and end walls and a horizontal wall lying in a plane containing common edge portions of said side and end walls, said eighth element having a lateral dimension substantially coextensive with the width of said fifth element, said eighth element being disposed between said fifth and seventh elements and adjacent an end of said sixth element with said horizontal wall lying in substantial coplanar relation with the flanges of said fifth, sixth and seventh elements, the walls of said eighth element forming wall portions of said cells, said stems and said latter wall portions extending substantially the entire distance between the floors and ceilings of said cells sufficiently to at least accommodate an adult human baing standing in an erect position on the floor, and means connecting the opposing flanges of said fifth, and sixth elements and said sixth and seventh elements and connecting said eighth element to at least one of said fifth, sixth and seventh elements, like end edges of said first, and third elements and said fifth and seventh elements being inset from their corresponding flanges to provide projecting end flanges, said fourth and eighth elements having flanges projecting to one side thereof and lying in the plane containing said horizontal walls and the projecting end flanges of said first, third, fifth and seventh elements, said first and third elements and said fifth and seventh elements being arranged in respective end to end relation with their respective flanges in opposing relation, said fourth and eighth element being disposed in spaced side-by-side relation with their flanges in opposing relation, means connecting the end flanges of said first and fifth elements and said third and seventh elements, means connecting the flanges of said fourth and eighth elements, said end flanges and the flanges of said fourth and eighth elements lying in a common plane and forming a horizontal wall portion of a hallway extending between the cells defined by said first, second, third and fourth elements and the cells defined by said fifth, sixth, seventh and eighth elements.

9. A building construction for human occupancy having a plurality of internal cells each including at least a floor, ceiling, and a pair of oppositely disposed side walls, comprising first and second preformed elements forming portions of said cells, each of said elements comprising an elongated generally T-shaped member having a stem and a pair of flanges extending substantially normal to said stem along opposite sides thereof, said first and second elements being arranged in substantially side-by-side relation with a flange on each element in opposing relation, and with the stems thereof forming generally oppositely disposed side walls of a cell defined therebetween, said stems extending substantially the entire distance between the floor and ceiling of said cell sufficiently to at least accommodate an adult human being standing in an erect position on the floor and for a height at least seven feet, means connecting said oppossing flanges of said first and second elements, each said element having a length at least twice its height, each of said elements including a planar endwise projection constituting a continuation of said flanges at like ends of said elements with the edges of the stems at the like ends of the elements being inset from the end edges of the projecting flanges.

10. A building construction according to claim 9 wherein said end projection is in the form of a dihedral with the apex thereof lying in a plane containing the stem.

11. A building construction for human occupancy having a plurality of internal cells each including at least a floor, a ceiling, and a pair of oppositely disposed side walls, comprising first and second preformed elements forming portions of said cells, each of said elements comprising an elongated generally T-shaped member having a stem and a pair of flanges extending substantially normal to said stem along opposite sides thereof, said first and second elements being arranged in respective, substantially side-by-side relation with a flange on each element in opposing relationship, and with the stems thereof forming the generally oppositely disposed side walls of a cell defined therebetween, said stems extending substantially the entire distance between the floor and ceiling of said cell sufficiently to at least accommodate an adult human being standing in an erect position on the floor and for a height at least seven feet, each said element having a length at least twice its height, at least one of said stems having an enlarged opening through its stem of a longitudinal extent greater than one-half of the longitudinal extent of the element, the distance between the edge of the stem defining the upper edge of the opening and the lower edge of the stem being sufficient to at least accommodate an adult human being standing in an erect position on the floor and for a height at least seven feet, the portion of said stem between said first mentioned edge and said flanges forming a generally T-shaped beam intermediate the ends of said elements, and means connecting said registering flanges of said first and second elements, said flanges forming a ceiling for said cell; said building construction including a pair of upstanding columns for each of said elements, said elements being superposed on said columns with the opposite end portions of said stems lying in vertical registry with said columns whereby cells of enlarged height may be provided.

12. A building construction for human occupancy having a plurality of internal cells each including at least a floor, a ceiling, and a pair of oppositely disposed side walls, comprising first, second, third and fourth elements forming portions of said cells, each of said elements comprising an elongated, generally T-shaped member having a stem and a pair of flanges extending substantially normal to said stem along the opposite sides thereof, said first and second elements being arranged in substantially side-by-side relation with a flange on each element in opposing relationship, and with the stems thereof forming the generally oppositely disposed side walls of a cell defined therebetween, said third and fourth elements being arranged in substantially side-by-side relation with a flange on each element in opposing relationship, and with the stems thereof forming the generally oppositely disposed side walls of a second cell defined therebetween, said stems extending substantially the entire distance between the floor and ceiling of the respective cells sufficiently to at least accommodate a human being in an erect position standing on the floor, means connecting said opposing flanges of said first and second elements together and said third and fourth elements together to form respective ceilings for said first and second cells, said third and fourth elements being respectively superposed over said first and second elements whereby said second cell is superposed over said first cell, the stems of said superposed elements being in substantial vertical alignment with the respective stems of the underlying elements, the opposing flanges of said first and second elements forming the floor if saud second cell, means respectively connecting said third and fourth elements to said first and second elements, first and second hallways adjacent said first and second cells, said hallways each being defined by a pair of elongated members each having a stem and a flange extending substantially normal to said stem along one side thereof, the stems of each pair of members being arranged in substantially side-by-side relation one to the other with the edges of their flanges lying in close juxtaposition one with the other to form a composite channel-shaped hallway, the stems of said hallway forming members having a height substantially coextensive with the height of said first, second, third, and fourth elements, one of said composite channels being superposed over the other of said composite channels with the stems of said members forming said channels lying substantially vertical registry one with the other on opposite sides of the hallways, said first composite channel and said first and second elements being relatively arranged such that the edges of the stems and the opposed flanges of said first and second elements at one end of said first cell lie juxtaposed one stem of said first composite channel with said latter stem forming at least a portion of the end wall for said first cell, said superposed second composite channel and said third and fourth elements being relatively arranged such that the edges of the stems and adjacent flanges of said third and fourth elements at one end of the second cell lie juxtaposed one stem of said second composite channel with said latter stem forming at least a portion of the end wall of said second cell; said building construction including an elevator tower, said tower comprising a pair of elongated members each having a stem and a flange extending substantially normal to said stem along one side thereof, said tower members being disposed on their ends and extending vertically a distance at least equal to the combined height of said first and second composite channels with the stems thereof lying in spaced sustantially side-by-side relation one to the other and the edges of the flanges lying in close juxtaposition one to the other to form a vertically extending composite elevator tower channel, said composite elevator channel being adapted to carry an elevator cab, said first and second composite channels and said composite elevator channel being relatively such that the stems on one side of said first and second composite hallway channels abut the stems of said vertically extending composite elevator channel, one of said stems in each composite hallway channel having a doorway therethrough for providing access between the elevator cab carried within said tower and the hallways.

13. A building construction for human occupancy having a plurality of internal cells each including at least a floor, a ceiling, and a pair of oppositely disposed side walls, comprising first, second, third and fourth elements forming portions of said cells, each of said elements comprising an elongated, generally T-shaped member having a stem and a pair of flanges extending substantially normal to said stem along the opposite sides thereof, said first and second elements being arranged in substantially side-by-side relation with a flange on each element in opposing relationship, and with the stems thereof forming the generally oppositely disposed side walls of a cell defined therebetween, said third and fourth elements being arranged in substantially side-by-side relation with a flange on each element in opposing relationship, and with the stems thereof forming the generally oppositely disposed side walls of a second cell defined therebetween, said stems extending substantially the entire distance between the floor and ceiling of the respective cells sufficiently to at least accommodate a human being in an erect position standing on the floor, means connecting said opposing flanges of said first and second elements together and said third and fourth elements together to form respective ceilings for said first and second cells, said third and fourth elements being respectively superposed over said first and second elements whereby said second cell is superposed over said first cell, the stems of said superposed elements being in substantial vertical alignment with the respective stems of the underlying elements, the opposing flanges of said first and second elements forming the floor of said second cell, means respectively connecting said third and fourth elements to ssaid first and second elements, first and second hallways adjacent said first and second cells, said hallways each being defined by a pair of elongated members each having a stem and a flange extending substantially normal to said stem along one side thereof, the stems of each pair of members being arranged in substantially side-by-side relation one to the other with the edges of their flanges lying in close juxtaposition one with the other the form a composite channelshaped hallway, the stems of said hallway forming members having a height substantially coextensive with the height of said first second, third and fourth elements, one of said composite channels being superposed over the other of said composite channels with the stems of said members forming said channels lying in substantial vertical registry one with the other on opposite sides of the hallways, said first composite channel and said first and second elements being relatively arranged such that the edges of the stems and the opposed flanges of said first and second elements at one end of said first cell lie juxtaposed one stem of said first composite channel with said latter stem forming at least a portion of the end wall for said first cell, said superposed second composite channel and said third and fourth elements being relatively arranged such that the edges of the stems and adjacent flanges of said third and fourth elements at one end of the second cell lie juxtaposed one stem of said second composite channel with said latter stem forming at least a portion of the end wall of said second cell.

* * * * *